US010542784B2

(12) United States Patent
Groff

(10) Patent No.: US 10,542,784 B2
(45) Date of Patent: Jan. 28, 2020

(54) EXTENDER BELTS FOR PANTS AND TROUSERS

(71) Applicant: VISCERAL ENTERPRISES, INC., Newport Coast, CA (US)

(72) Inventor: Lynn T Groff, Newport Coast, CA (US)

(73) Assignee: Visceral Enterprises, Inc., Newport Coast, CA (US)

( * ) Notice: Subject to any disclaimer, the term of this patent is extended or adjusted under 35 U.S.C. 154(b) by 60 days.

(21) Appl. No.: 15/650,907

(22) Filed: Jul. 15, 2017

(65) Prior Publication Data

US 2018/0014591 A1 Jan. 18, 2018

Related U.S. Application Data

(60) Provisional application No. 62/363,167, filed on Jul. 15, 2016.

(51) Int. Cl.
*A41F 9/02* (2006.01)
*A41F 9/00* (2006.01)

(52) U.S. Cl.
CPC ..... *A41F 9/025* (2013.01); *A41F 9/002* (2013.01); *A41D 2200/10* (2013.01); *A41D 2300/30* (2013.01)

(58) Field of Classification Search
CPC .. A41F 9/002; A41F 9/025; A41F 9/00; A41F 9/02; A41F 1/02; A41F 18/00;
(Continued)

(56) References Cited

U.S. PATENT DOCUMENTS 84,082 A * 11/1868 Boylson ..... A41F 9/002 2/339
121,992 A 12/1871 Clemens
(Continued)

FOREIGN PATENT DOCUMENTS

CN 102631039 A 8/2012

OTHER PUBLICATIONS

Comfy Pants Bundle online advertisement, Comfy Clothieres, Jun. 2, 2016; 17 pages.
(Continued)

*Primary Examiner* — Amy Vanatta
(74) *Attorney, Agent, or Firm* — Rutan & Tucker, LLP

(57) ABSTRACT

In one embodiment, an extender belt for clothing is disclosed including a belt strap, a belt buckle coupled to the belt strap, and an extender button coupled to the belt strap. The belt strap is configured to be wrapped around the waist of a user and form a loop. The belt strap has a series of a plurality of openings near a first end configured to receive a protrusion or prong of the belt buckle. The belt strap further has one or more buttonholes near a second end configured to receive a button of the pants or trousers. The belt buckle is pivotally coupled to the belt strap near the second end. The belt buckle has the pivotal protrusion or prong configured to extend into the plurality of openings near the first end. The extender button is coupled to an inner surface of the belt strap near the first end. The extender button is configured to extend into a pant hole of pants that typically receive the pant button. The belt strap can have a wide portion configured to cover over an open zipper and an open waist of the pants or trousers.

16 Claims, 50 Drawing Sheets

(58) Field of Classification Search
CPC ..... A41D 2300/30; A41D 1/06; A41D 1/21; A41D 2200/10; A41D 2300/326
USPC ... 2/235, 219, 339, 340, 338, 311, 312, 237, 2/221, 318, 322, 321
See application file for complete search history.

(56) References Cited

U.S. PATENT DOCUMENTS

D26,756 S 3/1897 Sanders
D30,922 S 5/1899 Deitsch
656,666 A * 8/1900 Scheuer ..... A41F 9/002 2/270
701,252 A 5/1902 Bandler
D36,979 S 6/1904 Hauser
822,710 A 5/1906 Askew
871,426 A 11/1907 Melanson et al.
1,017,544 A 2/1912 Hoffman
1,085,451 A * 1/1914 Lynch ..... F42B 39/02 224/223
1,128,824 A 2/1915 Struck
1,234,165 A 7/1917 Hill
1,378,207 A * 5/1921 Awner ..... A41F 9/00 2/312
1,384,440 A * 7/1921 Faust ..... A41F 9/00 2/321
1,471,604 A 6/1922 Heller
1,559,291 A 10/1925 Simmons
1,607,156 A 11/1926 Godshaw
1,639,383 A * 8/1927 Moretti et al. ..... A41F 9/002 2/310
1,705,562 A 4/1928 Fretz et al.
1,841,385 A * 1/1932 Speirs ..... A41F 9/002 2/320
D90,632 S 6/1933 Silverman
2,049,414 A * 8/1936 Cohen ..... A44B 11/24 2/322
2,084,720 A * 6/1937 Alexandre ..... A41F 9/025 2/237
2,108,175 A 2/1938 Miller
2,194,100 A 11/1938 Shikler
2,159,857 A 5/1939 Mix
2,386,708 A * 10/1945 Morrison ..... A41F 9/00 2/312
2,389,298 A 11/1945 Ellis
2,590,915 A 9/1949 Allison
2,487,649 A * 11/1949 Grisanti ..... A41F 9/002 2/322
2,503,157 A 4/1950 Knee
D161,666 S 1/1951 Wade et al.
2,544,333 A 3/1951 Lembo
2,653,323 A 9/1951 Ganim
2,583,992 A * 1/1952 Bouteloup ..... A41F 9/025 2/237
2,625,688 A 1/1953 Kaufman
D169,683 S 5/1953 Kellerman
2,885,685 A * 5/1959 Carr ..... A41F 9/002 2/321
2,914,070 A 11/1959 Kellner et al.
2,916,742 A 12/1959 Sobel
3,017,641 A 1/1962 Stollman
3,038,166 A 6/1962 Tobias
3,091,772 A 6/1963 Hebras
3,191,603 A 6/1965 Marino
D207,770 S 5/1967 Loston
D216,075 S 11/1969 D'Ella et al.
3,501,775 A * 3/1970 Moon ..... A41F 9/002 2/321
3,793,645 A * 2/1974 Kadison ..... A41F 9/025 2/221
D231,155 S 4/1974 Bowcut
D238,315 S 1/1976 Terwilleger
D241,188 S 8/1976 Lanham
4,139,913 A 2/1979 Garin et al.
4,164,044 A 8/1979 Holmes
4,545,370 A * 10/1985 Welsh ..... A61F 5/028 128/95.1
4,580,298 A 4/1986 Tuisl
4,620,326 A 11/1986 Matthias, Jr.
4,683,595 A 8/1987 Cash
4,800,594 A 1/1989 Young
4,803,740 A 2/1989 Dawson
4,975,987 A 12/1990 Teachout et al.
4,999,853 A 3/1991 Tanner
5,163,184 A 11/1992 Reardon
D359,836 S 7/1995 Shuler
D373,011 S 8/1996 Rippel
5,566,397 A 10/1996 Scott
D375,823 S 11/1996 Bleiweis
5,575,011 A 11/1996 Allen
5,623,735 A 4/1997 Perry
5,638,550 A 6/1997 Hube
D381,787 S 8/1997 Littleton
5,826,280 A 10/1998 Bradley
5,852,829 A 12/1998 Relaford
5,946,730 A 9/1999 Blair
5,983,403 A 11/1999 Neeley
D418,274 S 1/2000 Sartel
6,044,496 A 4/2000 Ramirez
6,067,661 A 5/2000 Bates
D428,237 S 7/2000 Murdock
6,085,356 A 7/2000 Redmond, Sr.
D436,714 S 1/2001 Korff
6,219,848 B1 4/2001 Russell
6,286,152 B1 9/2001 Mooneyhan et al.
6,339,848 B1 1/2002 Mayhood et al.
6,385,777 B1 5/2002 Hamada et al.
6,434,753 B2 8/2002 Kato
6,526,597 B1 3/2003 Shepard
6,671,888 B2 1/2004 Wallace
6,681,406 B2 1/2004 Yang
6,842,912 B1 1/2005 King et al.
D503,508 S 4/2005 Hooker et al.
D517,775 S 3/2006 Cook et al.
7,181,775 B2 2/2007 Carney
D544,677 S 6/2007 Wuolu, Jr.
7,275,667 B2 10/2007 Bertucci
D555,328 S 11/2007 Gilbert-Biro et al.
D568,579 S 5/2008 Mouquet
D578,751 S * 10/2008 Holtzclaw, Jr. ..... A41F 9/025 D3/224
D585,181 S 1/2009 Mouquet
D599,080 S 9/2009 Pantoja
D610,327 S 2/2010 Cavarra
D614,379 S 4/2010 Campbell
D619,780 S 7/2010 Hooker et al.
7,895,673 B2 3/2011 Forselius et al.
7,908,677 B1 3/2011 Montgomery
D637,789 S 5/2011 Chandihok
D637,795 S 5/2011 Hooker et al.
7,963,953 B2 6/2011 Erdman et al.
D642,356 S 8/2011 Wells et al.
8,015,623 B2 9/2011 Lee et al.
D656,297 S 3/2012 Christian
D658,350 S 5/2012 Goodman
D659,947 S 5/2012 Mouquet
D661,460 S 6/2012 Roy
8,266,723 B2 9/2012 Frandsen et al.
D707,917 S 7/2014 James et al.
8,763,164 B2 7/2014 MacGillivray
D716,543 S 11/2014 McMullen
D721,466 S 1/2015 Boyles et al.
D726,993 S 4/2015 Ermel
D728,196 S 5/2015 Stevens
9,044,309 B2 6/2015 Allen
D739,117 S 9/2015 Holloway et al.
9,119,426 B1 9/2015 Skanron
9,125,440 B1 9/2015 Guerrero
D741,571 S 10/2015 Tulin et al.
D743,668 S 11/2015 Holloway et al.
D746,051 S 12/2015 Conway
D747,591 S 1/2016 Holloway et al.
D755,076 S 5/2016 Blocker
D763,549 S 8/2016 Davis

(56) References Cited

U.S. PATENT DOCUMENTS

| | | | | |
|---|---|---|---|---|
| D768,359 | S | 10/2016 | Lago | |
| 2004/0163159 | A1 | 8/2004 | Edwards et al. | |
| 2006/0090710 | A1 | 5/2006 | Zazzara et al. | |
| 2007/0123148 | A1 | 5/2007 | Heer | |
| 2007/0271684 | A1 | 11/2007 | Ramirez et al. | |
| 2007/0271685 | A1 | 11/2007 | Ramirez et al. | |
| 2008/0172769 | A1 | 7/2008 | Herget | |
| 2009/0126083 | A1* | 5/2009 | Holtzclaw, Jr. ..... | A41F 9/002 2/300 |
| 2010/0235965 | A1 | 9/2010 | Frandsen et al. | |
| 2010/0235968 | A1 | 9/2010 | Lee et al. | |
| 2011/0314593 | A1 | 12/2011 | Anderson | |
| 2014/0208485 | A1 | 7/2014 | Kjar | |
| 2018/0055119 | A1 | 3/2018 | Groff | |

OTHER PUBLICATIONS

Pants Bundle Extenders—online advertisement, Comfy Clothieres, Oct. 26, 2015; 8 pages.

Comfy Buttons for Jeans—online advertisement, Comfy Clothieres, Jun. 2, 2016; 4 pages.

U.S. Appl. No. 15/805,091, filed Nov. 6, 2017 Advisory Action dated Feb. 15, 2019.

U.S. Appl. No. 15/805,091, filed Nov. 6, 2017 Advisory Action dated Mar. 18, 2019.

U.S. Appl. No. 15/805,091, filed Nov. 6, 2017 Final Office Action dated Jan. 2, 2019.

U.S. Appl. No. 15/805,091, filed Nov. 6, 2017 Non-Final Office Action dated Feb. 8, 2018.

* cited by examiner

EXTENDER BELTS FOR PANTS AND TROUSERS

RELATED APPLICATIONS

This application claims the benefit of U.S. Provisional App. No. 62/363,167 titled EXTENDER BELTS filed on Jul. 15, 2016 by Lynn Groff incorporated herein by reference.

FIELD

The embodiments disclosed relate generally to belts for clothing.

BRIEF SUMMARY

The embodiments of extender belts solve a classic problem for women, men (and even children) whose weight or mid-section varies from time to time. The extender belts combine an extension feature with fashionable belt designs to form a secure and reliable way to hide an open waistband (e.g., open button and open zipper) on jeans, pants, trousers, skirts and/or shorts.

What makes an extender belt particularly useful is that there are no belt parts to connect to each other before wearing. The extender belt is a contiguous belt including an extender strip, but for the optional removable snap-on extender strip. Even when one side of the extender strip is sewn to a backside of the belt strap, it is still considered a contiguous belt. Regardless of style, there is no embarrassing or unsightly extender or unusual hardware to be seen on the outside. The embodiments of the extender belt conceal the devices used to couple the extender belt to the pants or trousers.

Additionally, the embodiments of extender belts allow users to tuck in their shirts or just avoid the worry that the device used to close the waist of the pants or trousers will be revealed with movement of their blouse, pullover or shirt.

Because the extender sections of each embodiment of extender belt are completely hidden from sight, the extender belts can also be worn as belts for mainstream fashion clothing.

BRIEF DESCRIPTIONS OF THE DRAWINGS

FIGS. 1-6 show views of a first extender belt.
FIGS. 7-12 show views of a second extender belt.
FIGS. 13-20 show views of a third extender belt.
FIGS. 21-26 show views of a fourth extender belt.
FIGS. 27-34 show views of a fifth extender belt.
FIGS. 35-41 show views of a sixth extender belt.
FIGS. 42-48 show views of a seventh extender belt.
FIGS. 49-54 show views of a eight extender belt.
FIGS. 55-62 show views of a ninth extender belt.
FIGS. 63-69 show views of a tenth extender belt.
FIGS. 70-75 show views of a eleventh extender belt.
FIGS. 76-82 show views of a twelfth extender belt.
FIGS. 83-90 show views of a thirteenth extender belt.
FIGS. 91-98 show views of a fourteenth extender belt.

Figure 1:
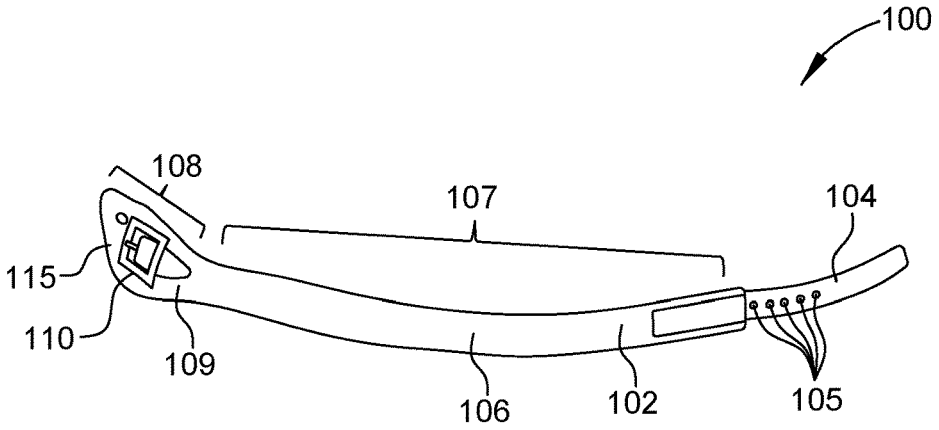

The figures of each embodiment of extender belt are not drawn to the same scale. A number of drawings of each embodiment have been enlarged and/or show magnified portions to more clearly show various aspects and features of each embodiment of extender belt. The different sized views and magnified portions do not represent alternate embodiments. Various materials with surface variations are used in the each embodiment of extender belt. Visible surface variations in the drawings due to the material, if any, are not a part of any ornamental design being claimed.

DETAILED DESCRIPTION

In the following detailed description of the embodiments, numerous specific details are set forth in order to provide a thorough understanding. However, it will be obvious to one skilled in the art that the embodiments disclosed can be practiced without these specific details. In other instances well known methods, procedures, components, and circuits have not been described in detail so as not to unnecessarily obscure aspects.

The embodiments include methods and apparatus for extender belts.

Extender Belt Function

An extender belt can be used when garments, typically jeans or pants, are too small leaving an open waist region. As a person's weight fluctuates, in a day, week, month or over years, the open waist region in jeans or pants can vary. For example, pregnant women in their first trimester and post pregnancy in particular, undergo weight fluctuations and do not want to buy a new wardrobe for transitional times. The extender belt can be adjusted to varying sizes to meet that need without purchasing a costly new wardrobe each time.

An extender belt can couple onto jeans/pants via a button and buttonhole or a hook and a bar (latch). In one embodiment, the extender feature of an extender belt can include one or more buttons and a plurality of buttonholes (e.g., three or more holes), depending on the style of the extender belt. Some of the extender belts combine together buttons and/or buttonholes with hook and/or bar (latch) connectors so that it can be used with different types of pants.

Product Benefits and Uses

A key benefit of the extender belts is that it allows the user to wear clothing that was nearly impossible before, particularly jeans and pants that fit comfortably—other than around the waist or mid hip, while maintaining a sophisticated look. The ideal usage case for an extender belt is when the top of the garment can't close. Regardless, the disclosed extender belts are easy to wear and take off.

Women who want to conceal a "muffin top" at mid-waist can do so with contoured, wide extender belts worn over regular pants or over jeans with belt loops—with or without the extender feature being used.

The various styles and features of extender belts e.g., wide buckles or wider leather design, help hide the open button and/or zipper by covering cover that area. The various extender belt styles also include those that are of a standard width that can go through the loops of jeans or pants and not just those with wider belts or straps that go over pants. The extender belt styles with the standard width are ideal for pants or jeans that are closer to fitting.

Regardless of how the extender feature portion is built into a belt, such as with one or more buttons facing inward or outward, the extender feature provides a sense of security that pants will not open further and is relatively hidden to avoid embarrassment that an extender will suddenly show.

Worn Under and/or Over Clothing

The Extender belts enable the wearer to tuck in a blouse or shirt if they wish to do so. The extender belt can be formed of many styles that are relatively thin and flat rather than bulky, so that the extender belts can also be worn under loose blouses and shirts. Furthermore, when wearing an extender belt without using the extender feature, the wide contoured portion of the extender belt can still hide an open button and/or zipper because of its width. In other cases of an extender belt, a large width of a buckle of an extender belt can hide an open button and/or zipper. An extender belt can also be worn over a blouse, tunic or sweater, achieve the camouflage of an open button and/or zipper—often with a flattering, contoured design.

Variables that Can Apply to All Extender Belts

There are many ways that an extender belt can be designed which all achieve the same basic objective. Some of the variables that an expender belt can be constructed and designed are as follows:

1. Belts can be designed for low, mid or high wasted jeans, pants, shorts, skirts. And if the extender portion is not being used, it can be worn over dresses, as well, or skirts without buttons, e.g., elastic waist, as a mainstream belt.
2. While many of the belt straps shown are contoured in shape to be flattering to women, they can be straight as well. The straps can vary in width, including the overlapping straps.
3. Buckles can be in any shape or size, and can either fit through belt loops or overlap on the garment.
4. The extender portion that attaches to clothing in the middle of the wearers pants, can have the connector button (which fastens onto your buttonhole)—either facing the pants or facing away from the pants—depending on belt style. (See the "Overlapping Double Belt.")
5. Extender features can use buttons; hook and bar closures (hook and bars are typically found on women and men's dress pants); and any other fasteners that connect the extender portion to the garment (e.g., T-shaped plugs that fasten to buttonhole, button studs, etc.). We will use the term "button" or "connector button" to designate these fasteners universally in this application.
6. There can be two or more buttonholes on the extender portion and one or more connector buttons. There can be multiple button studs, grommet holes or standard holes for the tongue portion.
7. With the overlapping strap design, there are varying ways to attach the overlapping strap of the belt (which keeps the belt together), e.g., belt buckles; hooks and grommets; button studs; snaps; VELCRO fabric fasteners; needle and thread, or and other connecting devices.
8. Certain designs included herein can be worn by women, men and/or children.
9. Buckles can be made on the opposite side of the strap versus what is shown. The shape of the belt if contoured, and the hardware and extender portion would be inverted, as well.
10. Belts can be made with leather, polyurethane, elastic, suede, denim, canvas, a combination thereof, or any other wearable material, and in any color.
11. Hardware, such as buckle (frame and prong), button stud, connector buttons, end tips and/or loops, etc., can be made of brass, gold, silver, any type of wearable metal, metal coating, rubber, and/or covered with any cloth—or material.
12. Rivets, studs, grommets, holes, varying buckle textures, relief/embossed designs and other ornamental features can be added to any and all belts.
13. Buckles are just samples—and can be designed in any shape or level of detail.
14. These extender belts can be made in small, medium and large sizes.

Embodiments of Extender Belts

In the description that follows, the extender belts when described from the wearer refer to the left and right side from the perspective of the wearer looking down at the extender belt. Furthermore, the types of extender belts can be categorized differently.

The extender belts described herein can be categorized as follows: Overlapping Belt Strap, built in extender; Hook Buckle, built in extender; Standard Loop Belt, extender piece behind buckle; Wide Strap Grabs Buckle from Side, pulls over and secures; Wide Belt Worn Over Pant Loops, buckle in front, built in extender; Wide Strap Grabs Buckle from Side, pulls over and secures; and Snap-on Extender Belt. The embodiments of the extender belts are disclosed under headings associated with these categories.

Figure 99:
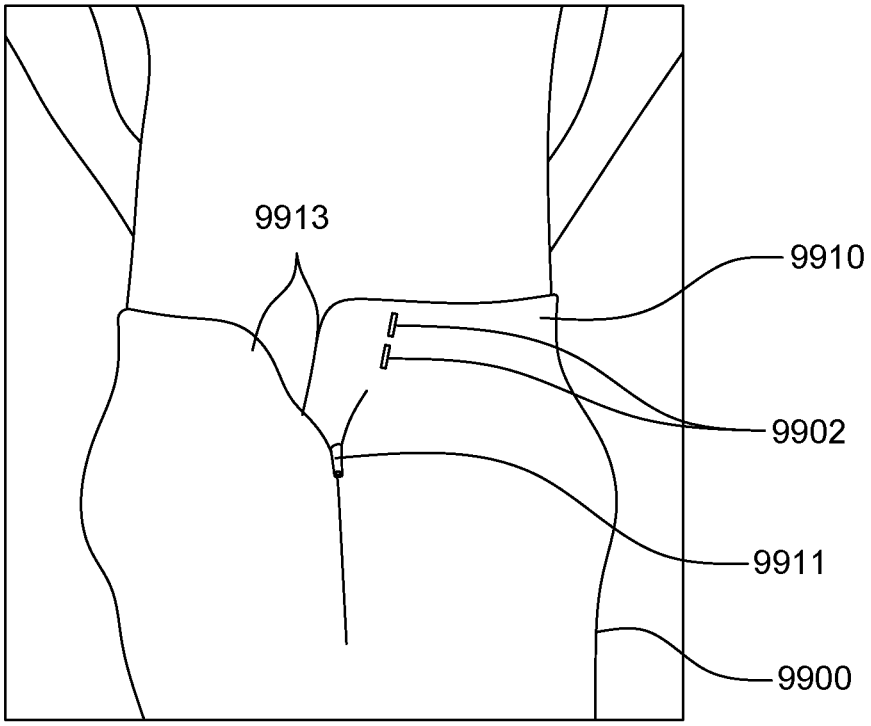
FIG. 99 show a pants or trousers having a hook and bar waistband closure with a too small waist size to which the twelfth extender belt is configured to close.
Figure 103:
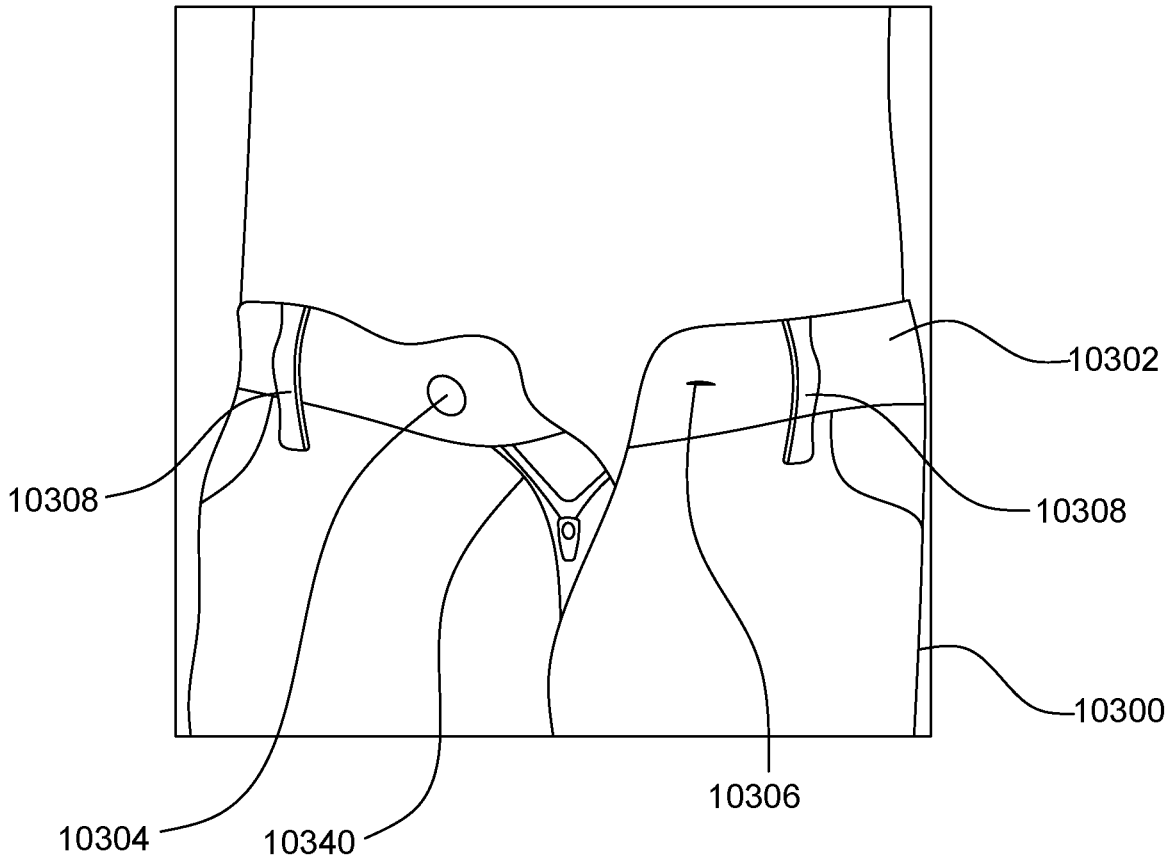
FIG. 103 show jean pants having a button and buttonhole waistband closure with a too small waist size to which the first extender belt is configured to close.

The extender belts described herein can be utilized with various pants, trousers, and other items of clothing. FIG. 103 show jean pants having a button and buttonhole waistband closure. FIG. 99 show a pants or trousers having a hook and bar waistband closure. The waist size of these pants or trousers is too small to close around a user.

Overlapping Belt Strap, Built In Extender

Referring now to FIGS. 1-6, a first embodiment of an extender belt 100 is shown. The extender belt 100 includes a brown leather belt 102 with a brass rectangular buckle 110. The belt 102 includes a narrow tongue leather strip 104 and a waist strap 106 with ends coupled together. The waist strap 106 has a narrow waist strip 107 that expands outward to an extender section 108. The narrow tongue leather strip 104 includes a plurality (e.g., four or five) of holes 105 spaced apart in a line or row along the strip.

Figure 105:
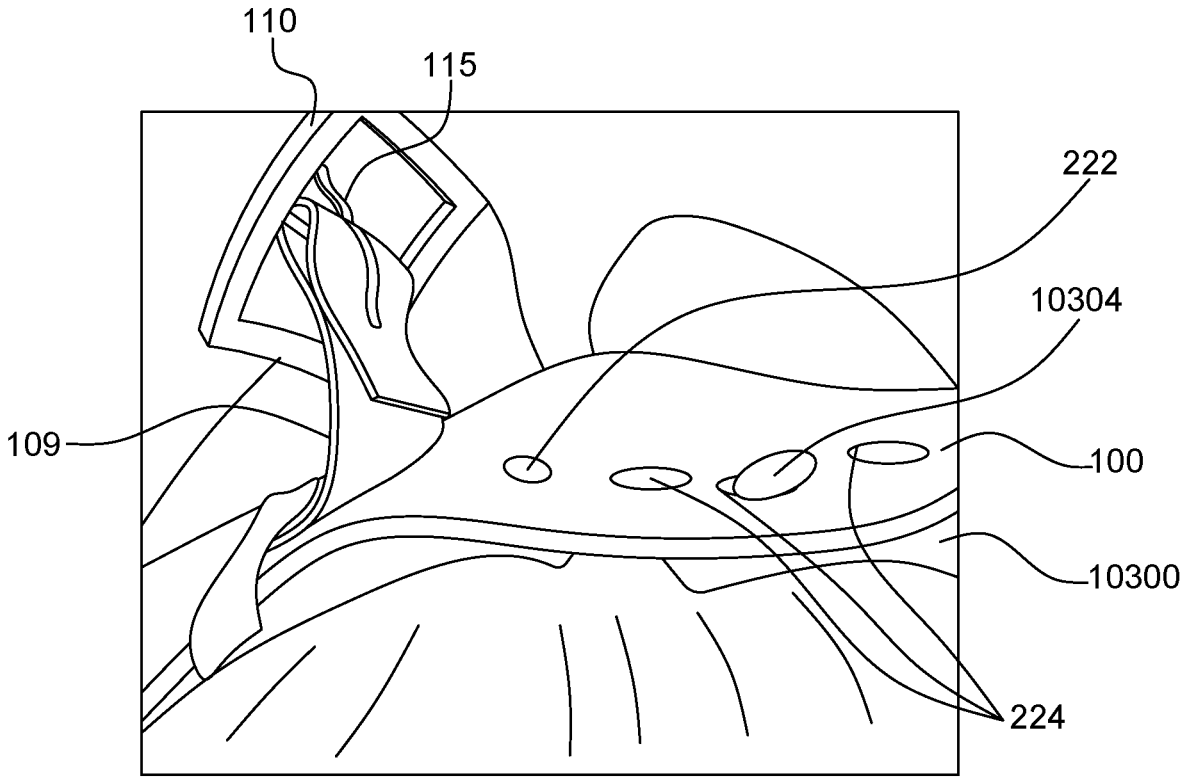

As shown in FIG. 105, a narrow leather loop 109 with a center hole wraps around a center bar of the buckle 110. The ends of the leather loop overlap and are coupled together to hold the buckle and then coupled to the front side of the extender section 108 to hold the buckle 110 secured to the leather belt 102. The center hole in the leather loop 109 allows the prong 115 of the buckle 110 to extend outward.

Figure 2:
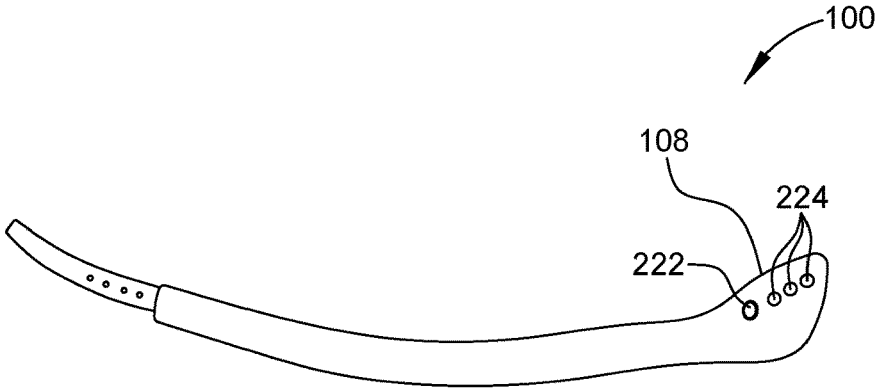
Figure 3:
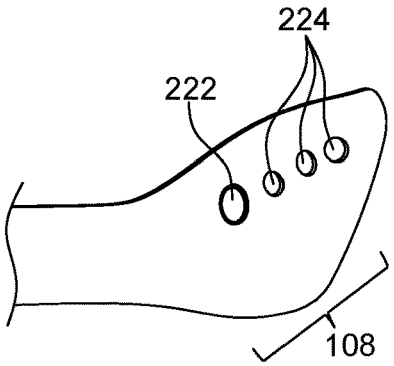

As shown in FIGS. 2-3, the extender belt 100 includes an extender feature behind the buckle 110. The extender feature includes a button 222 and a plurality (e.g., two or three) of holes 224 in the extender section 108 of the belt 102.

Referring now back to FIGS. 1-2, the extender section 108 of the waist strap 106 is wider than the narrow waist strip 107. The extender section 108 can be similar in shape to an upside down triangle. The extender section 108 is wider where the extender belt 100 affixes to a person's pant button and buttonhole. The extender section 108 helps to provide more coverage of the open button and partially opened zipper of the pants that no longer fit. From the extender section 108, the belt 102 slightly contours down to the narrow waist strip 107 so that it can be inserted into belt loops around the waist of pants.

Figure 4:
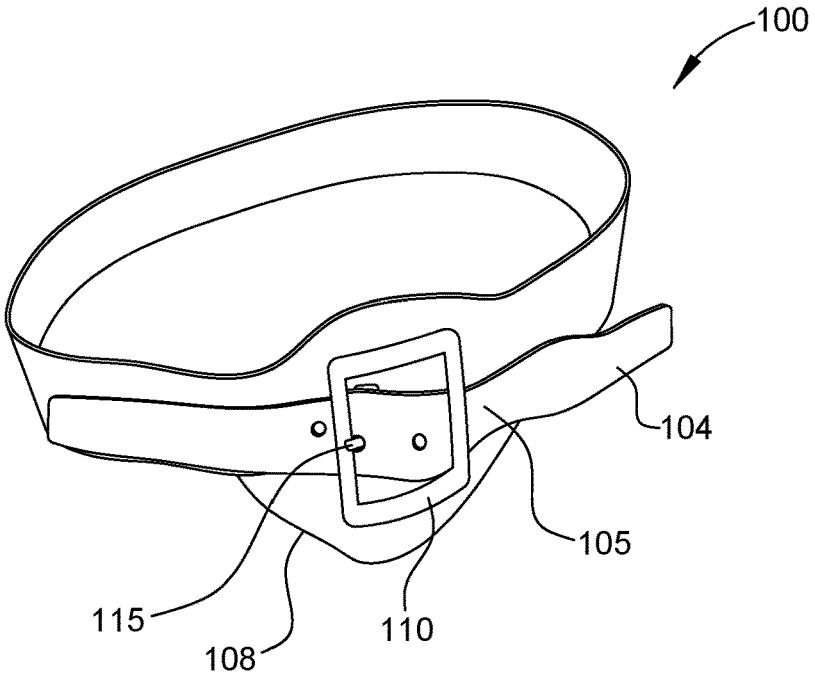

As shown in FIG. 4, the free end of the tongue leather strip 104 can be slid into the buckle 110. The tongue leather strip 104 includes the plurality of holes 105 into which the prong 115 of the buckle 110 can be inserted to removeably secure the belt 102 closed.

Referring momentarily to FIG. 103, the extender belt 100 is configured to couple to a waistband 10302 of pants or trousers 10300. The pants or trousers 10300 have a button 10304 and buttonhole 10306 closure means. The pants or trousers 10300 further have a plurality of belt loops 10308 periodically placed around the waistband 10302. The pant or trouser 10300 further has a zipper 10340. When the pant or trouser 10300, such as jean pants, are too tight at mid hip, the closure means at the waistband 10302 is inoperable leaving an unzipped zipper 10340 and an open waistband as shown in FIG. 103.

Figure 5:
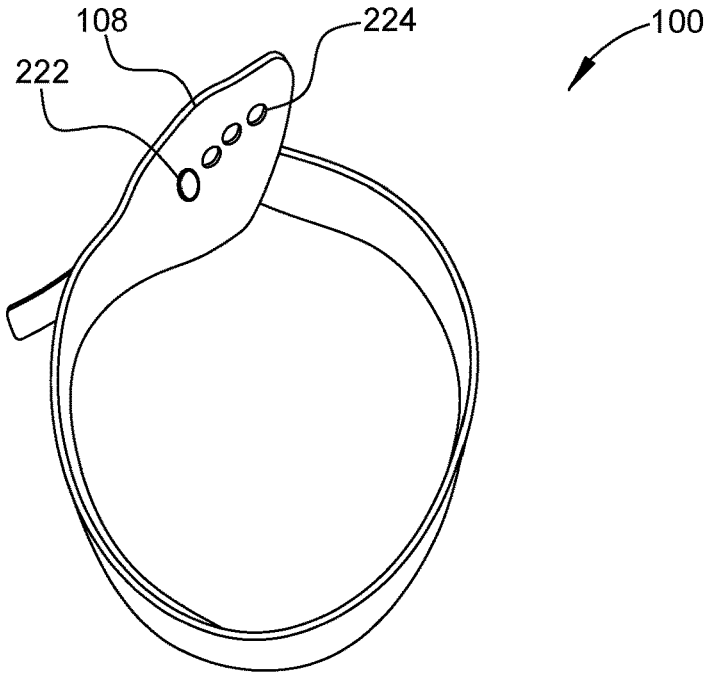
Figure 6:
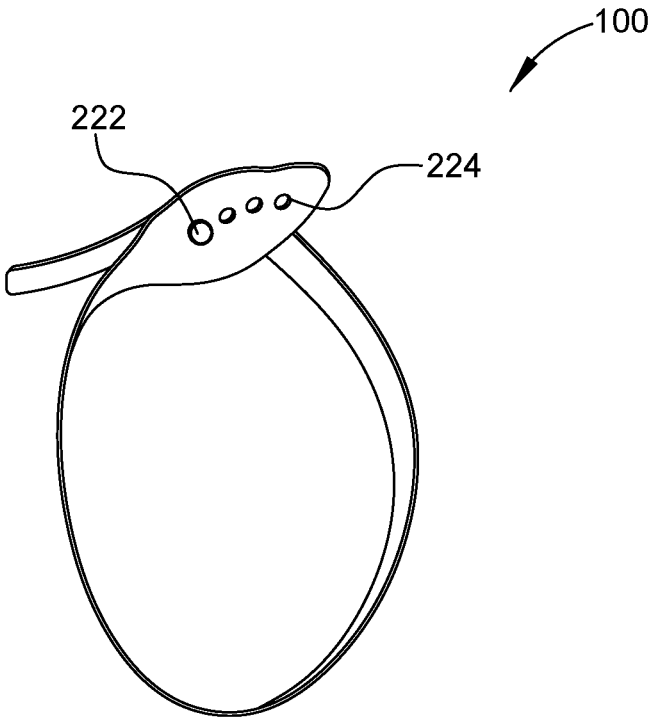
Figure 7:
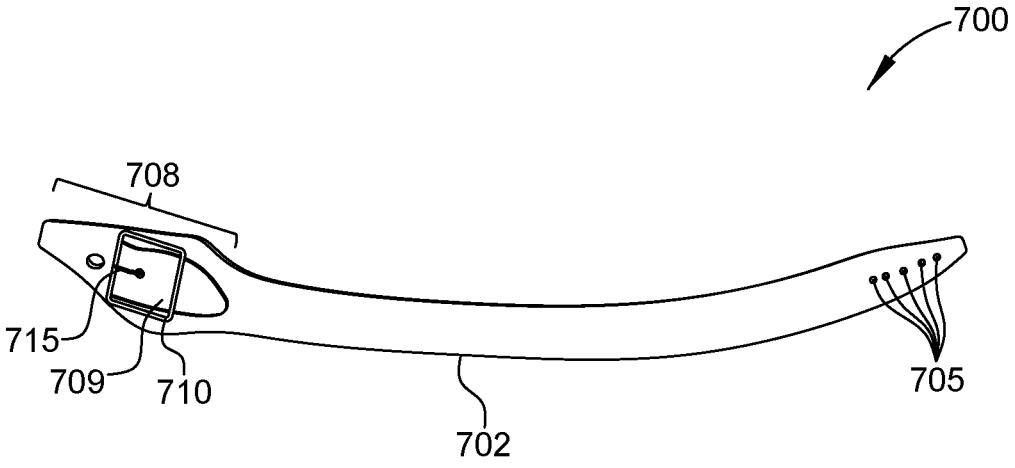

As shown in FIGS. 5-6, the extender button 222 of the extender belt 100 can be inserted into the buttonhole 10306 of the patents or trousers 10300. The button 10304 of the pants or trousers 10300 can be inserted into one of the plurality of holes 224 of the extender belt 100. The extender section 108 of the extender belt 100 is sufficiently large to cover over the open waistband and the open portion in the pants 10300 due to the unzipped zipper 10340.

Figure 104:
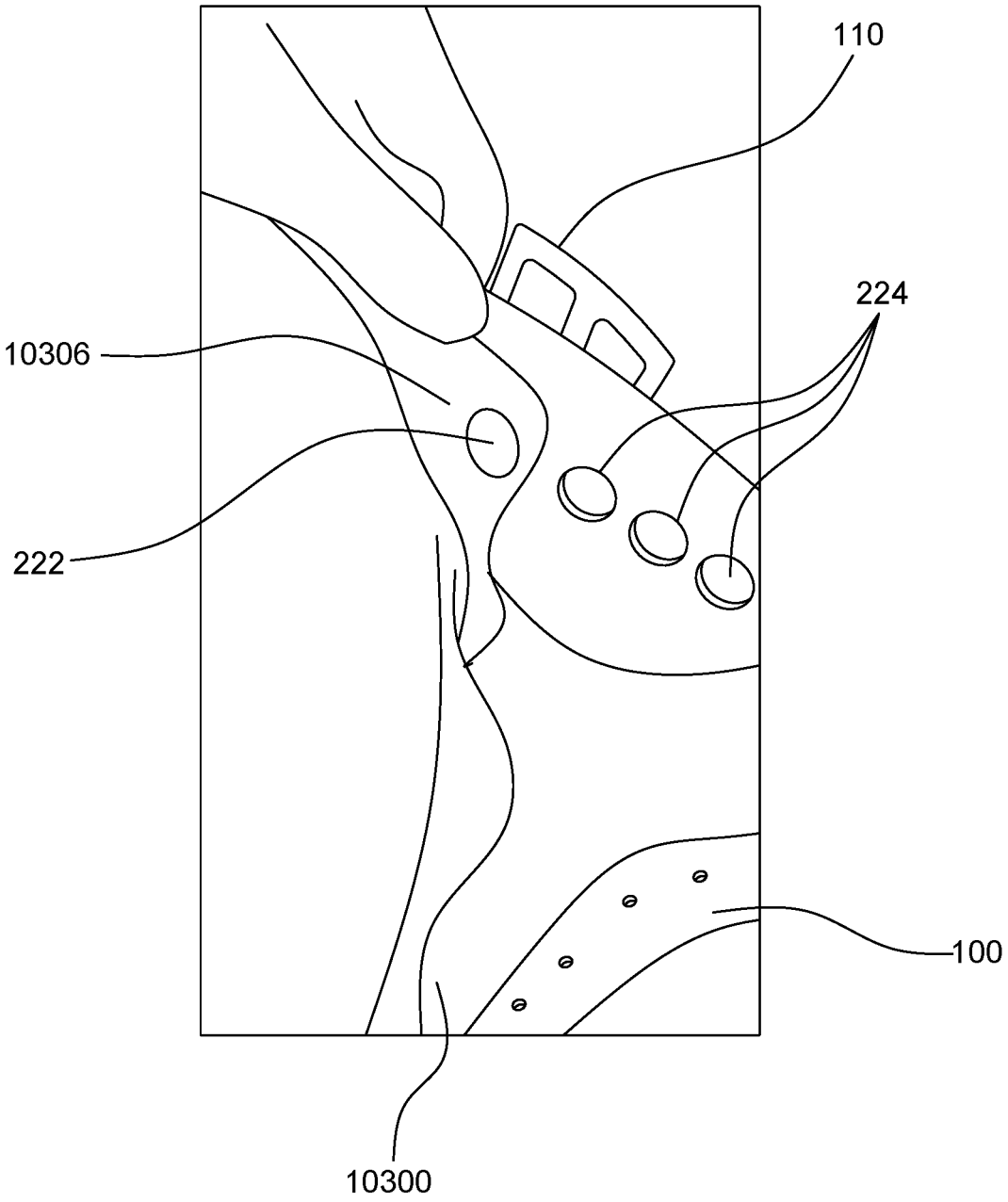
FIGS. 104-106 show views of the first extender belt coupled to the pants shown in FIG. 103.
Figure 106:
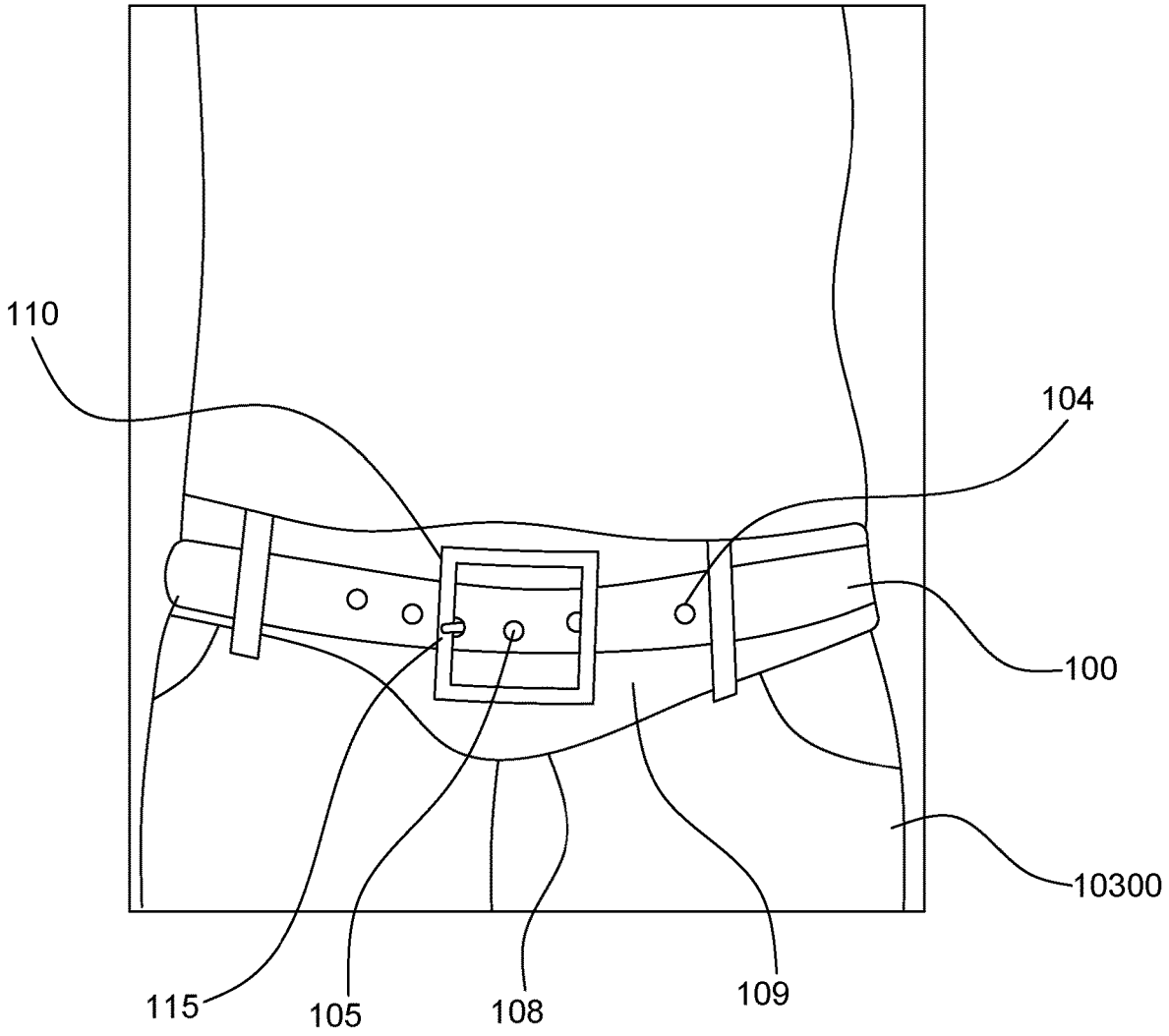

FIGS. 104-106 show views of the extender belt 100 being coupled to the pants 10300 shown in FIG. 103. In FIG. 104, the extender button 222 of the extender belt 100 is coupled into and extends through the buttonhole 10306 of the patents or trousers 10300. In FIG. 105, the button 10304 of the pants or trousers 10300 is inserted into and extends through an extender hole 224 of the extender belt 100. In FIG. 106, the tongue leather strip of the extender belt 100 is inserted into the buckle 110. The prong 115 of the buckle 110 is inserted through one of the holes 105 in the tongue 104. The extender section 108 of the extender belt 100 covers over the open waistband and the open portion in the pants 10300.

Referring now to FIGS. 7-12, a second embodiment of an extender belt 700 is disclosed. The extender belt 700 includes a black leather belt strap 702 with a gold rectangular buckle 710. The buckle 710 is affixed to a face portion of the belt strap 702 by a separate overlapping strap 709. The belt strap 702 can be inserted through belt loops of pants or trousers and is slightly contoured.

Figure 10:
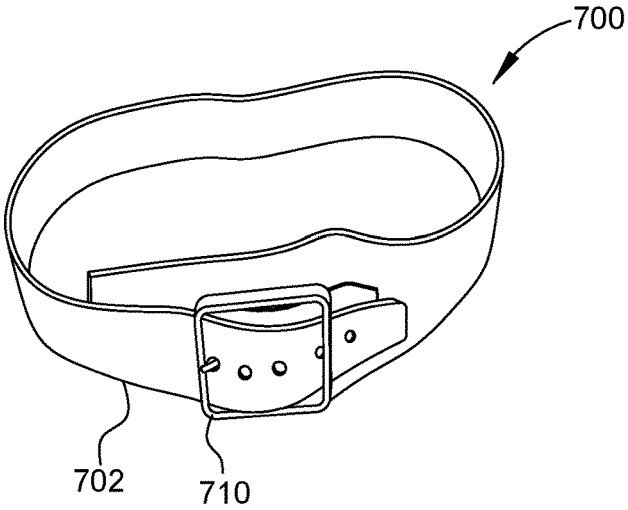

The belt 700 does not have a secondary overlapping tongue strap 104 as does the belt 100. The strap portion of the belt 700 includes a tongue portion that can be inserted into the buckle 710 such as shown in FIG. 10. The tongue portion of the belt 700 includes adjustment holes 705 that receive a prong 715 of the buckle 710 to help secure ends of the belt together and around a user.

A face or buckle area of the belt strap 702 is just behind the buckle 710. The buckle area of the strap 702 is wider and curved at the bottom with a more angled curve on the top to provide greater coverage over an open waist and zipper in pants or trousers.

Figure 8:
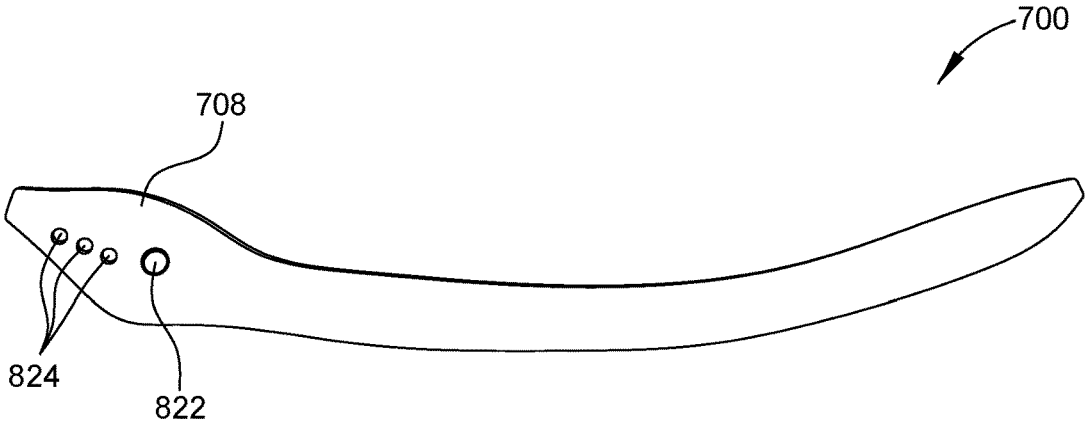
Figure 9:
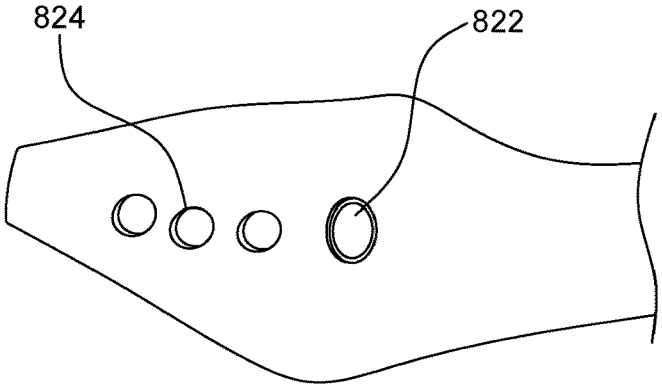

In FIGS. 8-9, a backside of the belt 700 is shown. A backside of the face of the belt includes an extender feature 708 of the extender belt 700. The extender feature 708 includes a plurality of extender holes 824 in a row and an extender button 822 in line with the row of the plurality of extender holes 824.

Figure 11:
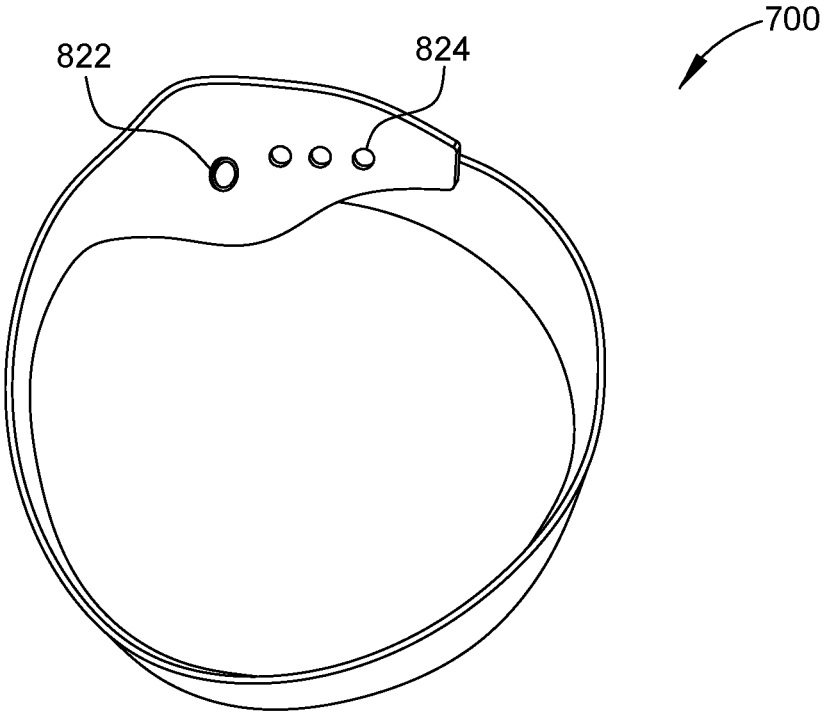
Figure 12:
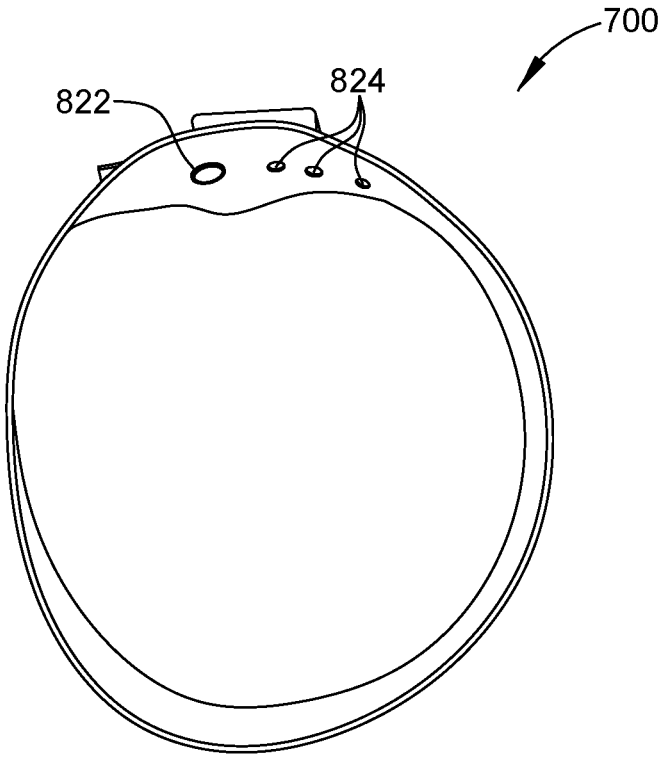

In FIG. 11-12, the extender button 822 is ready to be inserted into a buttonhole near the waist of pants or trousers. The extender holes 824 of the belt 700 are ready to receive a button of the pants or trousers.

Figure 13:
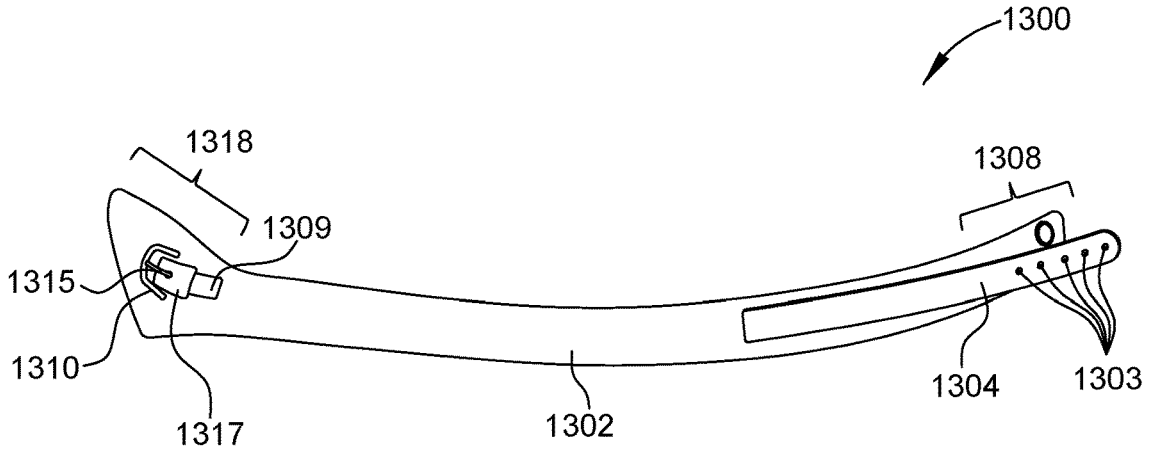
Figure 14:
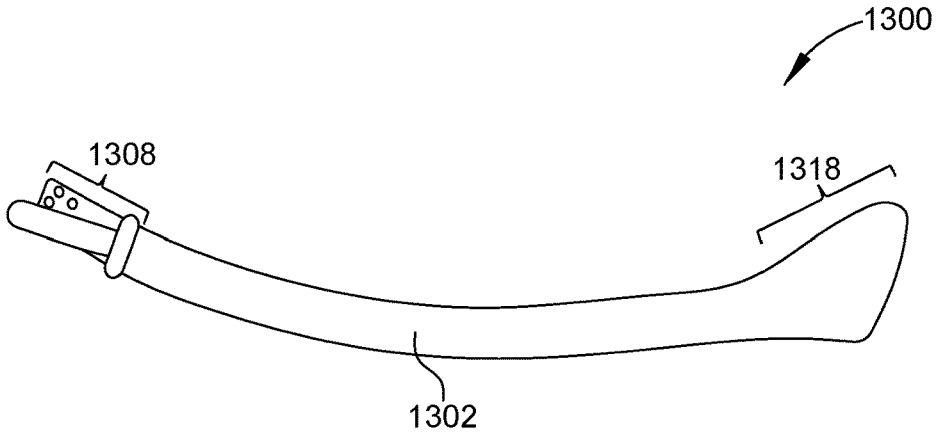

Referring now to FIGS. 13-20, a third embodiment of an extender belt 1300 is disclosed. As shown in FIG. 13, the extender belt 1300 includes a black leather belt strap 1302 and a gold C shaped buckle 1310. The belt strap 1302 includes a buckle area portion 1318 at one end and an extender portion 1308 at the opposite end. The buckle area portion 1218 of the strap 1302 is in the shape of an upside down triangle, affording extra coverage at its widest point to cover over an open waist and zipper of pants or trousers.

As shown in FIG. 13, the extender belt 1300 further includes a tongue strap 1304 that has one end coupled to the belt strap 1302 and an opposing free end. Portions of the tongue strap 1304 and belt strap 1302 overlap. The free end of the tongue strap 1304 is free to couple to the buckle 1310. Near the end of the tongue strap 1304 is a plurality of prong holes 1303 to receive the prong 1315 of the buckle 1310.

The buckle 1310 is affixed to the strap 1302 near the buckle area portion 1318 with a separate, narrow, overlapping loop 1309 of leather. A portion of the loop wraps around a bar of the buckle 1310. The loop 1309 includes a center prong opening in the portion wrapping around the bar to allow a prong 1315 of the buckle to extend outward.

About the leather loop 1309 is an added design feature of one to three thin belt loops 1317 of leather. The belt loops 1317 can also be one to three rows of a metal-based belt loops. The belt loops 1317 can receive the free end of the tongue strap 1304.

Figure 15:
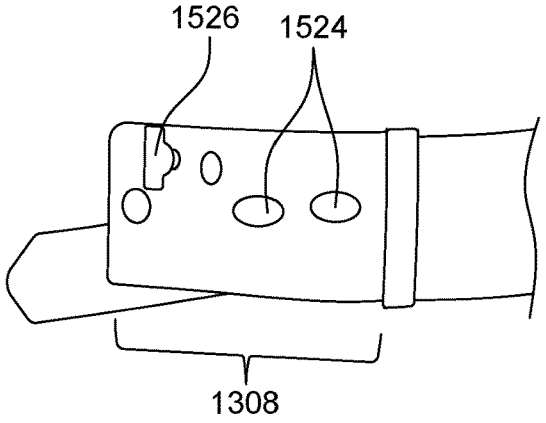
Figure 16:
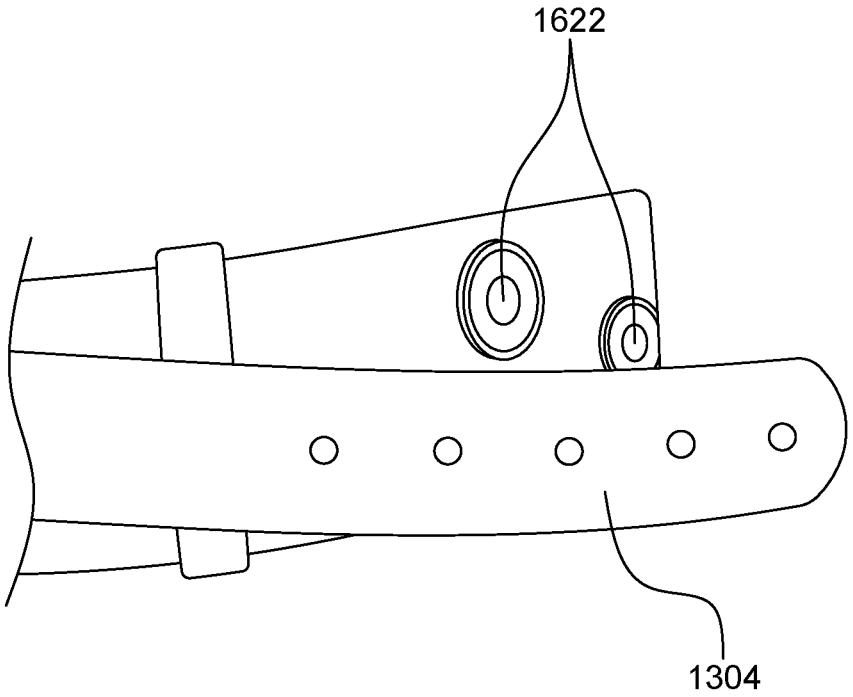
Figure 17:
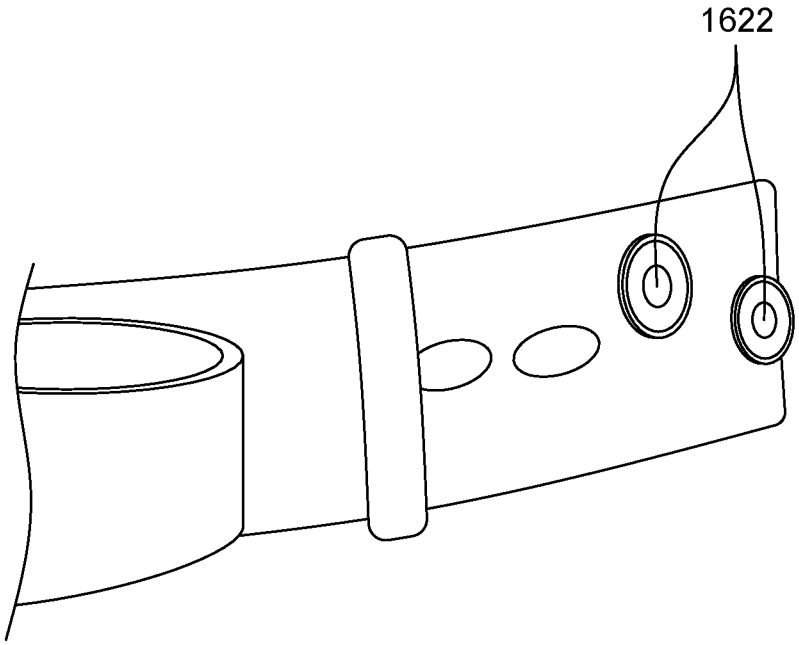

With the embodiment of the extender belt 1300, the extender feature portion 1308 is found near the tongue end of the belt and not the opposite end with the buckle 1310. As shown in FIGS. 15-17, the extender feature portion 1308 of the belt strap 1302 includes two buttons 1622 and two extender buttonholes 1524. The two or more buttons 1622 and two or more extender buttonholes 1524 provides flexibility in coupling to pants with different distances or lengths in an open waist. The extender feature portion 1308 of the belt strap 1302 can further include an extender hook 1526 for a hook and bar type of dress pants. FIG. 99 shows a pair of bars 9902 in pants 9900 that can receive a pair of extender hooks. In this manner, the extender belt 1300 provides further flexibility in coupling to different types of pants.

The extender belt 1300 is slightly contoured from the buckle area portion 1218 down to center portion of the belt strap 1302 so that it can be can be inserted through belt loops of pants or trousers. Accordingly, the extender belt 1300 shown is as a mid/hip belt, but can also be formed with a wider center portion of the belt strap 1302 to form a waist belt.

Figure 18:
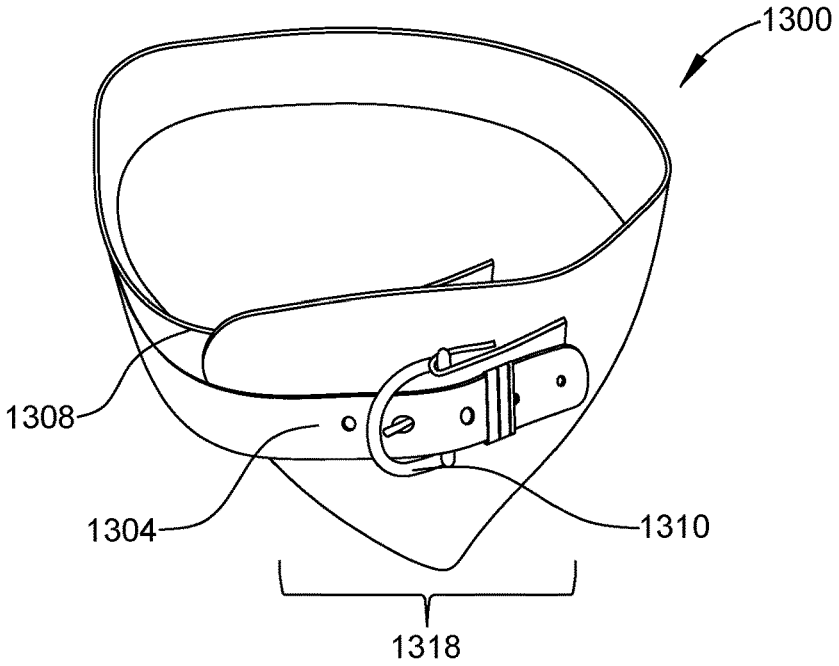
Figure 19:
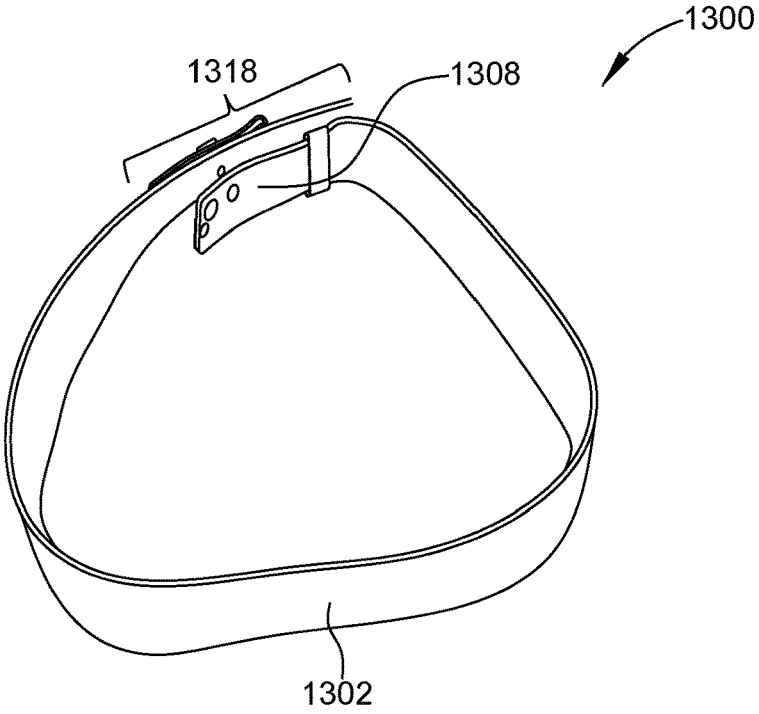
Figure 20:
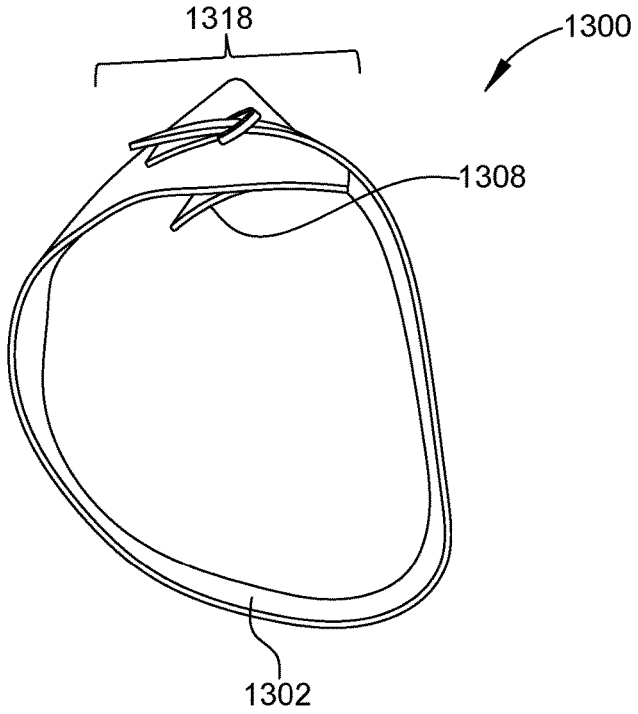
Figure 21:
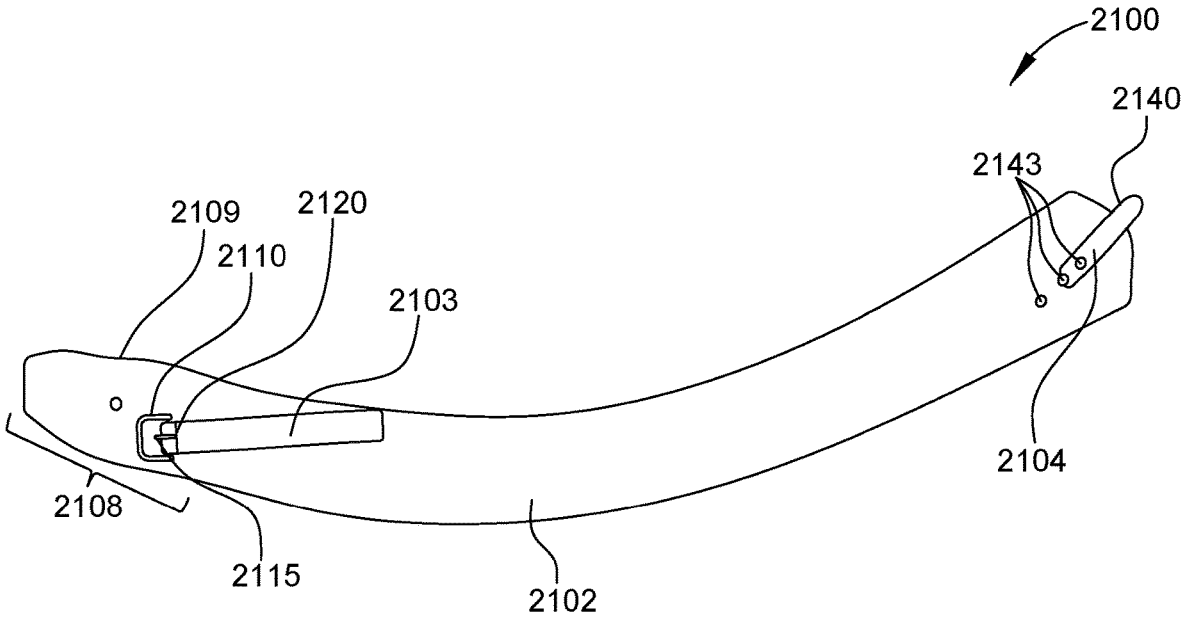

FIGS. 18-20 show how opposing ends of the extender belt 1300 can wrap around and couple together. The free end of the tongue strap 1304 is inserted through the buckle 1310 and the loops 1317 for retention. The prong 1315 is inserted into one of the openings 1303 in the tongue strap. The buckle area portion 1318 is wide to cover over an open waist line and open zipper. FIGS. 19-20 illustrate how the buckle area portion 1318 of the belt strap also covers over and hides the extender feature portion 1308.

Referring now to FIGS. 21-26, a fourth embodiment of an extender belt 2100 is disclosed. The extender belt 2100 includes a brown leather belt strap 2102, a buckle strap 2103, and a tongue strap 2104 coupled together. Each of the buckle strap 2103, and the tongue strap 2104 have an end coupled to the belt strap 2102. The extender belt 2100 further includes an extender feature portion 2108 in the belt strap 2102.

The buckle strap 2103 includes a gold C shaped belt buckle 2110 with a prong 2115. The buckle 2110 is coupled to an end of the buckle strap 2103. A gold metal loop 2120 is coupled near the end of the buckle strap 2103. A narrow piece of leather loops around at the end of the buckle strap and couples back to the buckle strap 2103 to couple the buckle 2210 and the gold metal loop 2120 to the belt strap 2102.

To cover over an open zipper and an open pant waist, the extended feature portion 2108 of the belt strap 2102 widens on top and bottom. A peak 2109 in the extended feature portion 2108 of the belt strap 2102 can be placed in line relative to the position of the buckle 2110 to further cover over the open pant waist.

Figure 24:
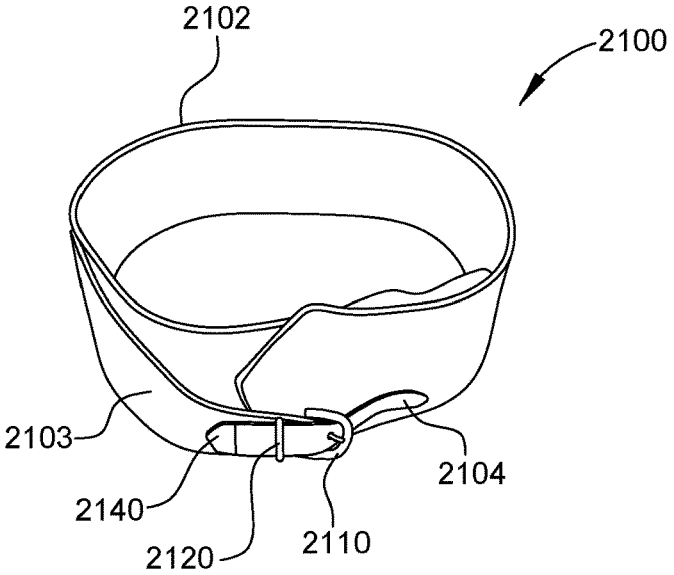
Figure 25:
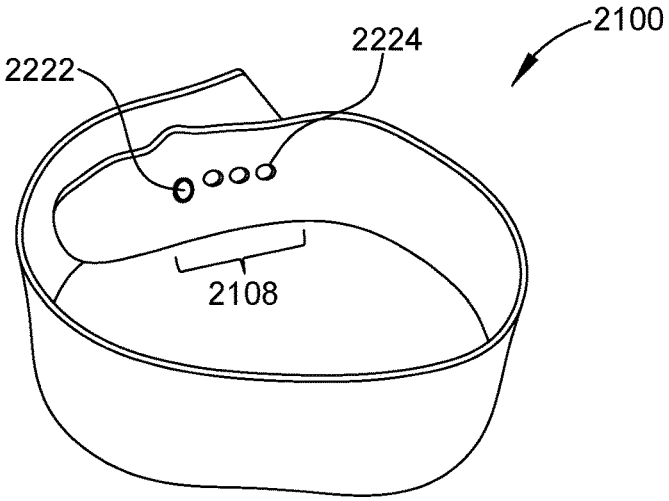
Figure 26:
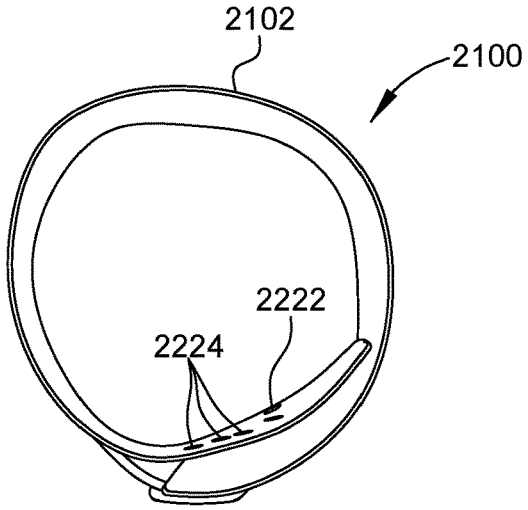
Figure 27:
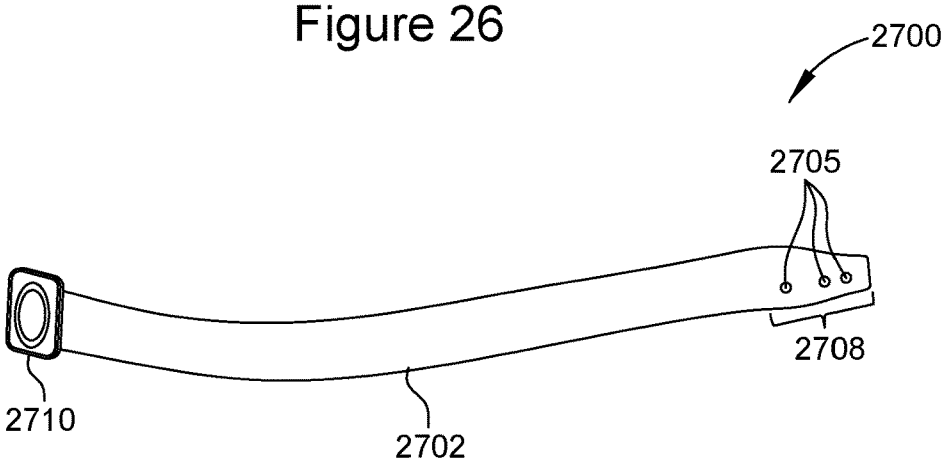

The tongue strap 2104 is separate piece of leather with an end coupled to the belt strap 2102. At the free end, the tongue strap 2104 comes down to a point like an arrow. The tongue strap can include a brass colored metal tip 2140. The tongue strap 2104 further includes a plurality of adjustment holes 2143 to variably conform to the size of a users waist. Portions of the tongue strap substantially overlap the belt strap. When the tongue strap and buckle strap are coupled together by the buckle, such as shown in FIGS. 24-26, there is a wide continuous thin overlapping belt loop formed by the belt strap 2102.

Figure 22:
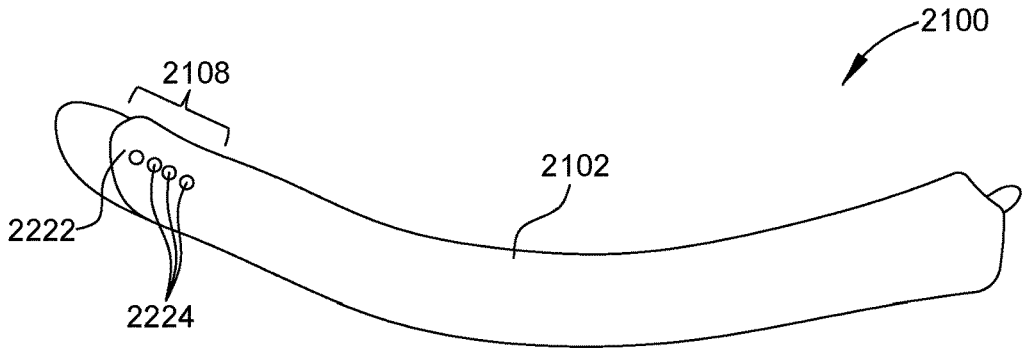
Figure 23:
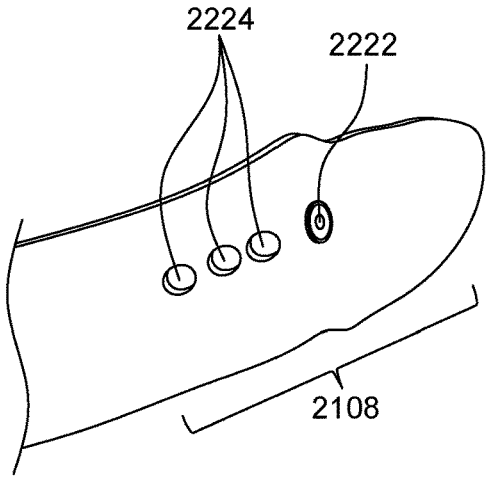

As shown in FIG. 22, the extender feature portion 2108 is located on the back side of the belt strap 2102 behind the belt buckle 2110. The extender feature portion 2108 includes one extender button 2222 and three extender buttonholes 2224 aligned in series. In FIG. 25, the extender button 2222 points in towards the pants so that it can couple to a pant hole in the pants. The three extender buttonholes 2224 can receive a pant button from the pants or trousers the user desires to wear.

In an open configuration, the extender feature portion 2108 of the belt is located to the right of the user while the tongue belt is located to the left of the user. In another embodiment, the extender feature portion 2108 of the belt is located to the left of the user while the tongue belt is located to the right of the user.

The extender belt 2100 is contoured and has a rather wide width so that it can be worn over pants or jeans with loops. That is, the width to the belt strap 2102 can not be able to fit through the belt loops around the waist of jean pants or trousers.

Hook Buckle, Built In Extender

Referring now to FIGS. 27-34, a fifth embodiment of an extender belt 2700 is disclosed. The extender belt 2700 includes a brown leather belt strap 2702 and a solid brass-colored squared rectangular buckle 2710. The strap 2702 of the extender belt 2700 includes an extender feature portion 2708. The extender feature 2708 is a built-in (e.g., an integral) part of the belt strap 2702. In a tongue portion near an end, the strap 2702 of the extender belt 2700 further includes a plurality of holes 2705 in a series or row that are configured to receive a hook of the buckle 2710.

Figure 28:
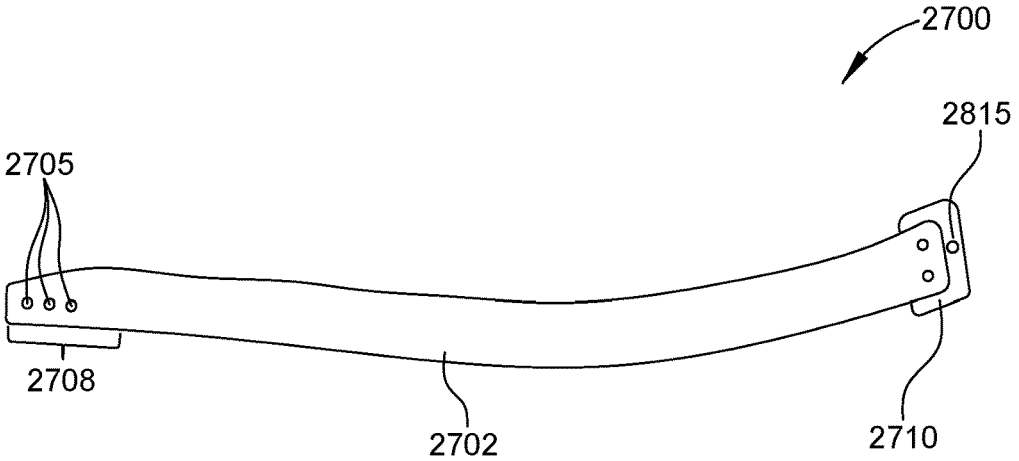

As shown in FIG. 28, the front side of the solid buckle 2710 can include an ornamental design. As shown in FIG. 28, the back side of the solid buckle 2710 includes a hook 2815. The hook 2815 of the buckle 2710 extends into one of the plurality of holes 2705 of the tongue portion of the strap 2705.

Figure 29:
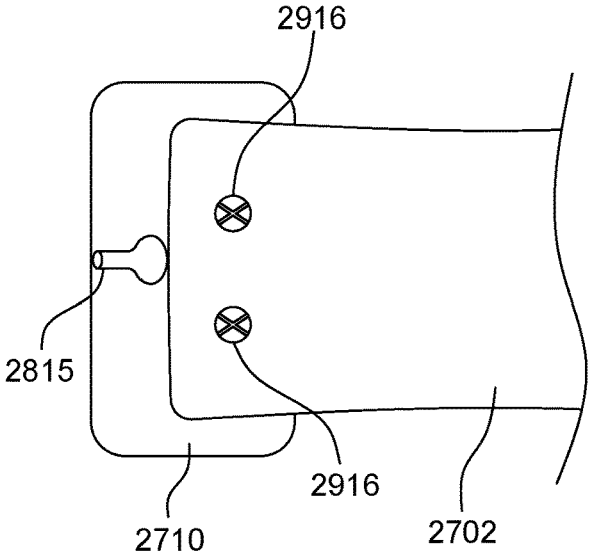

Referring now to FIG. 29, a magnified view of a portion of a backside of the belt, the buckle 2710, is coupled to the strap 2702 by a plurality of fasteners 2916. The plurality of fasteners 2916 can be two or more screws and threaded nuts, two or more screws and threaded holes in the buckle, or two or more rivets coupling the buckle to the strap 2702. The hook 2815 can have various shapes to couple into one of the plurality of holes 2705 to secure the open pant waist together around the user.

Figure 30:
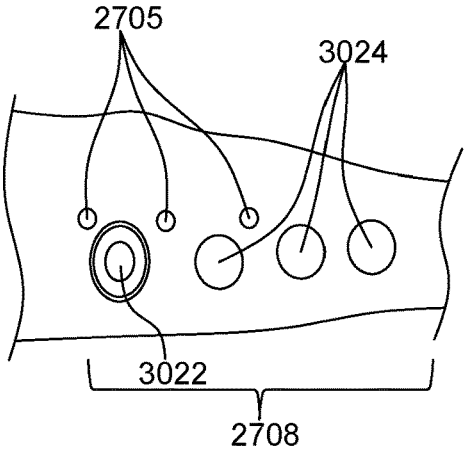
Figure 31:
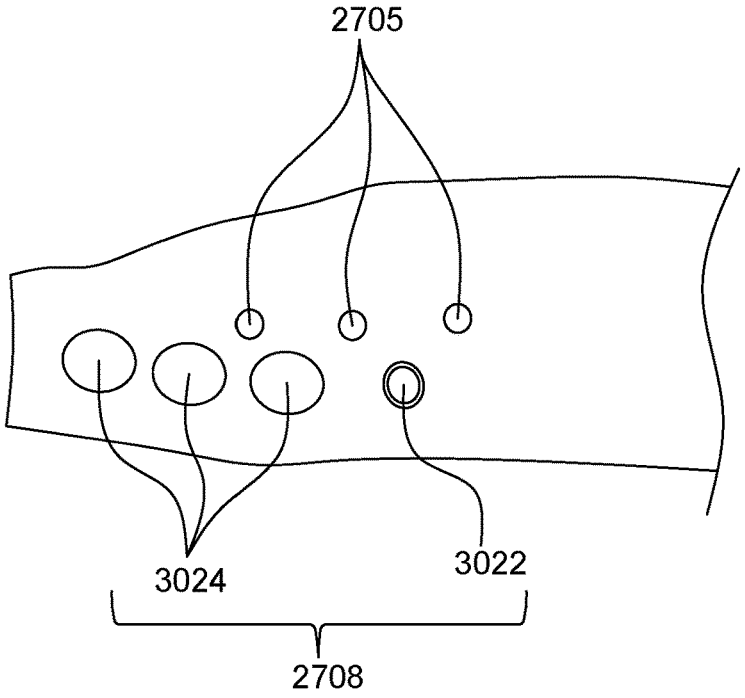

Referring now to FIGS. 30-31, the extender feature 2708 of the belt is located in the tongue portion of the strap 2705. The extender feature 2708 includes a plurality (e.g., two or three) of extender buttonholes 3024 and one extender button 3022. The extender button 3022 protrudes from the backside of the belt protruding in towards the user. In the backside of the strap 2708, the three extender buttonholes 3024 are in series in a row to the right of the extender button 3022. A portion of the bottom edge of the tongue portion can slightly extend downward. From the end, a top edge of the tongue portion has a slight angle up into a straight edge. That is, the tongue portion of the strap narrows down to the end to help hide the extender feature 2708 behind the strap 2702 and the solid buckle 2710 at the opposite end of the belt, such as shown in FIG. 32.

In one embodiment, the buckle 2710 can be worn on the left side from the viewpoint of the user with the tongue portion of the strap extending from the right side of the user. In another embodiment, the buckle 2710 can be worn on the right side from the viewpoint of the user with the tongue portion of the strap extending from the left side of the user. The extender feature 2708 can be mirrored to the other side of the user such that the extender holes 3024 and extender button 3022 are positioned under the row of holes 2705 in the tongue portion of the strap.

Figure 32:
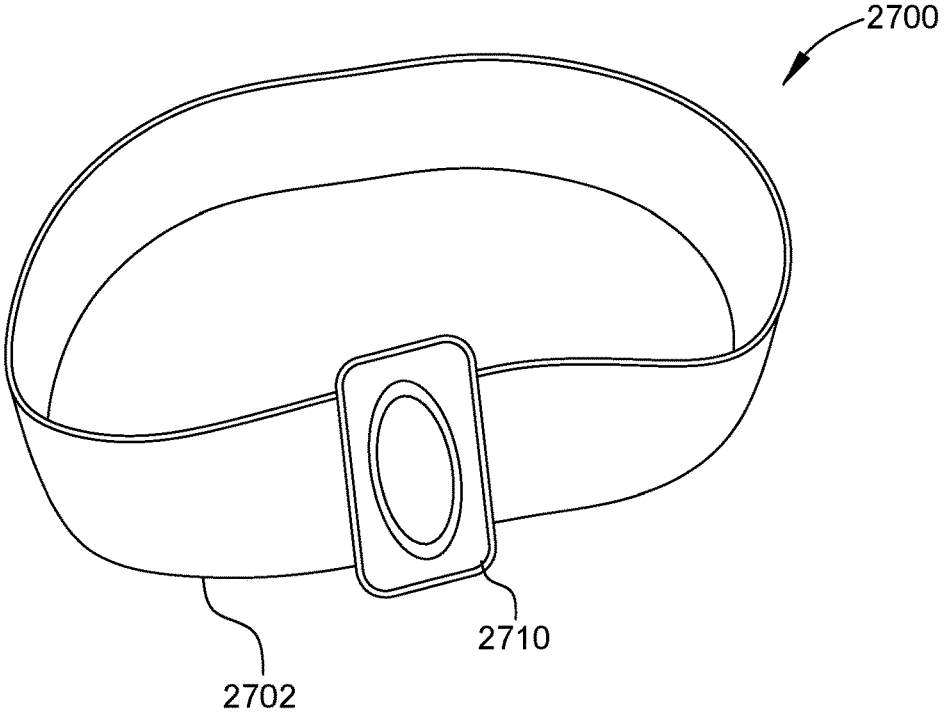
Figure 33:
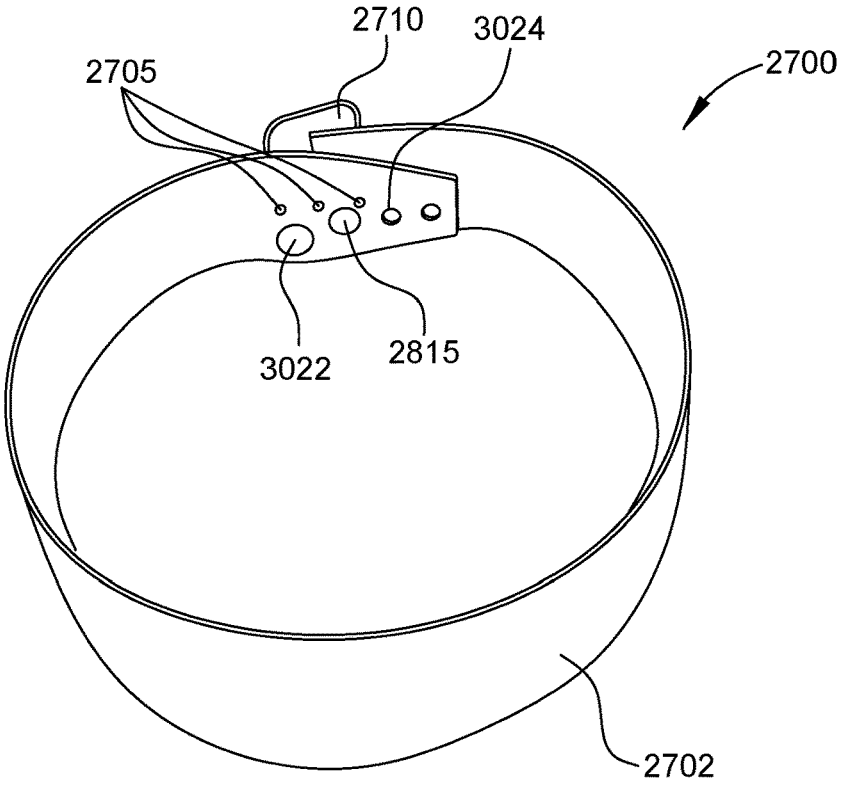
Figure 34:
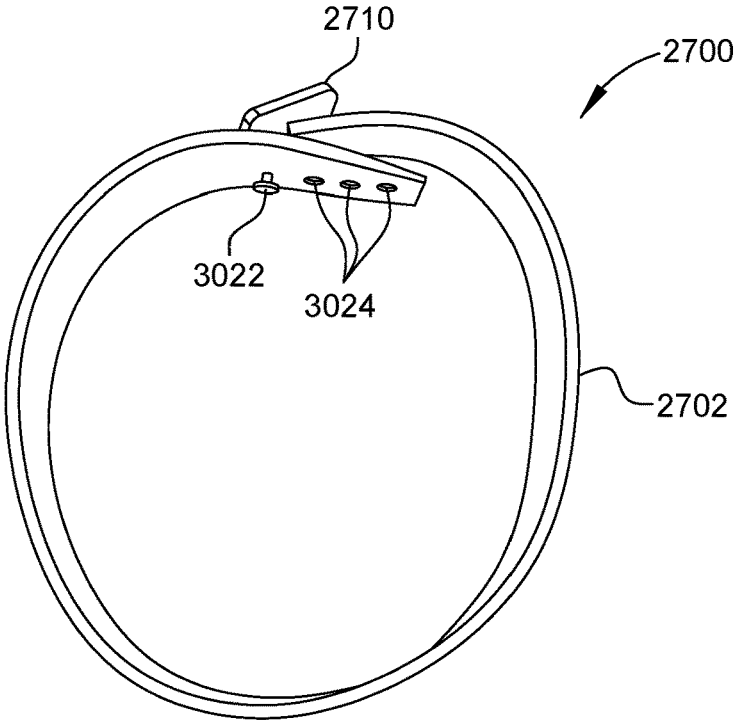
Figure 35:
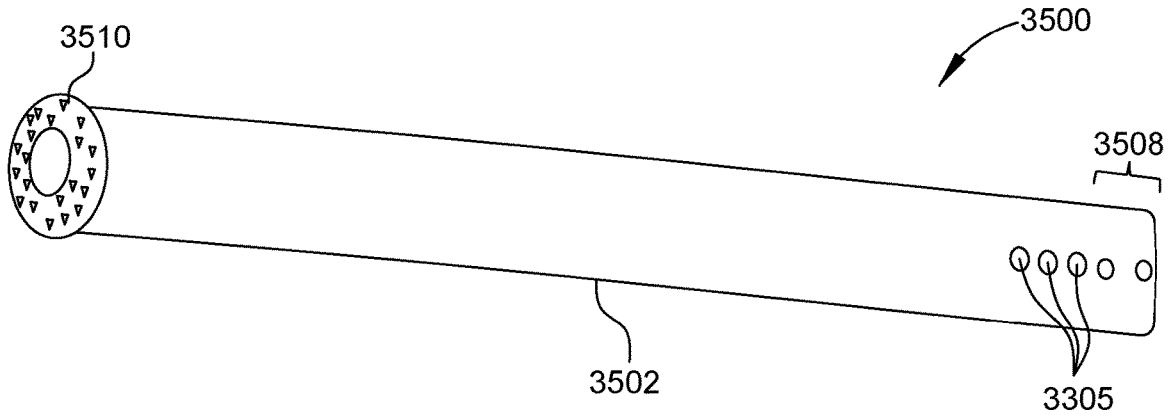

As shown in FIG. 32, the strap 2702 of the extender belt 2700 is slightly contoured so that it can be inserted through belt loops of pants and worn around the waistband of the pants. As shown in FIG. 33, the extender button 3022 extends inward to fit into a pant hole of pants or trousers worn by the user. One of the extender holes 3024 in the strap 2702 is selected by the user. The user inserts a pant button into the selected hole 3024 to close over the open waistband in the pants. The buckle 2710 can then be engaged with the tongue portion of the strap. The user selects one of the tongue holes 2705 into which the hook 2815 of the buckle 2710 can be inserted. The hook 2815 is inserted into the selected tongue hole 2705 to couple the strap 2702 of the extender belt 2700 into a loop around the waistband of the pants worn by the user.

Referring now to FIGS. 35-41, a sixth embodiment of an extender belt 3500 is disclosed. The extender belt 3500 includes a camel brown suede belt strap 3502 and a silver round hook buckle 3510 coupled to the strap. The strap 3502 of the extender belt 3500 includes a row of a plurality of grommets 3505 provide holes located in a tongue portion of the strap near one end.

Figure 36:
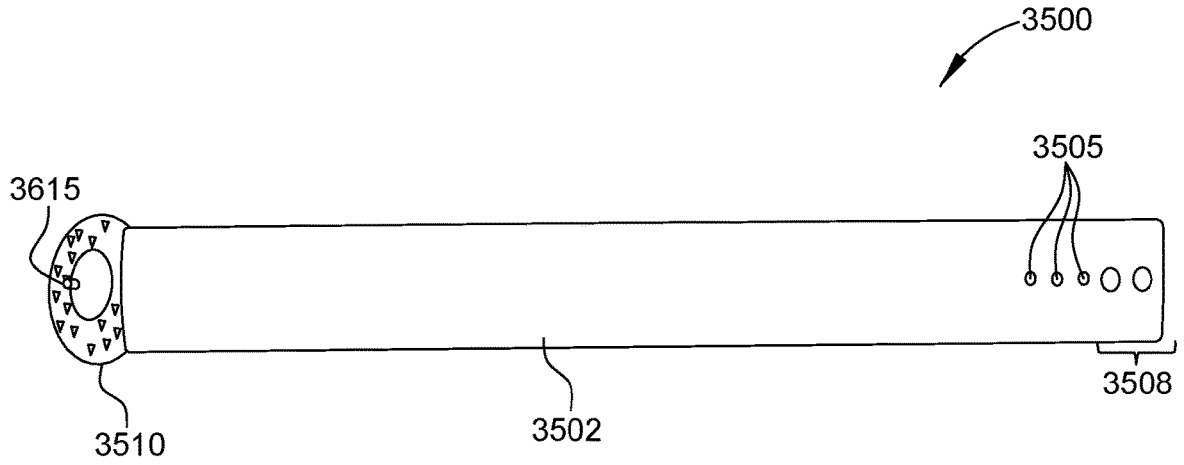
Figure 37:
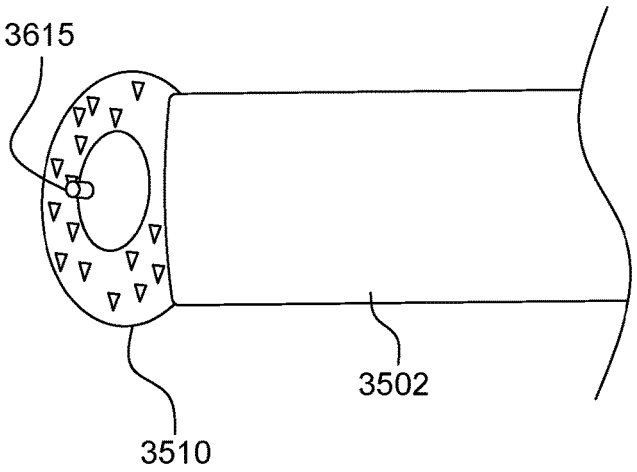

As shown in FIGS. 36-37, a hook 3615 in the backside of the buckle 3510 can be inserted into a selected hole of one of the plurality of grommets 3505.

Figure 38:
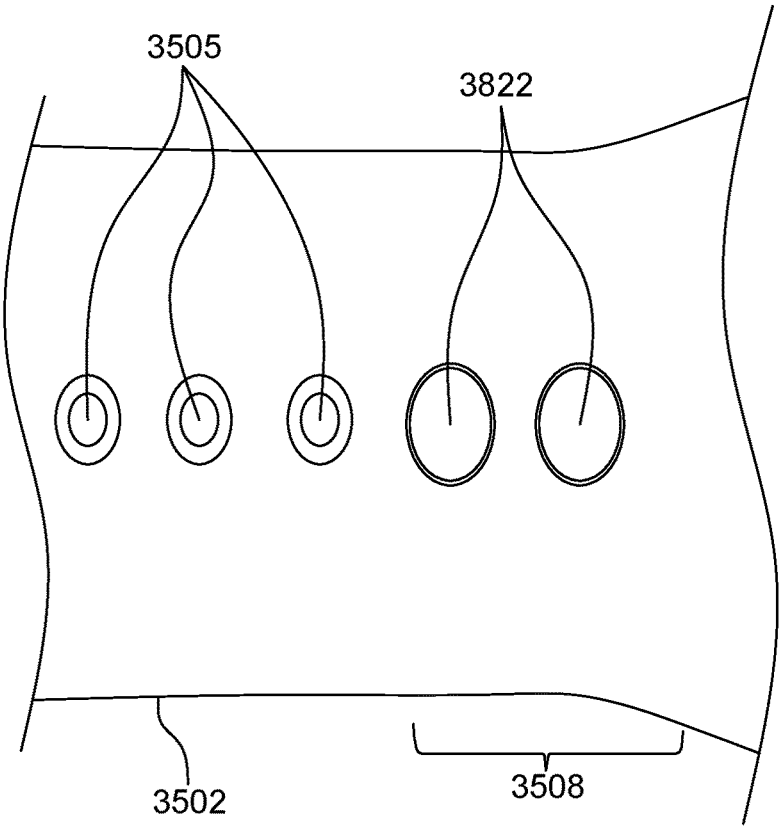

The extender belt 3500 further includes an extender feature portion 3508 in the tongue portion of the strap 3502. Referring now to FIG. 38, the extender feature portion 3508 includes a plurality (e.g., two) of extender buttons 3822 in a row along a center line of the strap near the grommets 3505. The plurality of extender buttons 3822 provides a plurality of options (e.g., two) to the user to secure an open zipper and unbuttoned pants at the waistband of pants or trousers. The strap of the extender belt 3500 is rather wide such that an extender opening is unnecessary to couple to a patent button. Regardless, an extender opening can be added to the extender belt 3500 in the extender feature portion so that the extender belt 3500 can receive a pant button.

Figure 39:
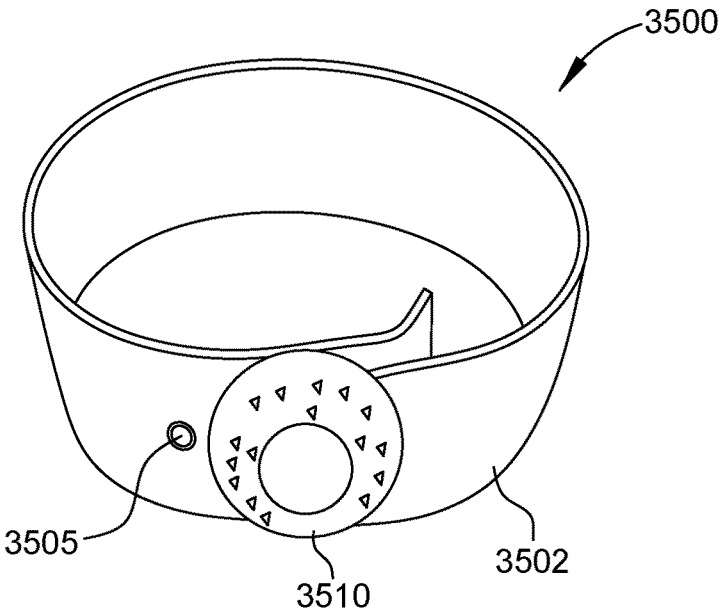
Figure 40:
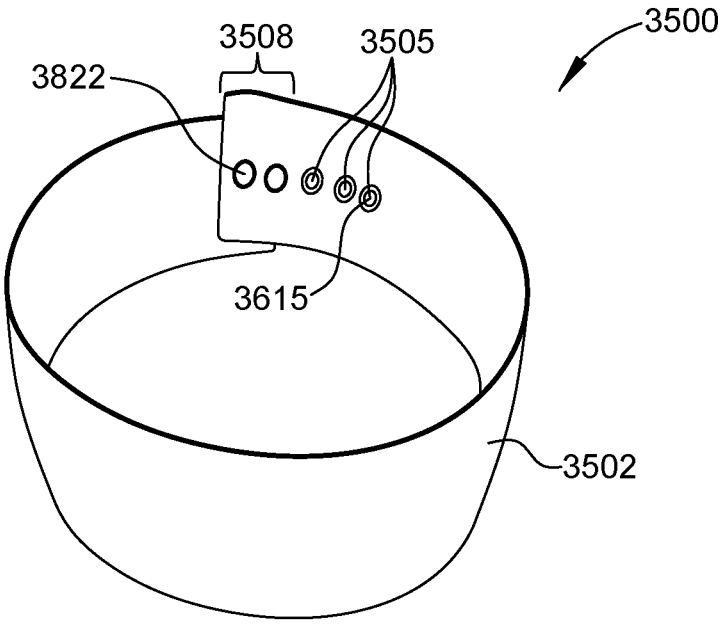
Figure 41:
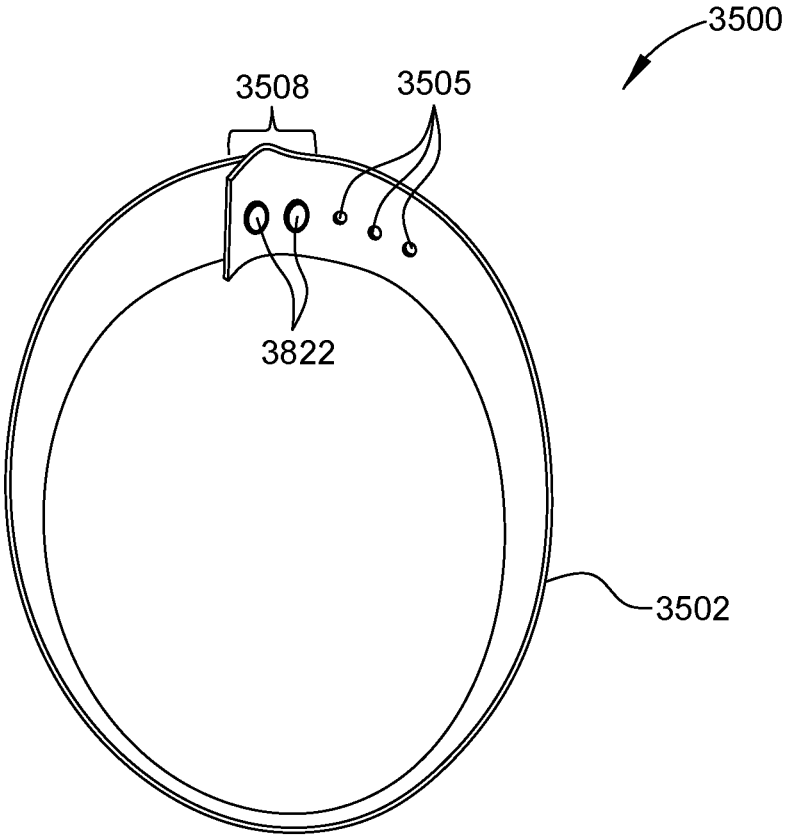

Referring now to FIGS. 39-41, the user/wearer selects one the plurality of extender buttons 3822 and places into a pant hole, helping to secure in place the extender belt 3500 near the waistband of pants or trousers. The user/wearer selects a grommet 3505 and its hole into which the hook 3615 of the buckle 3510 can be inserted. The user/wearer hooks the hook 3615 into the grommet 3505 to further secure the extender belt 3500 around the user/wearer.

The extender belt 3500 is not contoured down to a narrow center portion and tongue portion to fit through belt loops. Accordingly, the extender belt 3500 is worn over pants or other garments. However as seen with other belts disclosed herein, the extender belt 3500 could be designed with contours and narrow portions to fit through belt loops around a waistband of pants or trousers. Furthermore, the extender belt 3500 is designed to be a waist belt around the waistband of pants. However, it can be designed with added grommets to also function as a belt for the mid/hip section of the user/wearer.

Standard Loop Belt, Extender Piece Behind Buckle

Referring now to FIGS. 42-48, a seventh embodiment of an extender belt 4200 is disclosed. The extender belt 4200 includes a black leather belt strap 4202 and a silver rectangular buckle 4210 couple to the strap 4202 near one end. A tongue portion 4204 of the belt strap 4202 is at an opposite end. The belt strap 4202 includes a plurality of spaced apart holes 4203 in a row in the tongue portion 4204. Each of the holes 4203 in the tongue portion 4204 of the belt strap 4202 can receive a prong 4215 of the buckle 4210. The prong 4215 is pivotally coupled to the center bar 4415 of the buckle 4210.

Figure 46:
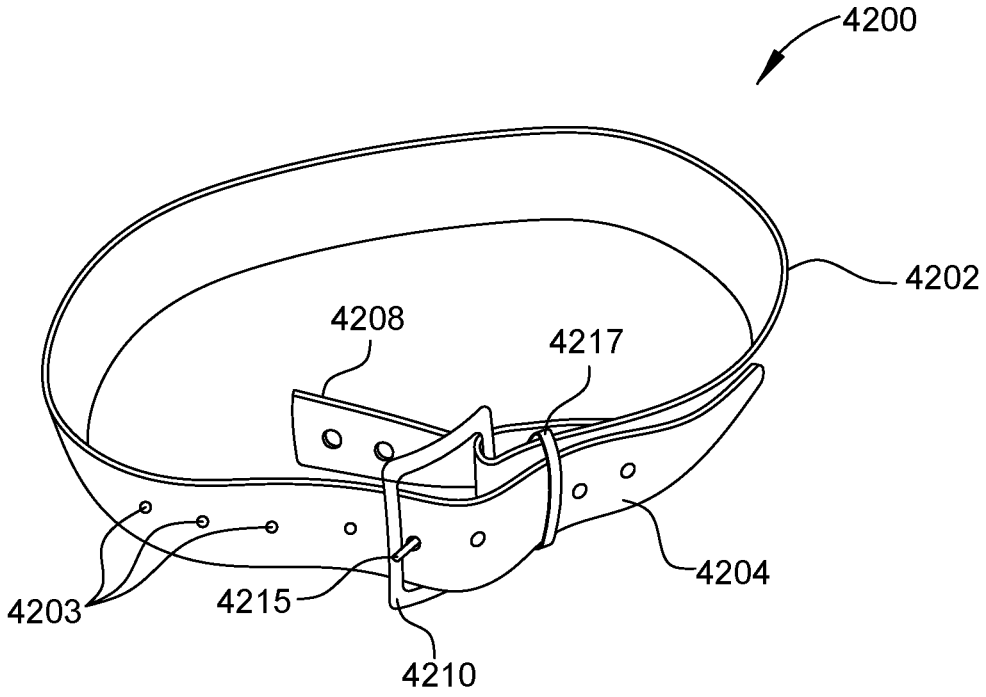

The extender belt 4200 further includes a metal belt loop 4217 coupled to the strap 4202 right next to the buckle 4210. As shown in FIG. 46, the end of the tongue portion 4204 of the belt strap 4202 can be inserted into and extend through the buckle 4210 and the belt loop 4217, similar to standard belts. The metal belt loop 4217 helps secure the end of the tongue portion 4204 to the belt strap 4202 when worn by the user.

Figure 42:
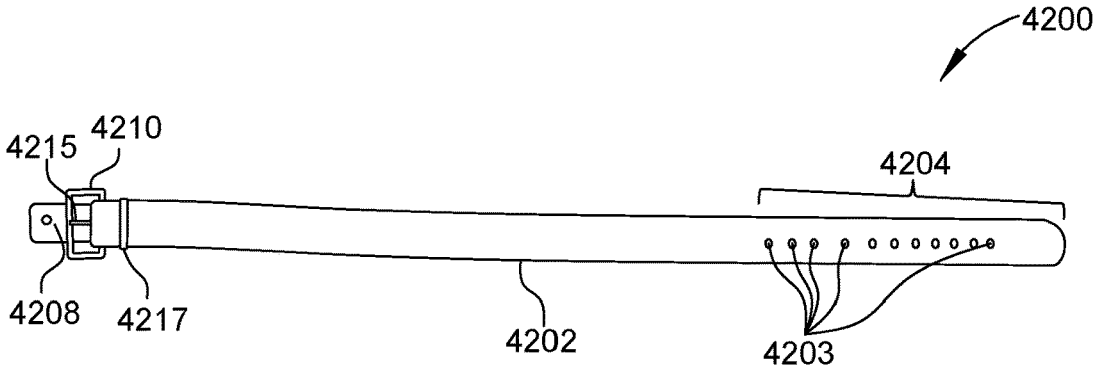
Figure 43:
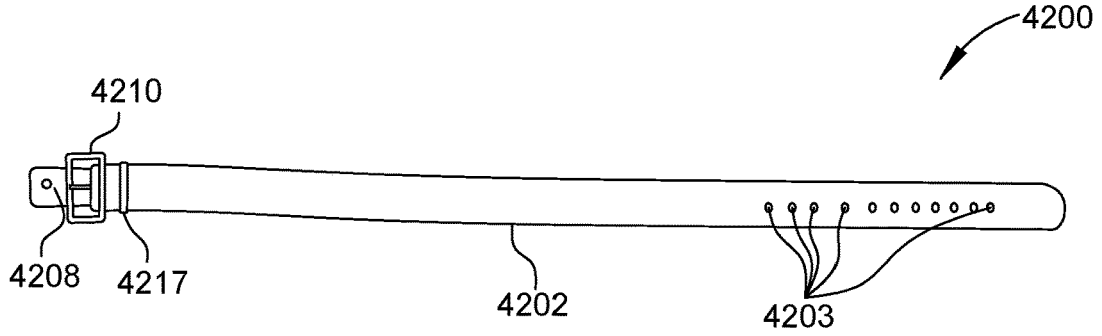
Figure 44:
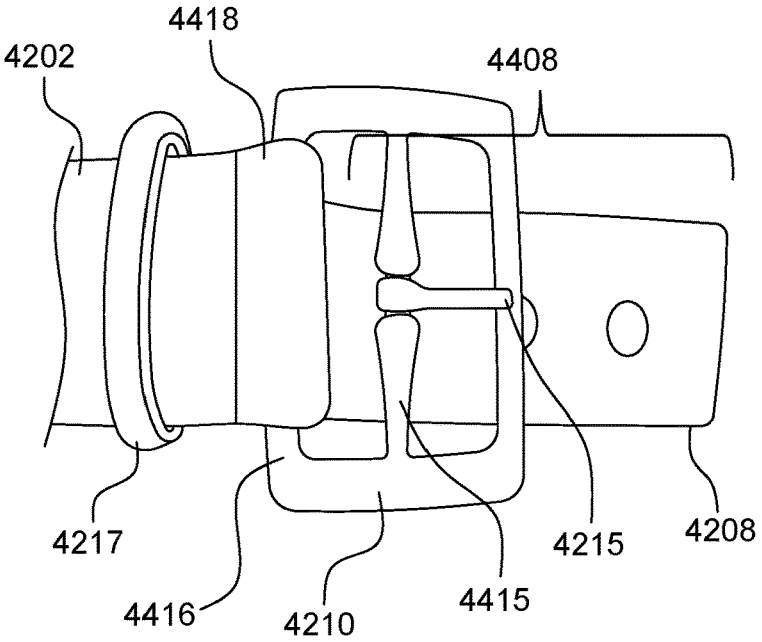
Figure 45:
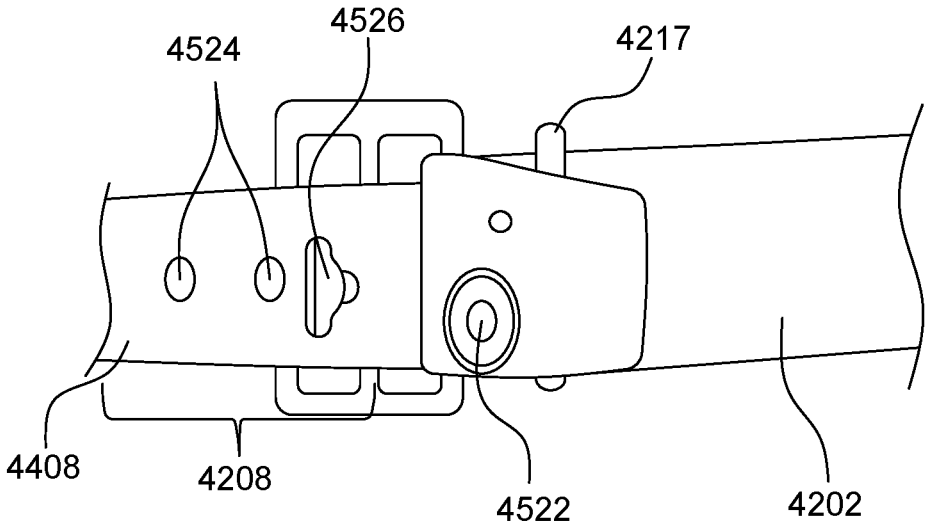

As shown in FIGS. 42-43, the extender belt 4200 further includes an extender feature portion 4208 located behind the buckle 4210. As better shown in FIGS. 44-45, the extender feature portion 4208 includes a leather extender strip 4408 with a plurality (e.g. two or three) of extender buttonholes 4524. The leather strip 4408 is coupled to the strap 4202 near an edge of a loop 4418 of the strap that wraps around a bar 4416 of the buckle 4210. The loop 4418 extends over the belt loop 4217 and couples to the backside of the strap. The loop 4418 can be sewn to the back side of the strap by needle holes and thread. Alternatively, one or more male-female snaps can be used to removeably hold the loop snapped to the back side of the strap 4202. The plurality of extender holes 4524 can be rectangular holes as shown or alternatively circular holes as shown in other embodiments.

In accordance with one embodiment, the extender feature portion 4208 further includes an extender button 4522 coupled to the extender strip 4408. In accordance with another embodiment, the extender feature portion 4208 further includes an extender hook 4526 coupled to the extender strip 4408. In accordance with another embodiment, the extender feature portion 4208 further includes both the extender button 4522 and the extender hook 4526. In this case, the extender button 4522 is coupled to the loop portion of the belt strap 4202 and the extender hook 4526 is coupled to the extender strip 4408.

Figure 47:
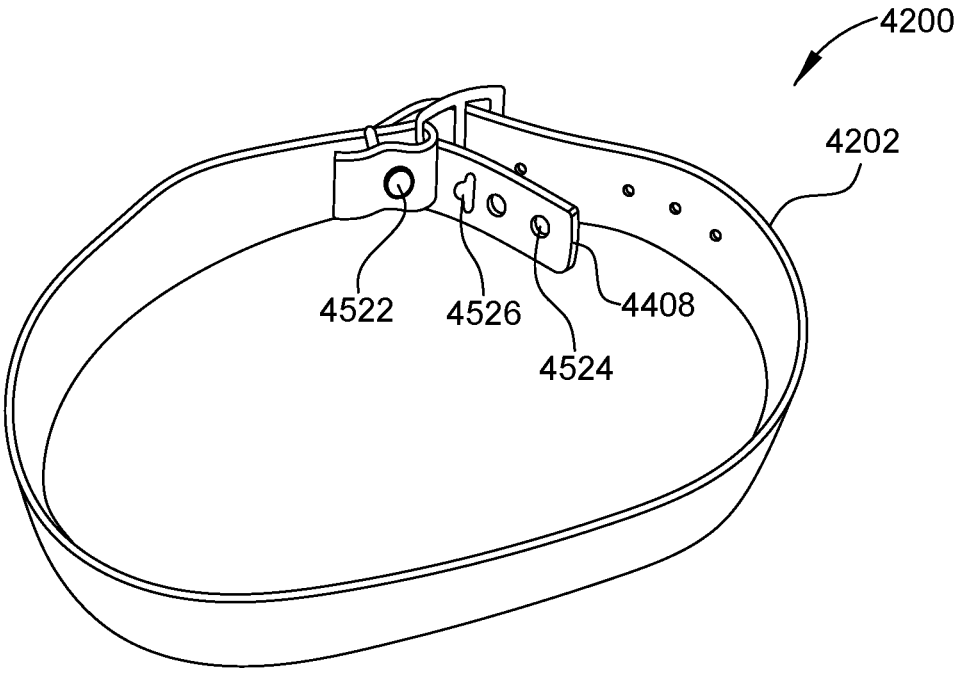
Figure 48:
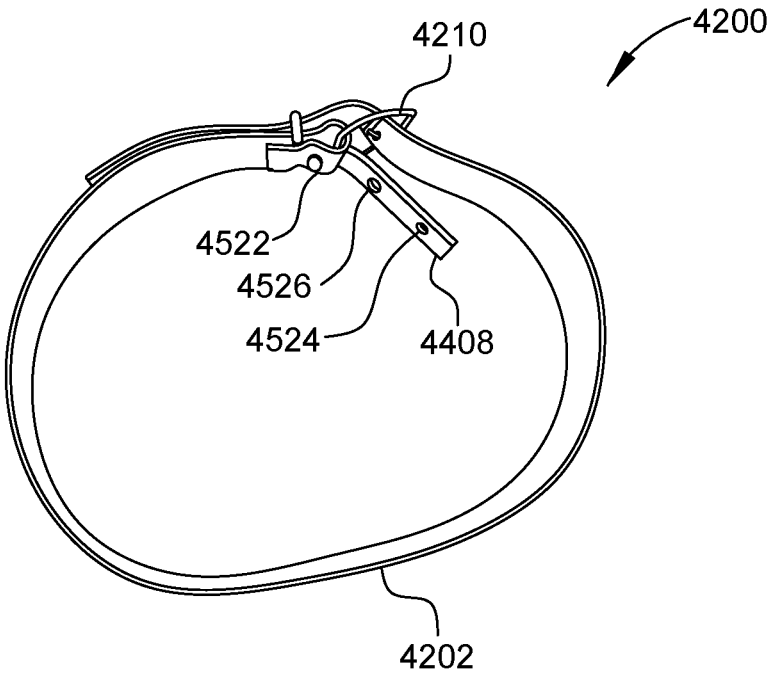

The belt strap 4202 is not contoured. The belt strap 4202 can be inserted through belt loops around the waistband in a pant or trouser. As shown by FIGS. 46-48, the tongue portion 4204 of the strap 4202 can be inserted into and extend through the buckle 4210 and the belt loop 4217. The prong 4215 of the buckle 4210 is inserted into and extends through one of the holes 4203 in the tongue portion 4204 of the strap 4202.

In FIG. 47, the extender button 4522 extends inward and can go into a buttonhole in the pants or trousers worn by a wearer/user. A pant button can go into a selected one of the extender buttonholes 4524. For a different style, the extender hook 4526 can go into a pant bar in the pants or trousers worn by a wearer/user.

Advantageously, the extender strip 4408 extends out from the strap 4202 behind the buckle 4210 and the strap 4202 to be hidden from view when worn by the wearer/user.

Referring now to FIGS. 49-54, an eighth embodiment of an extender belt 4900 is shown. The extender belt 4900 includes a black leather belt strap 4902 and a silver rectangular buckle 4910 coupled to the strap 4902 at one end. A tongue portion 4904 of the belt strap 4902 is at an opposite end. The belt strap 4902 includes a plurality of spaced apart holes 4903 in a row in the tongue portion 4904. Each of the holes 4903 in the tongue portion 4904 of the belt strap 4202 can receive a prong 4215 of the buckle 4210.

It can be desirable to provide flexibility to change out the buckle 4910 to a different color such as gold or brass, or a different design/style such as an oval buckle. With the extender belt 4900, the buckle 4910 is removeably coupled to the belt strap 4902 by a loop 4918 in the strap and two removable snaps 4912. In an alternate embodiment, the buckle 4910 is fixed with the end of the loop 4918 being sewn to the belt strap.

Figure 49:
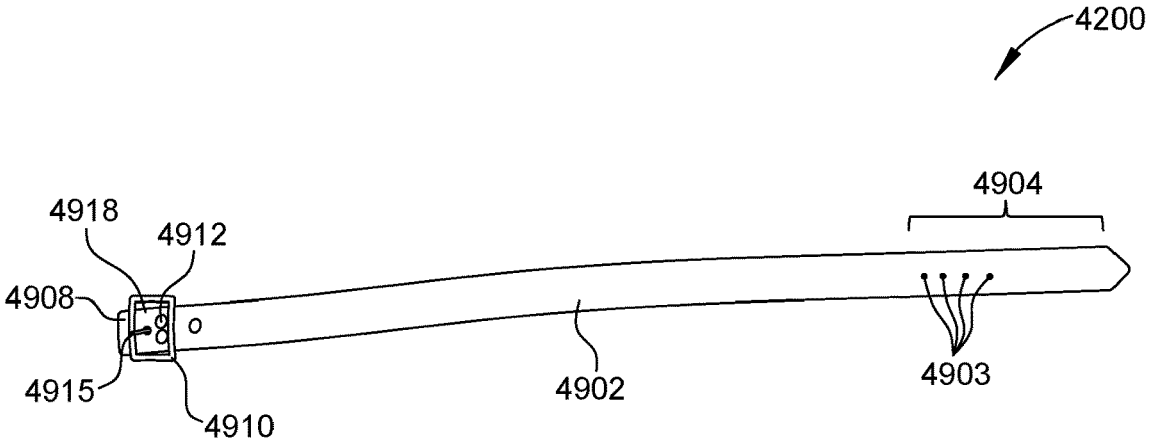
Figure 50:
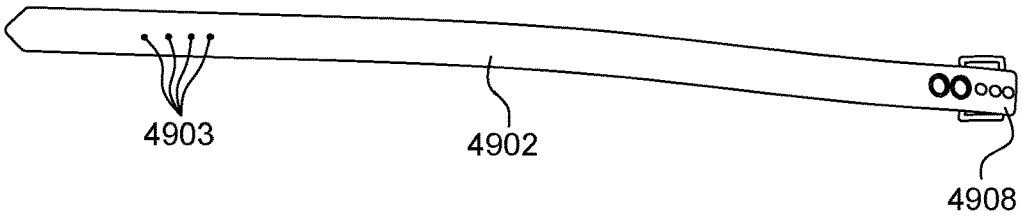
Figure 51:
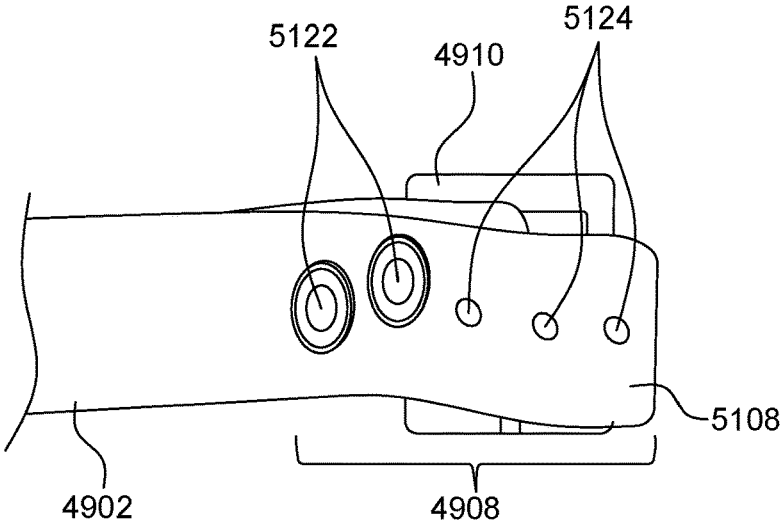

As shown in FIGS. 49-50, the extender belt 4900 further includes an extender feature portion 4908 located behind the buckle 4910. As better shown in FIG. 51, the extender feature portion 4908 includes a leather extender strip 5108 with a plurality (e.g. two or three) of extender buttonholes 5124. The extender strip 5108 is coupled to the strap 4902. The extender strip 5108 can be an integral part of the strap 4902 or physically coupled thereto such as by a needle and thread. The plurality of extender buttonholes 5124 in series in a row can be rectangular holes, circular holes, diamond holes, or a combination.

The loop 4918 wraps around a center bar of the buckle 4910 and has a center hole allowing the prong to pivotally extend out from the loop. The loop 4918 is removeably coupled closed by the pair of snaps 4912. In an alternate embodiment, the buckle 4910 is fixed with the end of the loop 4918 being sewn to the belt strap.

The extender feature portion 4908 further includes a plurality of extender buttons 5122 to provide flexibility in covering up over different size waistband openings and zipper openings. One of extender buttons 5122 is coupled to the belt strap 4902. Another one of the extender buttons 5122 is coupled to the extender strip 5108.

Figure 52:
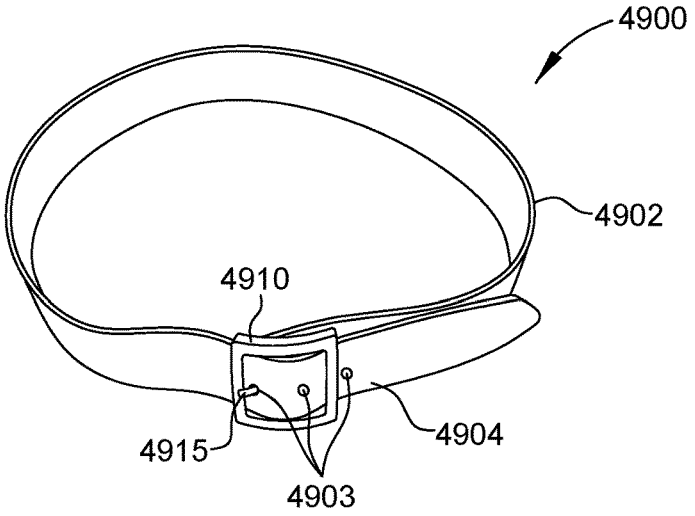

The belt strap 4902 is not contoured. The belt strap 4902 can be inserted through belt loops around the waistband in a pant or trouser. As shown by FIG. 52, the tongue portion 4904 of the strap 4902 can be inserted into and extend through the buckle 4910. The prong 4915 of the buckle 4910 is inserted into and extends through one of the holes 4903 in the tongue portion 4904 of the strap 4902.

Figure 53:
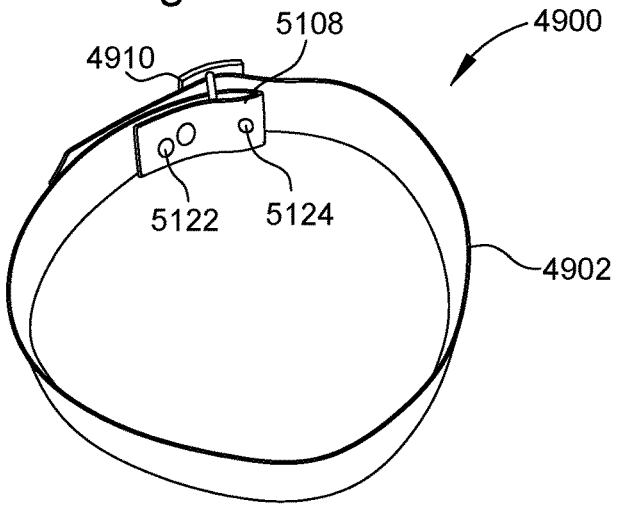
Figure 54:
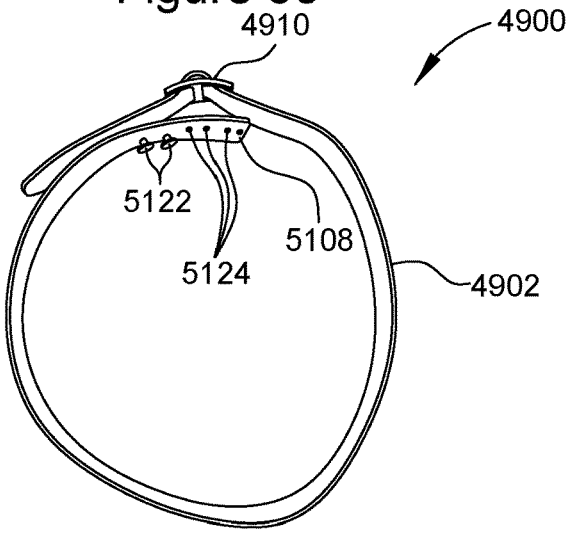

As shown by FIGS. 53-54, the extender buttons 5122 extends inward and a selected one can go into a buttonhole in the pants or trousers worn by a wearer/user. A pant button can go into a selected one of the extender buttonholes 5124. The combination of a plurality (e.g., two) of extender buttons 5122 and a plurality (e.g., three) of extender buttonholes 5124 allows flexibility in coupling to pants and bridging over an open waistband.

Advantageously, the extender strip 5108 extends out from the strap 4902 behind the buckle 4910 and the strap 4902 to be hidden from view when worn by the wearer/user.

Wide Belt Worn Over Pant Loops, Buckle In Front, Built In Extender

Referring now to FIGS. 55-62, a ninth embodiment of an extender belt 5500 is shown. The extender belt 5500 includes a black leather belt strap 5502 and a black leather vertical rectangular buckle 5510 pivotally coupled to the black leather belt strap 5502.

Figure 56:
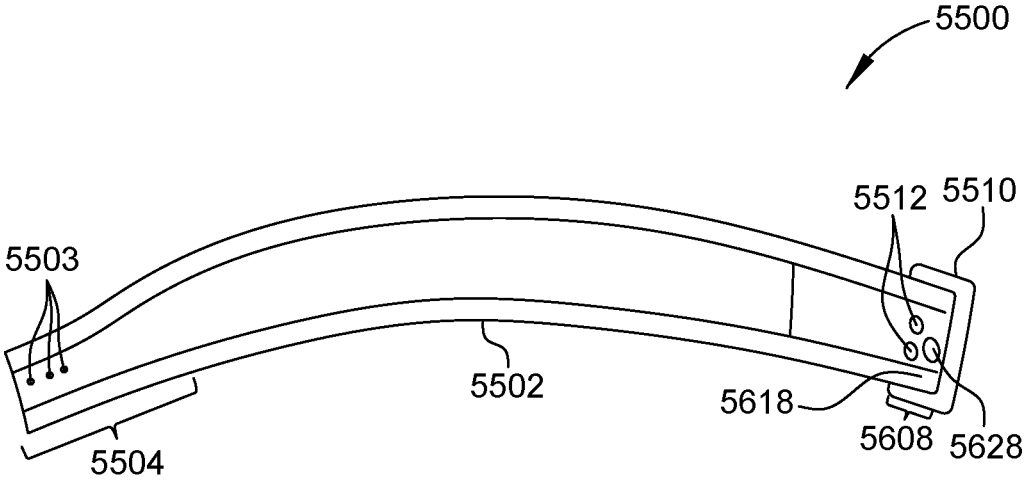
Figure 57:
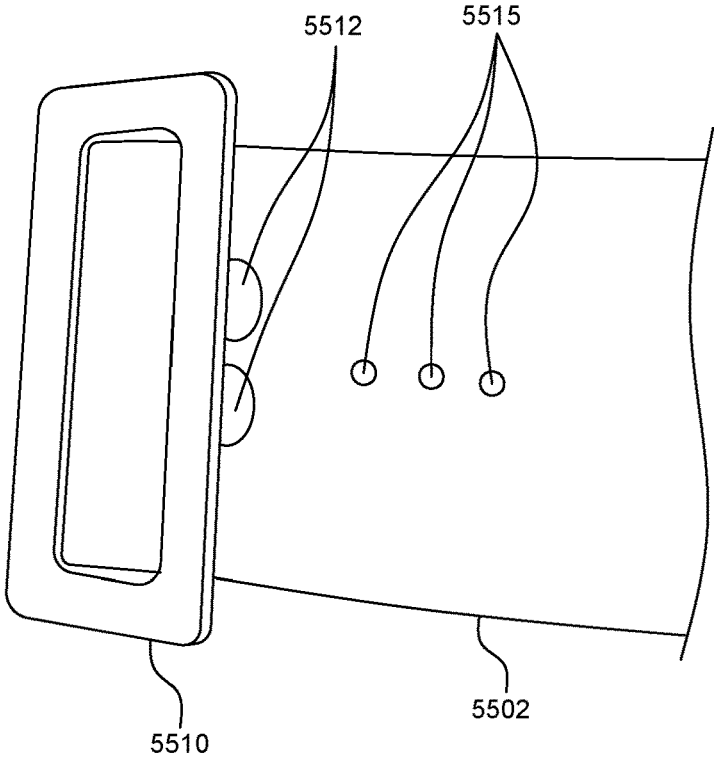
Figure 59:
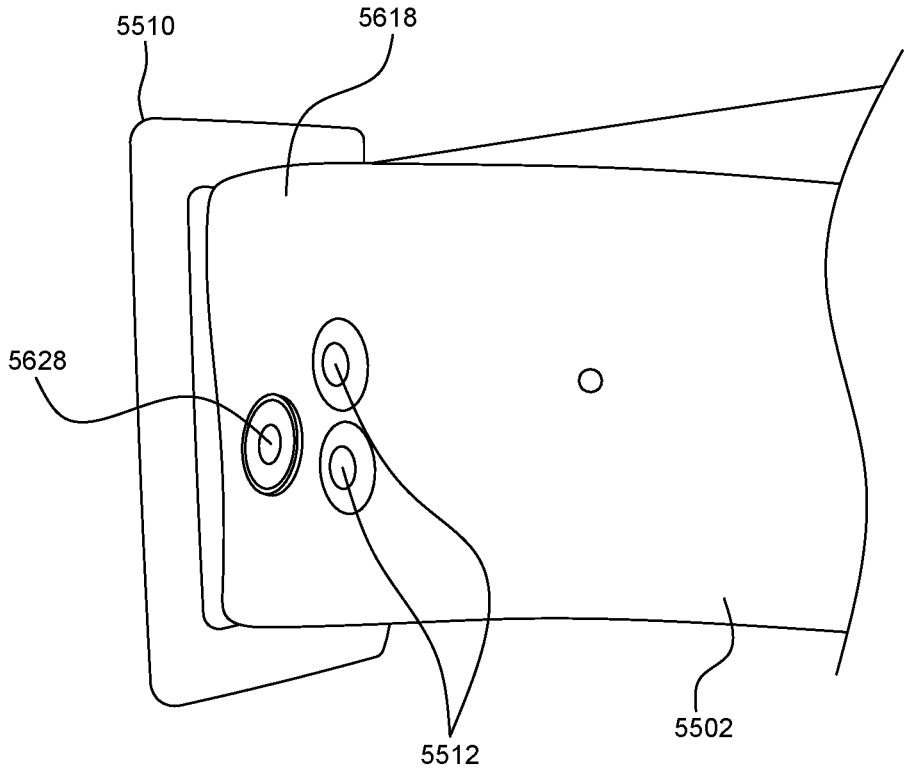

As can be seen in FIGS. 56, 57, and 59, the buckle 5510 is secured to the strap 5502 by the end of the strap wrapping around a center bar of the buckle and folding over to form a loop 5618. The end of the strap is fastened to a backside of another portion of the belt strap and fastened together with two male-female snaps 5512. The use of snaps allows a swap of buckles to a different color or a different design style. In an alternate embodiment, the end of the strap is fastened to the backside of the belt strap by being sewn thereto.

Figure 55:
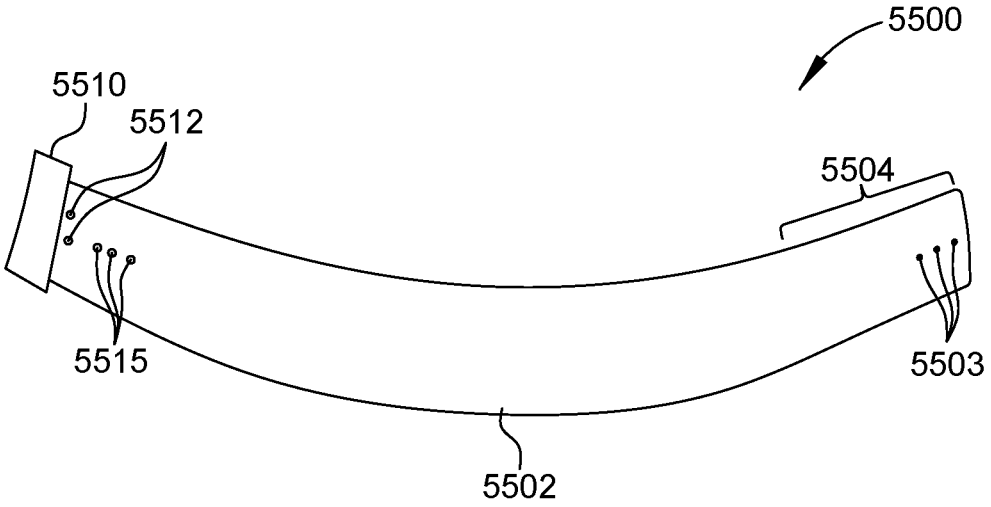

Note that the buckle 5510 has no prong. Instead, the strap 5502 has three button studs 5515 near the buckle 5510 as shown in FIGS. 55 and 57. The three button studs 5515 are configured to removeably couple to the holes 5503 of the strap 5502 in order to form a loop coupling portions of the extender belt together.

Figure 61:
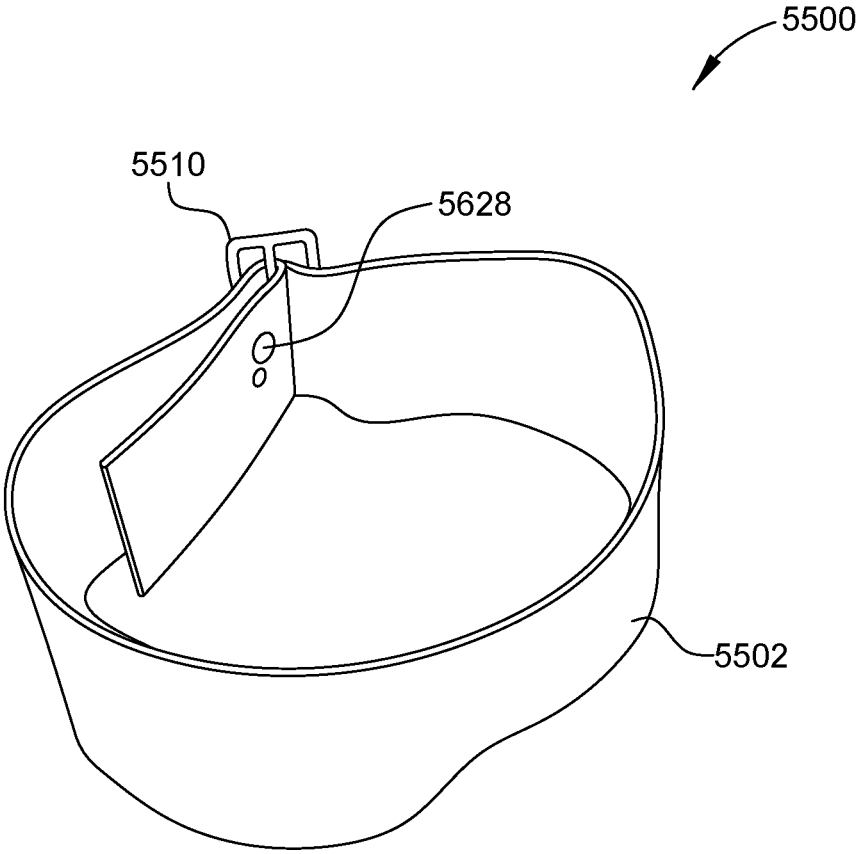
Figure 62:
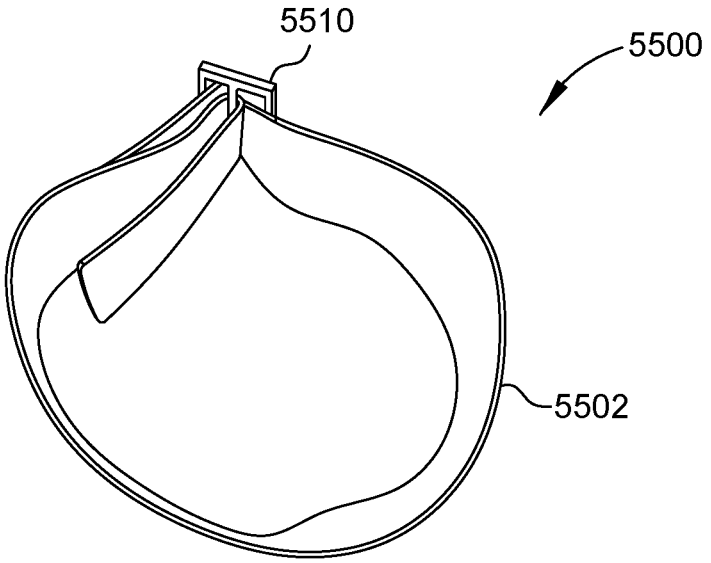

As shown in FIG. 56, the extender belt 5500 further includes an extender feature portion 5608 in the strap 5502 located in the backside behind the buckle 5510. The extender feature portion 5608 includes an extender button 5628 configured to engage a buttonhole in pants to couple the extender belt to the users pants and cover over the open waistband. Given the width of the strap of the extender belt 5500, there is no need for extender holes in the strap to engage a pant button of the pants worn by the user. Referring now to FIG. 61, the extender button 5628 extending inward towards the user is inserted into a buttonhole in the pants the user desires to wear.

Figure 58:
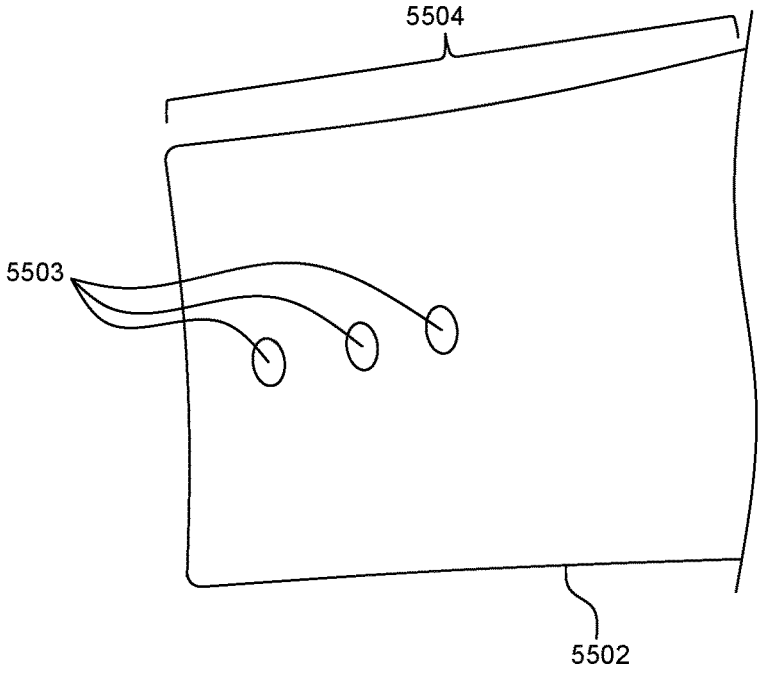
Figure 60:
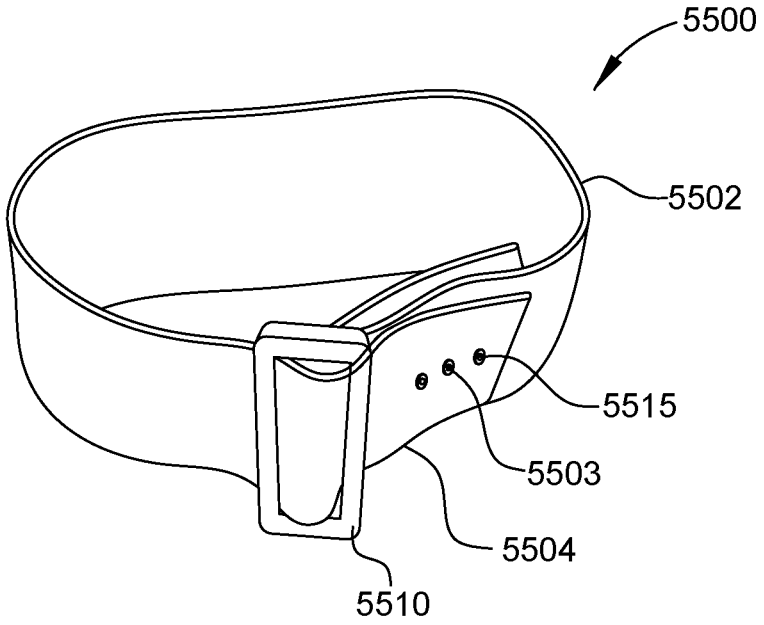

As shown in FIGS. 55 and 58, the tongue portion 5504 of the strap has three holes 5503 receiving a matching number of button studs 5515. Referring now to FIG. 60, the tongue portion of the strap 5502 is routed up, over the center bar, down, and through the belt buckle 5510. That is, the tongue portion of the strap 5502 goes through into the buckle on one side and comes out of the buckle on the opposite side. The tongue portion 5504 of the strap 5502 can then be releasable coupled to the opposite side of the strap.

One or more holes 5503 of the tongue portion of the strap 5502 are then aligned with one or more of the button studs 5515 and releasably engaged together. As shown in FIG. 60, three holes 5503 are engaged with three button studs 5515 forming a loop in the strap 5502 that can secure the extender belt 5500 around the wearer/user. The holes 5503 of the strap 5502 are configured to be releasable from the engagement with the button studs 5515 so the loop formed out of the strap can be opened and the pants taken off from a user.

While the extender belt 5500 is slightly contoured, the width of the strap 5502 is large such that the tongue portion of the strap is not intended to be worn through belt loops. Instead, the extender belt 5500 is designed as a mid/hip belt or waist belt that goes around to the right.

As shown in FIG. 60, the vertical rectangular buckle 5510 of the extender belt 5500 camouflages the extender button 5628 and can help cover an open waistband and a partially opened zipper of a pants or trousers.

Wide Belt Worn Over Pant Loops, Buckle In Front, Built In Extender

Referring now to FIGS. 63-69, a tenth embodiment of an extender belt 6300 is shown. The extender belt 6300 is similar to the extender belt 5500 shown in FIGS. 55-62 but with a different buckle and snaps. The extender belt 6300 includes a black leather belt strap 6302 and a gold round belt buckle 6310 coupled to the strap 6302.

As can be seen in FIGS. 63-66, the buckle 6310 is secured to the strap 6302 by the end of the strap wrapping around a center bar of the buckle and folding over to form a loop 6418. The end of the strap is fastened to a backside of another portion of the belt strap and fastened together with two male-female snaps 6312. The use of snaps allows a swap of buckles to a different color or a different design style. The snaps 6312 can be gold colored to match the color of the gold round belt buckle 6310. In an alternate embodiment, the end of the strap is fastened to the backside of the belt strap by being sewn thereto.

Figure 63:
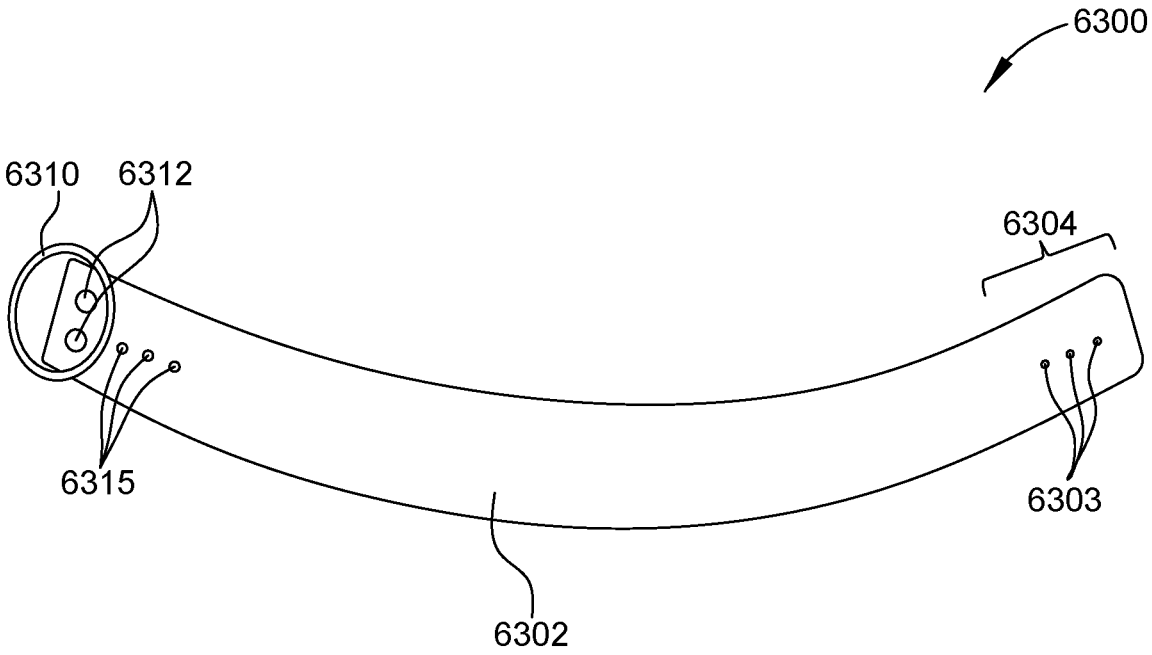
Figure 65:
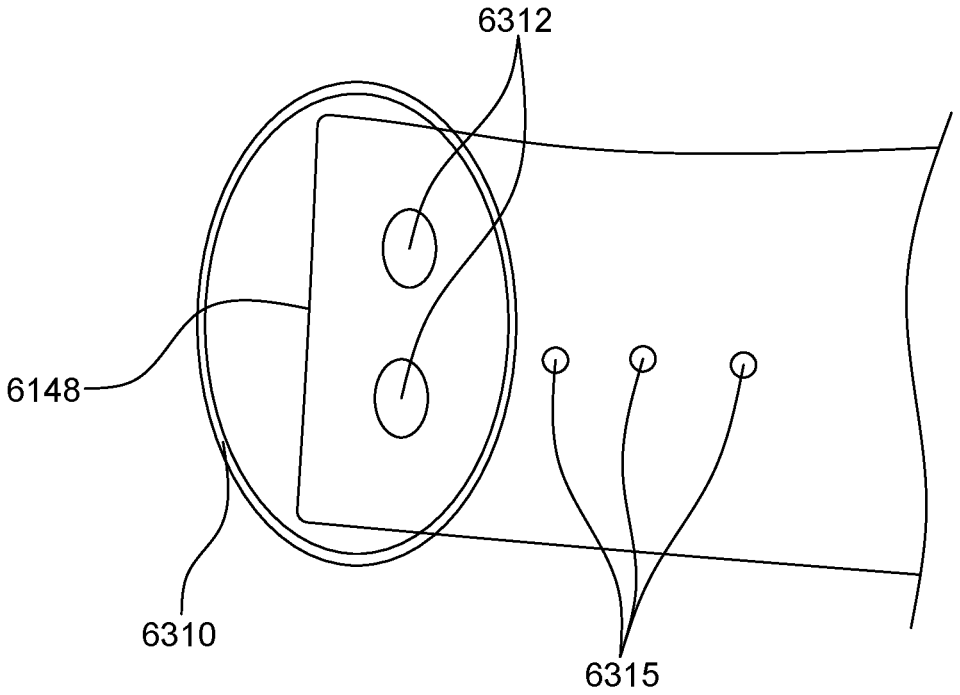
Figure 66:
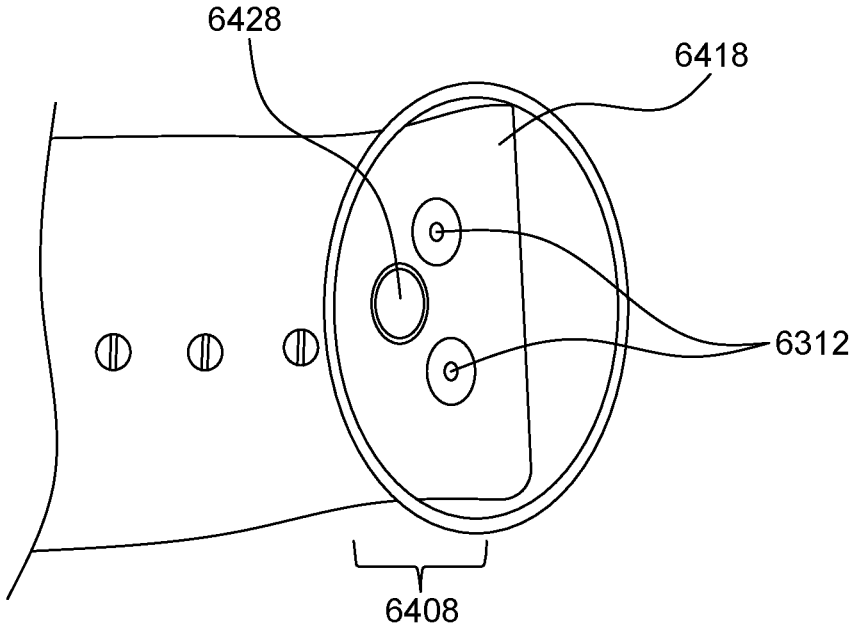

Note that the buckle 6310 has no prong. Instead, the strap 6302 has three button studs 6315 near the buckle 6310 as shown in FIGS. 63 and 65. The three button studs 6315 are configured to removeably couple to the holes 6303 of the strap 6302 in order to form a loop coupling portions of the extender belt together.

Figure 64:
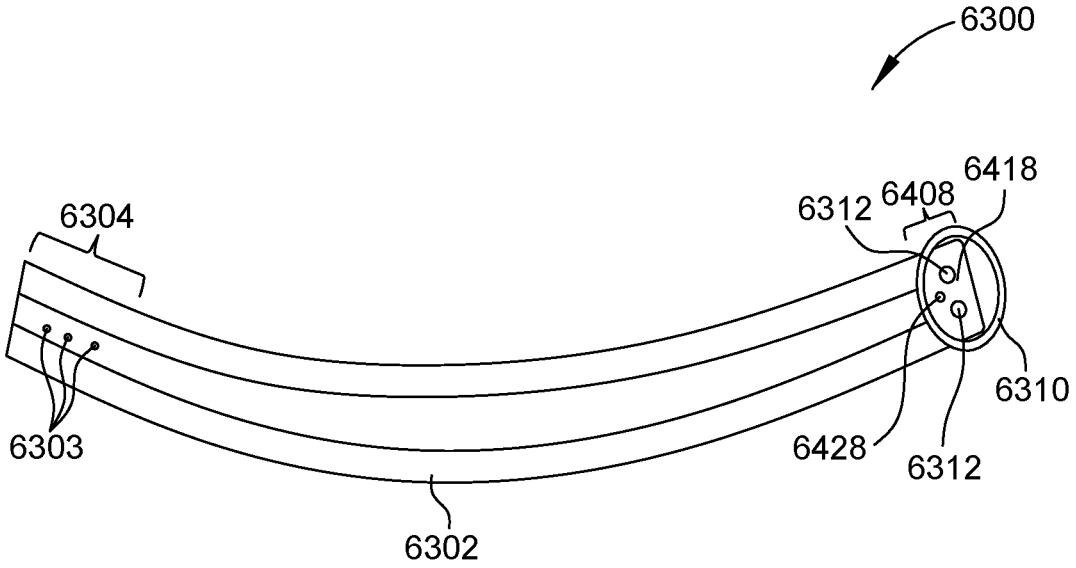
Figure 68:
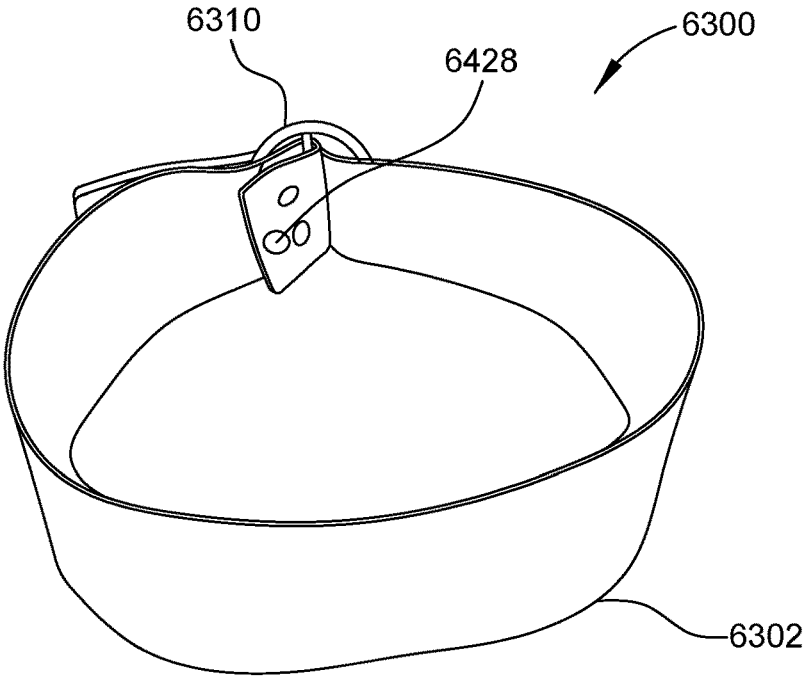
Figure 69:
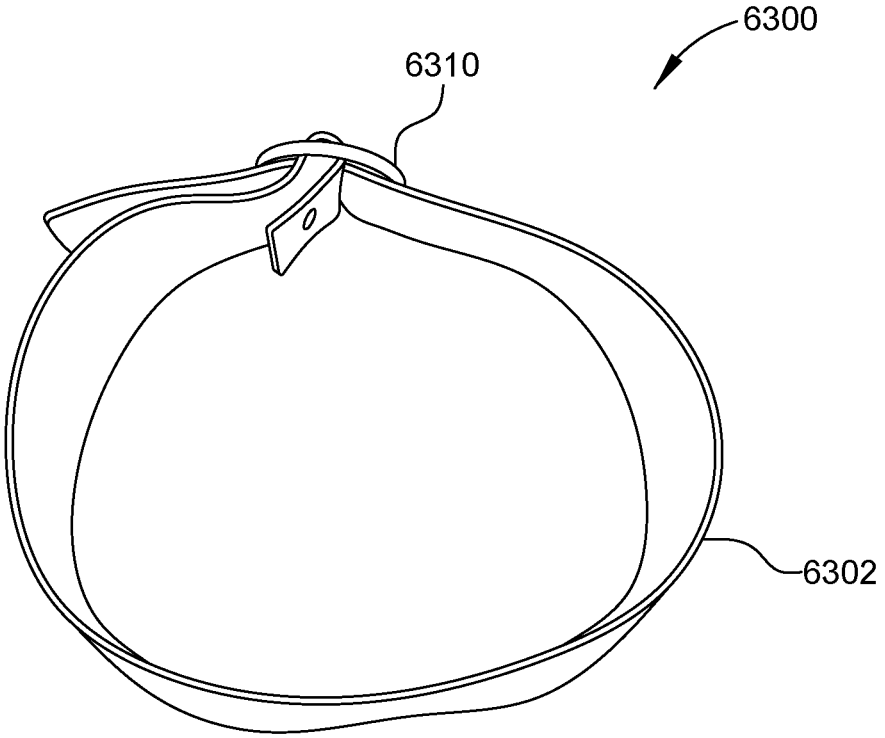

As shown in FIG. 64, the extender belt 6300 further includes an extender feature portion 6408 in the strap 6302 located in the backside behind the buckle 6310. The extender feature portion 6408 includes an extender button 6428 configured to engage a buttonhole in pants to couple the extender belt to the users pants and cover over the open waistband. Given the width of the strap of the extender belt 6300, there is no need for extender holes in the strap to engage a pant button of the pants worn by the user. Referring now to FIG. 68, the extender button 6428 extending inward towards the user is inserted into a buttonhole in the pants the user desires to wear.

Figure 67:
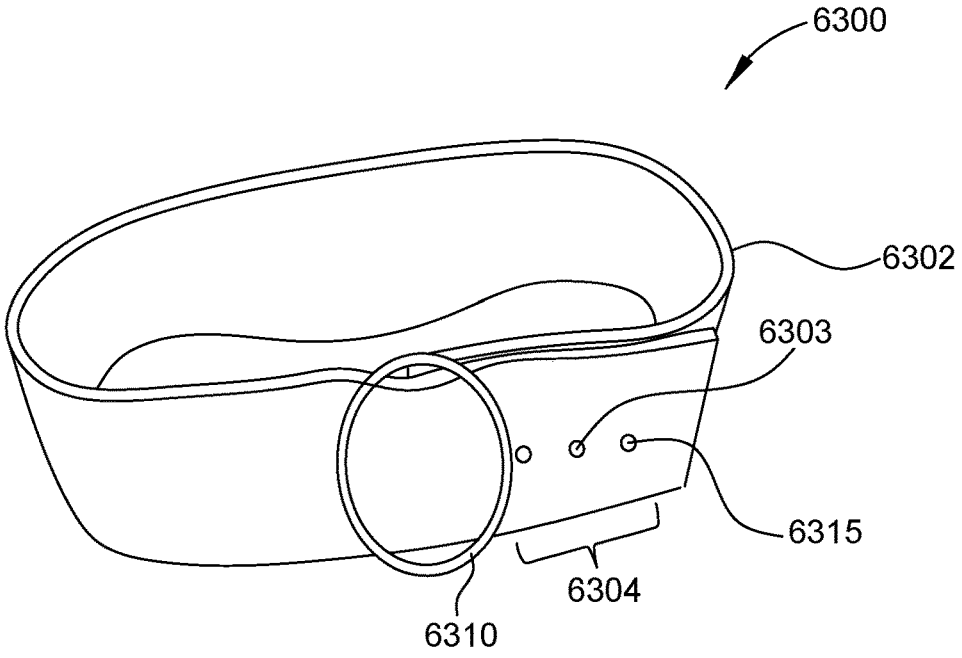

As shown in FIG. 63, the tongue portion 6304 of the strap has a number of button stud holes 6303 to receive a matching number of button studs 6315. Referring now to FIG. 67, the tongue portion of the strap 6302 is routed up, over the center bar, down, and through the belt buckle 6310. That is, the tongue portion of the strap 6302 goes through into the buckle on one side and comes out of the buckle on the opposite side. The tongue portion 6304 of the strap 6302 can then be releasably coupled to the opposite side of the strap.

One or more holes 6303 of the tongue portion of the strap 6302 are then aligned with one or more of the button studs 6315 and releasably engaged together. As shown in FIG. 67, three holes 6303 are engaged with three button studs 6315 forming a loop in the strap 6302 that can secure the extender belt 6300 around the wearer/user. The holes 6303 of the strap 6302 are configured to be releasable from the engagement with the button studs 6315 so the loop formed out of the strap can be opened and the pants taken off from a user.

While the extender belt 6300 is slightly contoured, the width of the strap 6302 is large such that the tongue portion of the strap is not intended to be worn through belt loops. Instead, the extender belt 6300 is designed as a mid/hip belt or waist belt that goes around to the right.

As shown in FIG. 67, the vertical rectangular buckle 6310 of the extender belt 6300 camouflages the extender button 6428 and can help cover an open waistband and a partially opened zipper of a pants or trousers.

Wide Strap Grabs Buckle from Side, Pulls Over and Secures

Referring now to FIGS. 70-75, an eleventh embodiment of an extender belt 7000 is shown. The extender belt 7000 includes a black elastic belt strap 7002 and a silver crescent moon-shaped buckle 7010 coupled to the strap. The extender belt 7000 is designed for a hook and bar attachment to pants. The strap 7002 includes a plurality (e.g., two) of stud holes 7003 in a tongue portion 7004.

Figure 70:
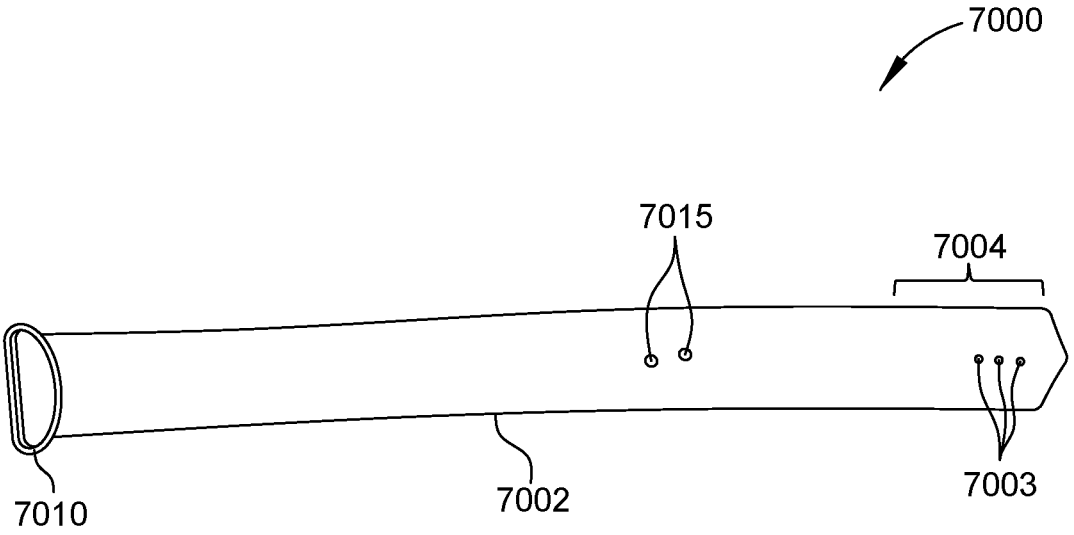

Note that the buckle 7010 has no prong. Instead, the strap 7002 has a plurality of button studs 7015 near its midpoint as shown in FIG. 70. The button studs 6315 are configured to removeably coupled to the stud holes 7003 of the strap 7002 in order to couple the tongue portion to another part of the strap.

Figure 71:
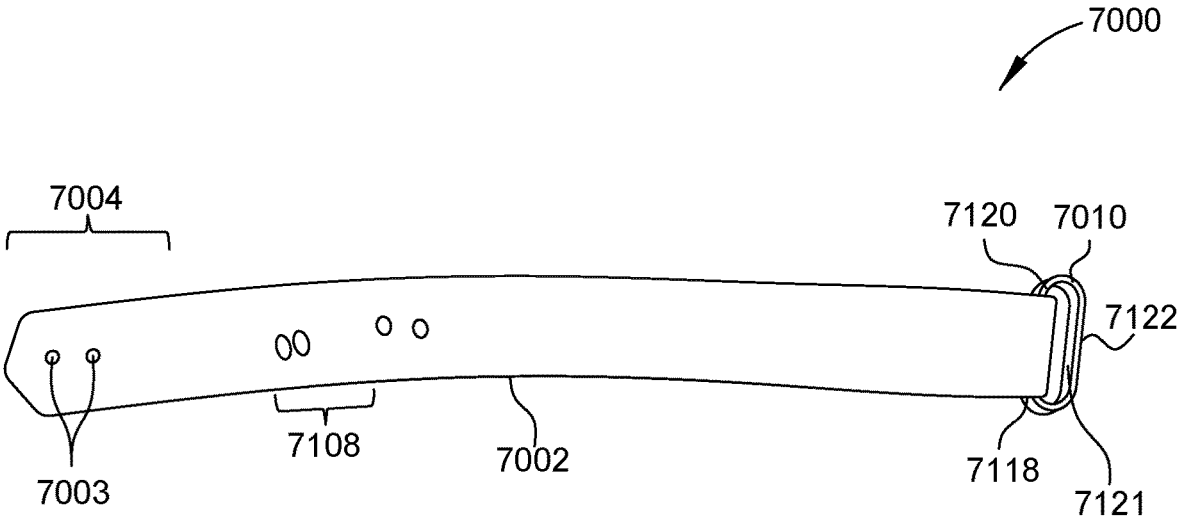

As can be seen in FIG. 71, the buckle 7010 is secured to the strap 7002 by an end of the strap wrapping around a first buckle bar 7120 of the buckle 7010 and folding over to form a loop 7118. After the loop, the end of the strap is fastened to a backside of the belt strap. The layers of belt strap can fastened together by sewing thread into holes between each with a needle. Alternatively, the layers of belt strap can be coupled together by one or more male-female snaps. With one end of the strap coupled to the buckle, the opposite end can be inserted into the opening 7121 and wrapped over the second buckle bar 7122 of the buckle 7010.

Figure 72:
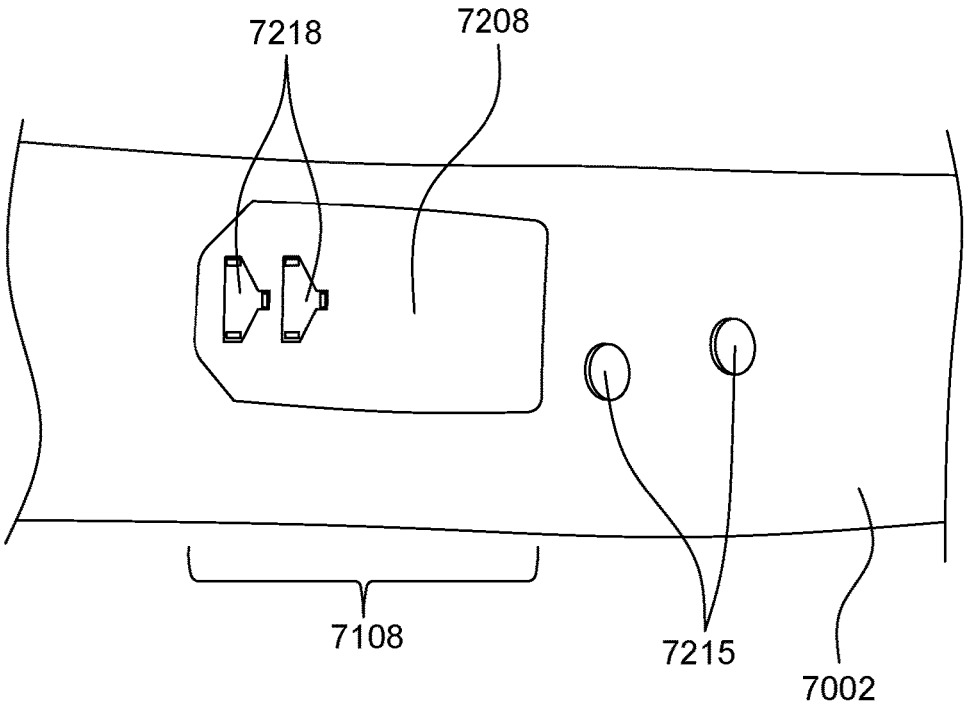
Figure 73:
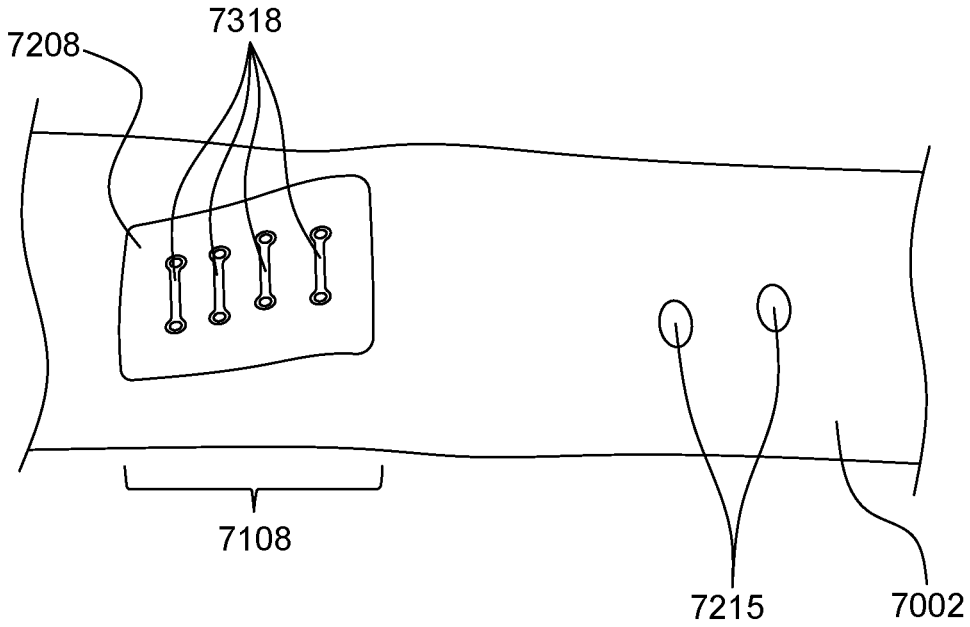

As shown in FIGS. 71-73, the extender belt 7000 includes an extender feature portion 7108 in the backside of the strap near the fasteners 7215 holding the button studs 7015 to the strap 7002. The extender feature portion 7108 includes a leather extender strip 7208 with one end coupled to the belt strap 7002. The extender feature portion 7108 further includes a plurality (e.g., two) extender hooks 7218 coupled to a first side of the strip 7208 that typically faces the user/wearer. With one end coupled to the strap 7002, the extender strip 7208 can be flipped over to reveal another side.

As shown in FIG. 73, the extender feature portion 7108 further includes a plurality (e.g., four) of extender bars (extender latches) 7318 coupled to a second side of the extender strip 7208 typically facing the backside of the strap 7002. Accordingly, the extender strip 7208 has a plurality of extender hooks on one side and a plurality of extender bars on the opposite side.

Figure 74:
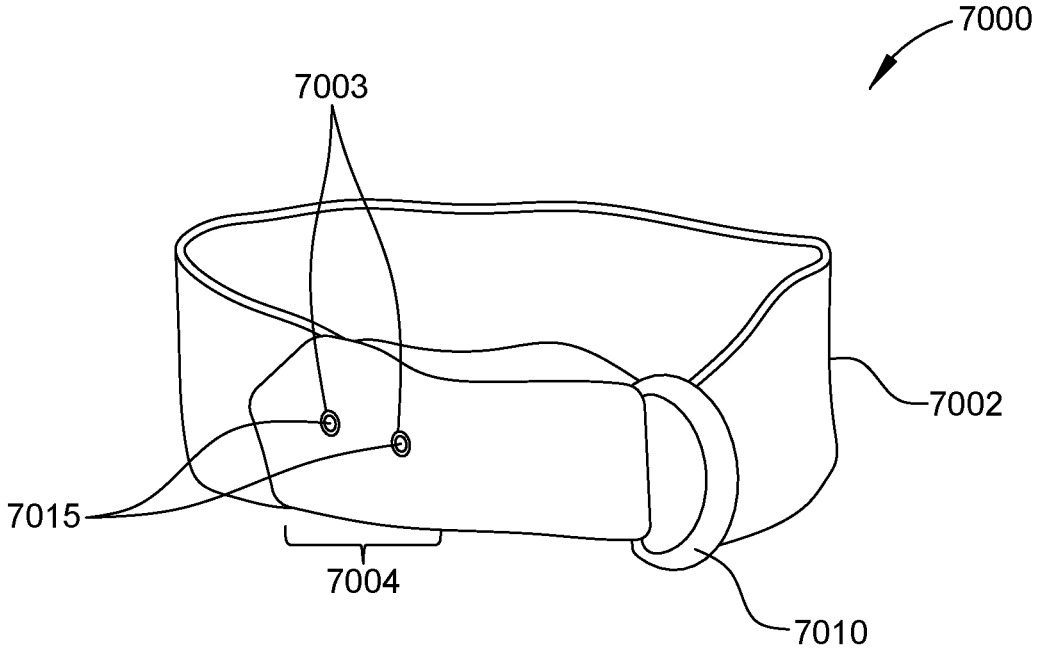

Referring now to FIG. 74, the expender belt 700 is typically worn by the user/wear with the buckle 7010 on a hip (e.g., on the left hip) and side of the user/wearer. With this configuration, the studs 7015 of the extender belt near the front of the user/wearer. The tongue portion 7004 of the strap 7002 is threaded through the buckle 7010 somewhat differently than with previous buckles.

Figure 75:
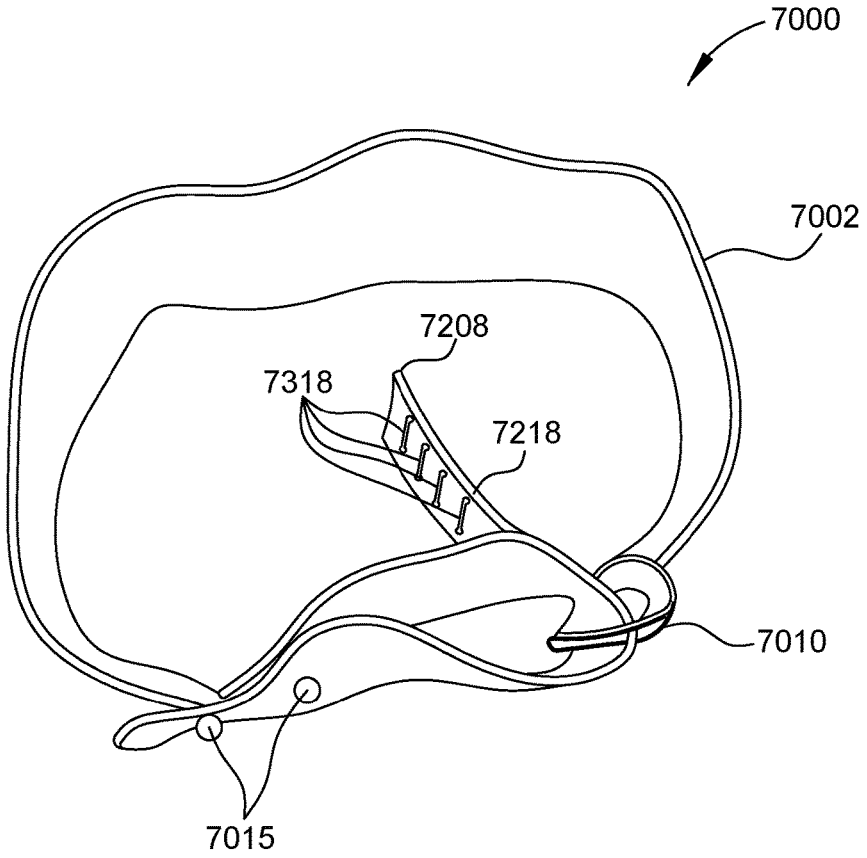

Referring now to FIGS. 72-73 and 75, for a user/wearer to wear the extender belt 7000, a pant hook in the pants or trousers is hooked onto a selected one of the plurality of extender bars 7318 on one side of the extender strip 7208. A pant bar around the waist in the pants or trousers is attached to a selected one of the plurality of extender hooks 7218 on the opposite side of the extender strip 7208.

Referring to FIGS. 71 and 74, the end of the tongue portion 7004 of the strap 7002 is inserted into and through the opening 7121 of the buckle 7010. The tongue portion 7004 is then wrapped back over the bar 7122 so that is fed back from the direction it came. If inserted from the right, then the tongue portion feeds back to the right of the user/wearer. The openings 7003 in the tongue portion 7004 of the strap are then aligned with the studs 7015 in the strap. The tongue portion is pushed in towards the strap 7002 so that the holes 7003 releasably engage button studs 7015 to secure the tongue portion to the strap 7002.

As shown in FIG. 74, the extender belt 7000 is not contoured much at all. The extender belt 7000 has a wide belt strip 7002 and is not intended to be worn through the belt loops of pants or trousers, unless the belt loops are wide enough to receive the width of the strap. The extender belt 7000 is designed to be a mid/hip or waist belt.

While the extender belt 7000 has been described as having an extender feature portion with hooks and bars, the extender belt 7000 can be modified to have buttons and holes in the place of its hook and bars.

Wide Strap Grabs Buckle from Side, Pulls Over and Secures

Referring now to FIGS. 76-82, a twelfth embodiment of an extender belt 7600 is shown. The extender belt 7600 includes a black leather belt strap 7602 and a silver round buckle 7610 coupled to the strap. The buckle 7610 in this case is worn on the side of the user/wearer such as the right hip. Alternatively, the belt can be inverted with the buckle 7610 on the left hip and other features inverted.

The strap 7602 includes an extender feature portion 7608. A tongue strap 7604 is coupled to the belt strap 7602. The tongue strap 7604 has a plurality (e.g., 4) of stud holes 7603. A width of the tongue strap 7604 is less than the width of the belt strap 7602 so that the tongue strap can be inserted through the buckle 7610.

Figure 76:
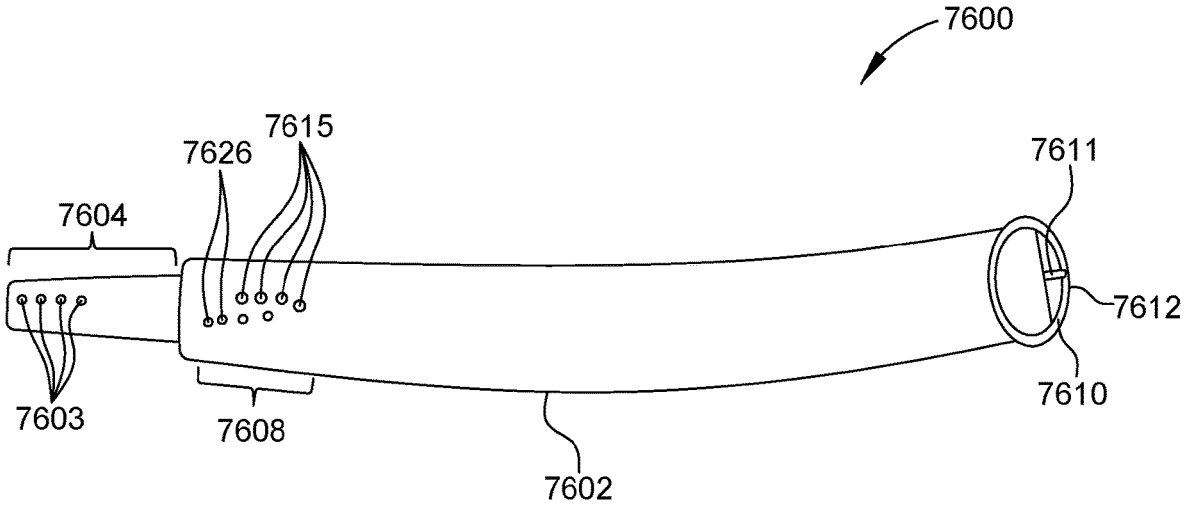

Note that the buckle 7610 has no prong. Instead, the belt strap 7602 has a plurality of button studs 7615 as shown in FIG. 76. The button studs 7615 are configured to be removeably coupled to the stud holes 7603 of the strap 7602 in order to couple the tongue portion 7604 to another part of the strap 7602.

Figure 77:
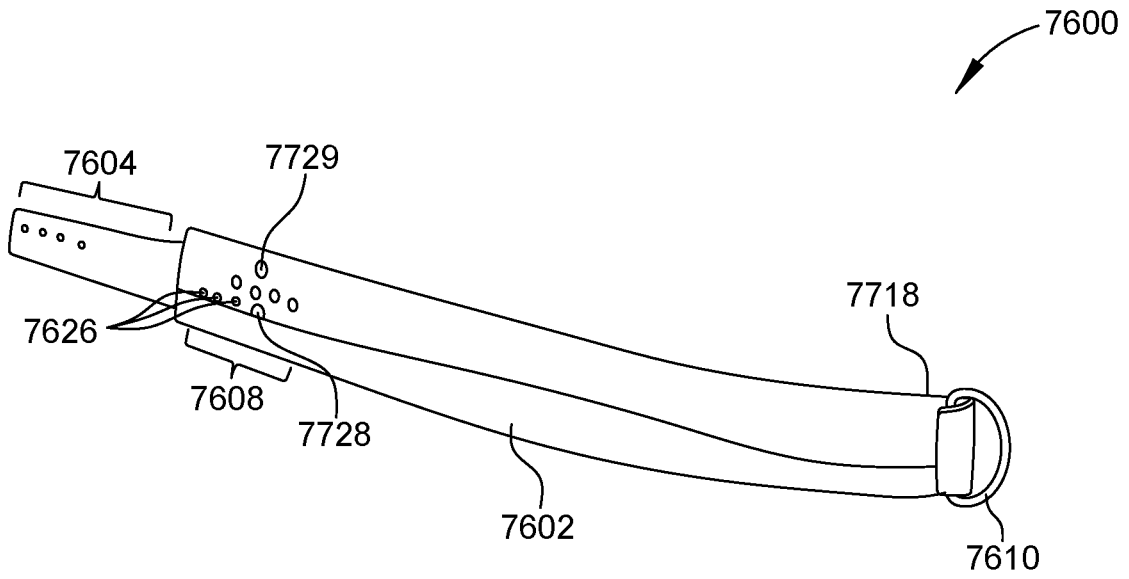
Figure 78:
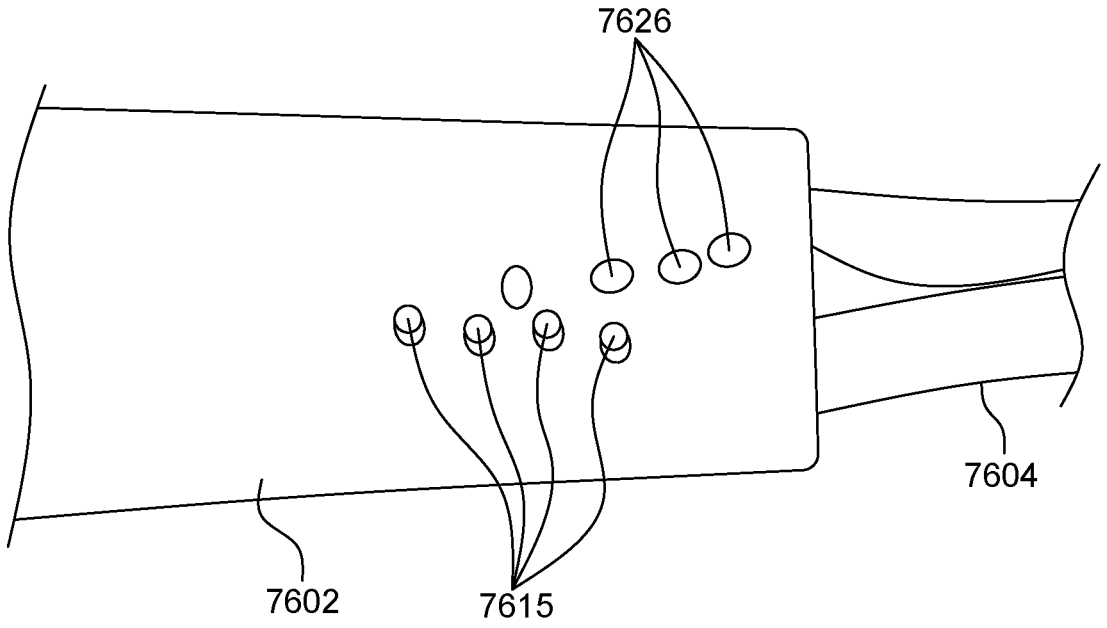
Figure 80:
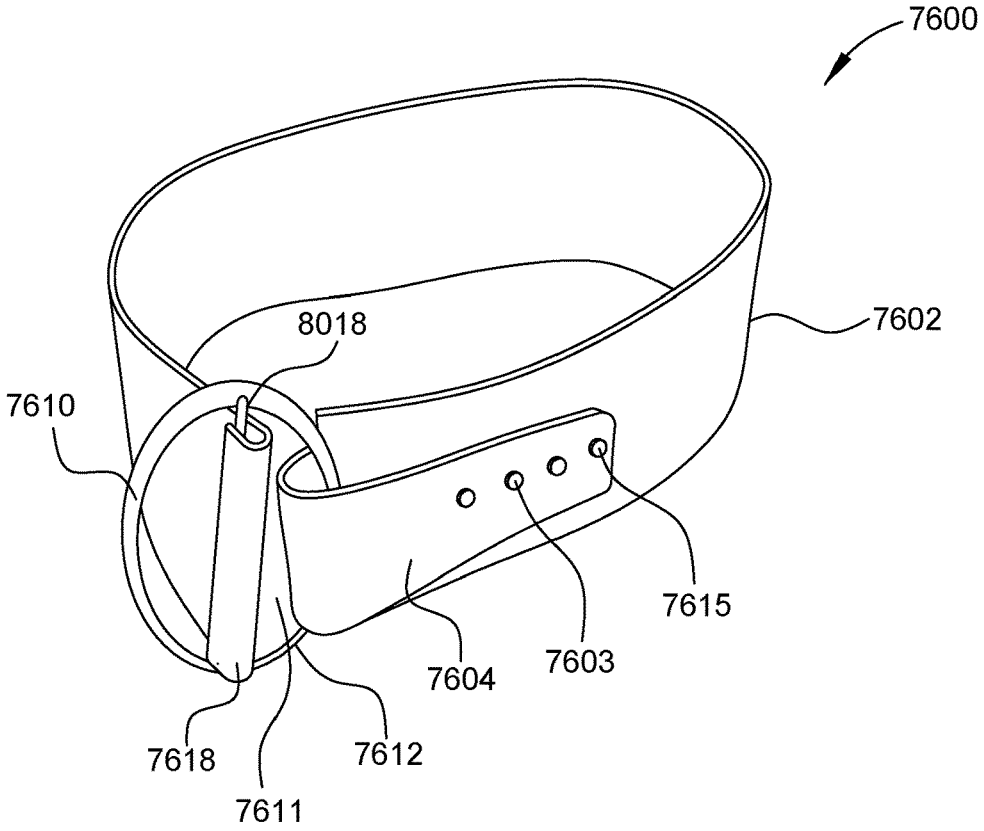

The buckle 7610 is also open with a center bar 8018 as shown in FIG. 80. As can be seen in FIGS. 77 and 80, the buckle 7610 is secured to the strap 7602 by having an end of the strap wrap around the center buckle bar 8080 of the buckle 7610 and folding over to form a loop 7718. After the loop, the end of the strap is fastened to a backside of the belt strap 7602. These layers of belt strap can fastened together by sewing thread into holes between each with a needle. Alternatively, the layers of belt strap can be coupled together by one or more male-female snaps. With one end of the strap coupled to the buckle, the opposite end can be inserted into the opening 7611 and wrapped over a semicircle outer bar 7612 of the buckle 7610 as shown in FIGS. 76 and 80.

Figure 79:
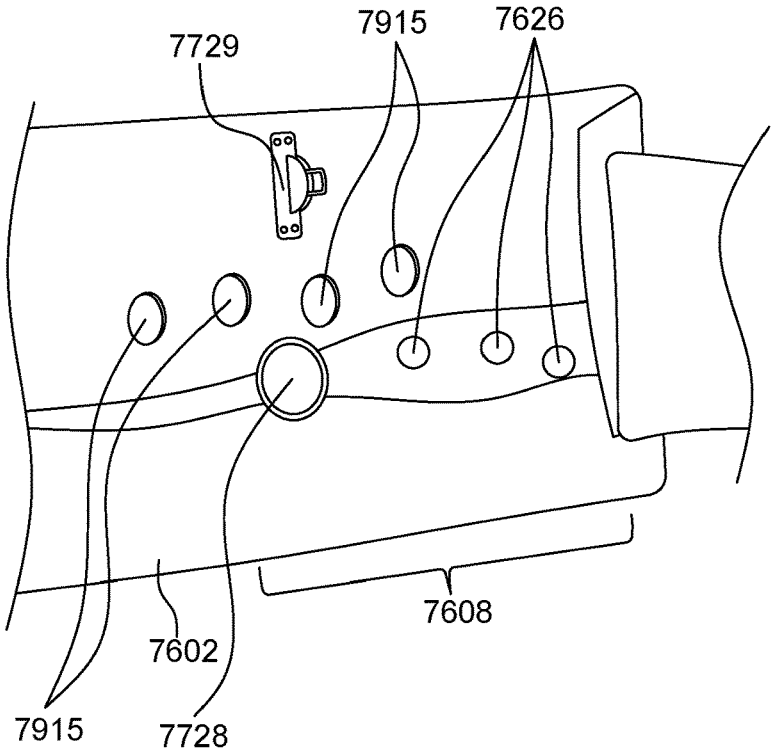

Referring now to FIGS. 77 and 79, the extender feature portion 7608 of the extender belt 7600 is located in the backside of the belt strap 7602 near the joint with the tongue strap 7604. The extender feature portion 7608 includes an extender button 7728, a plurality (e.g., three) extender holes 7626, and an extender hook 7729 built in or integral with the belt strap 7602. FIG. 79 also illustrates the fasteners 7915 (e.g., screws or plugs) that couple the button studs 7615 to the belt strap 7602.

Figure 81:
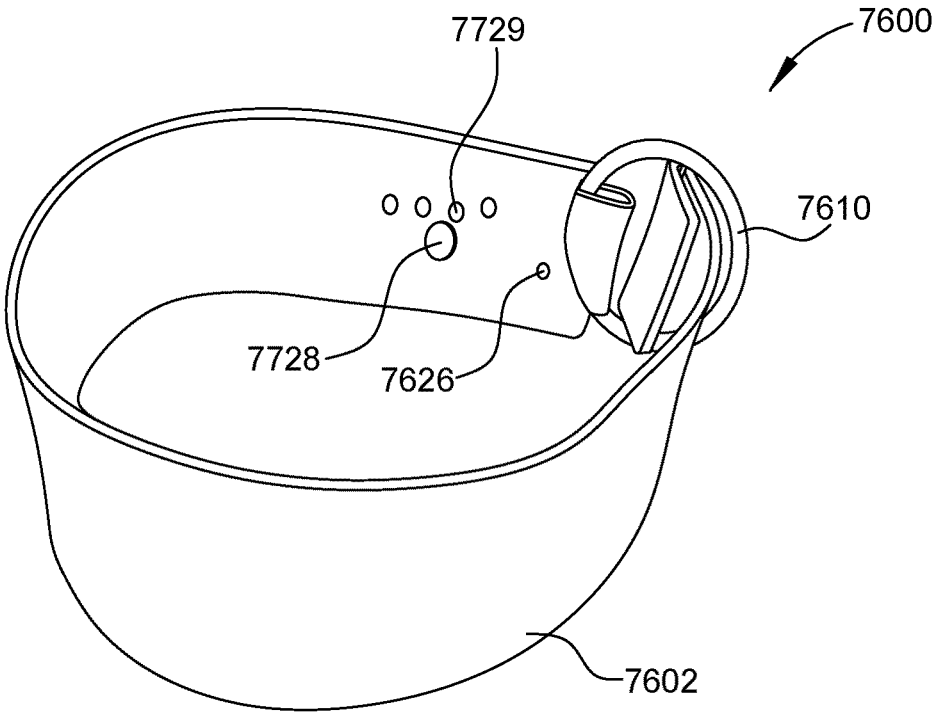
Figure 82:
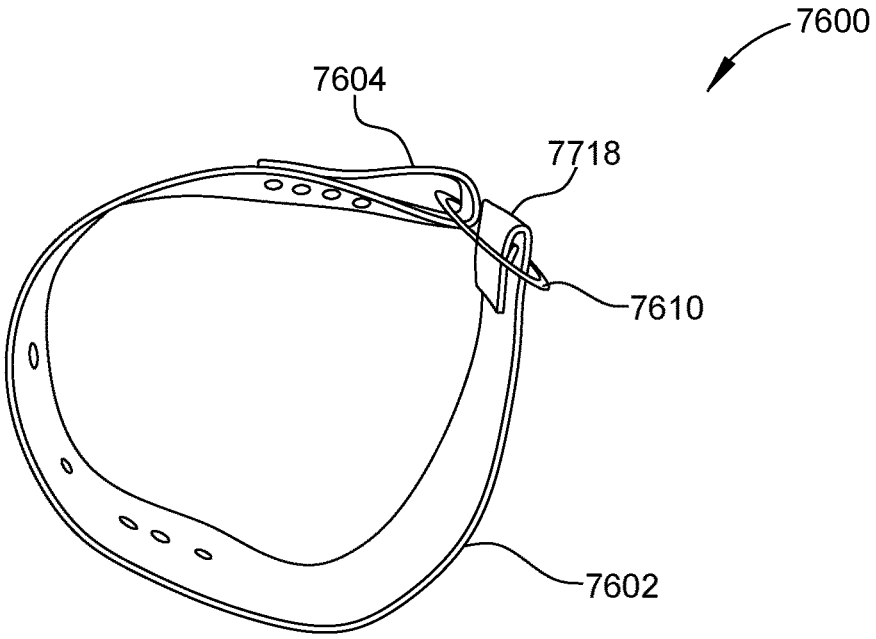
Figure 83:
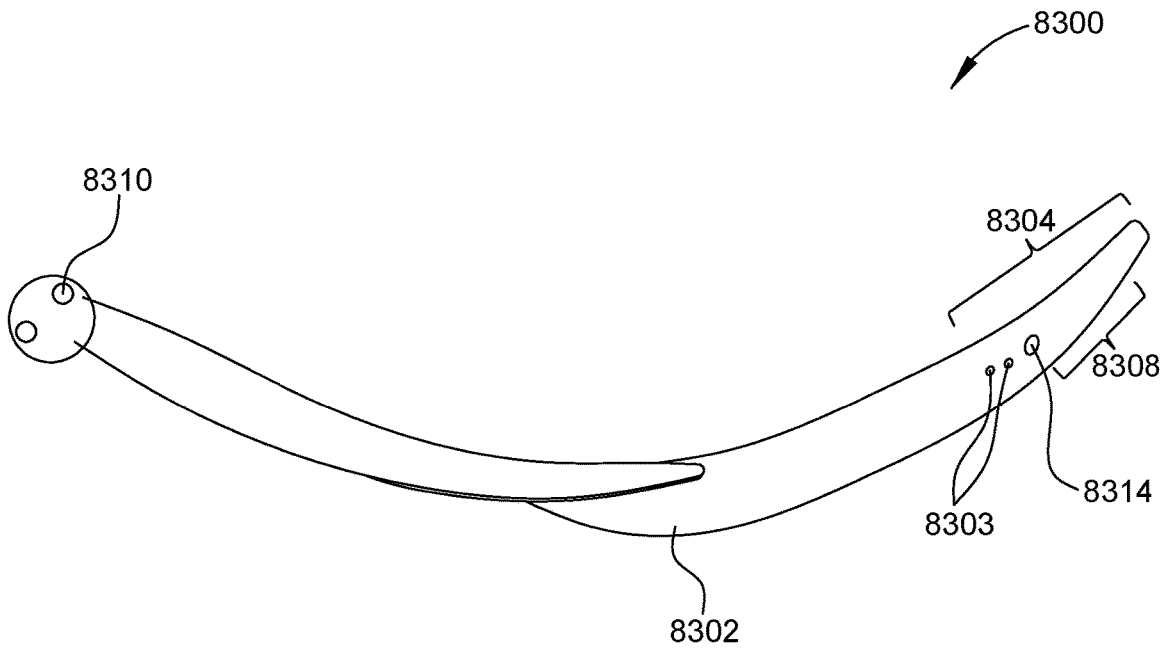

Referring now to FIGS. 79 and 81, the extender button 7728 couples to a pant buttonhole of pants or trousers. One of the extender holes 7626 is selected to receive a pant button of the pants or trousers. Alternatively, the extender hook 7729 hooks on or attaches to a pant bar of pants or trousers. Accordingly, the extender feature can be referred to as a multiple extender feature and the belt a multi-extender belt. Regardless, the extender belt 7600 is removeably coupled to the pants or trousers by the extender features.

Referring to FIGS. 76 and 80, the tongue strap 7604 is inserted into the opening 7611 of the buckle 7610, wrapped around bar 7612, and then fed back in the opposite direction along the front face of the belt strap 7602 forming a loop. One or more button stud holes 7603 in the tongue strap 7604 are aligned with one or more button studs 7615 of the belt strap 7602. The tongue strap 7604 is pushed inward toward the strap so that the holes 7603 engage the studs 7615 to removeably engage the tongue strap to the belt strap.

The extender belt 7600 is slightly contoured. The extender belt 7600 has a wide belt strap 7602 to cover over an open waistband and a partially open zipper. However, the wide belt strap deters the extender belt from being worn through the belt loops. Instead, the extender belt is designed to be worn as a mid/hip or waist belt.

Figure 100:
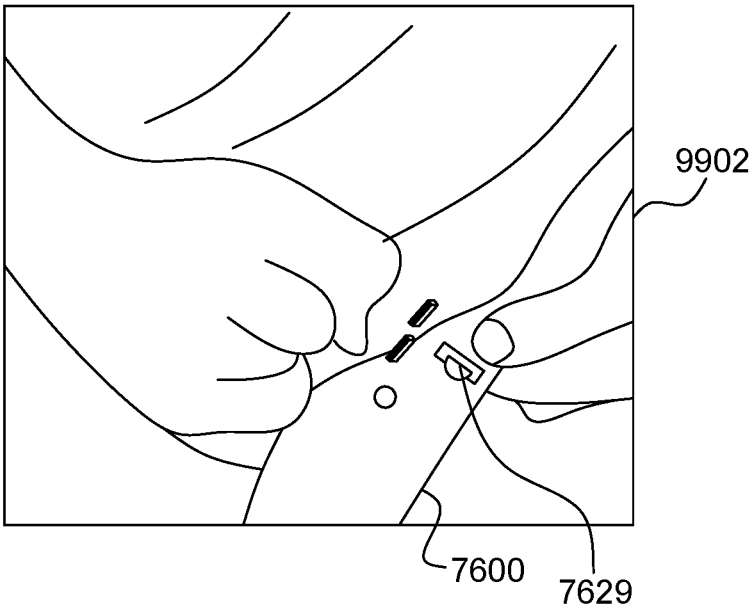
FIGS. 100-102 show views of the twelfth extender belt coupled to the pants or trousers shown in FIG. 99.
Figure 101:
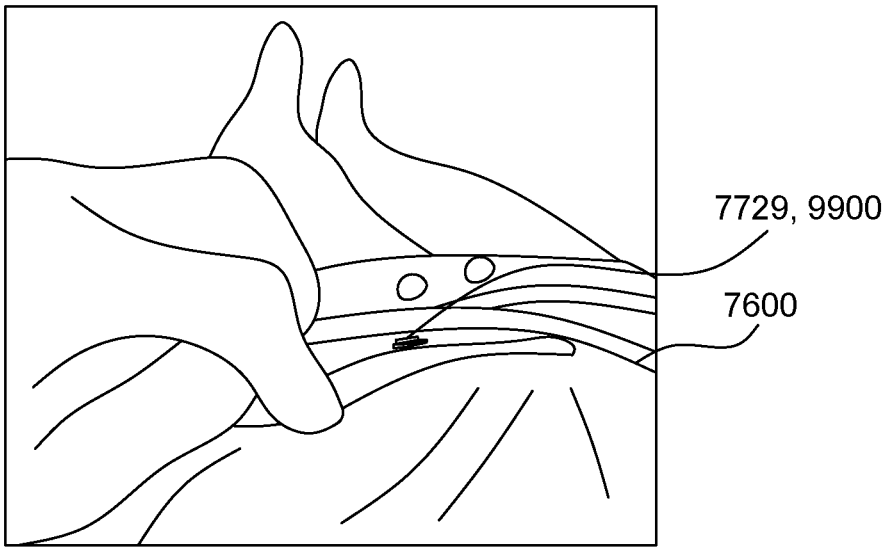
Figure 102:
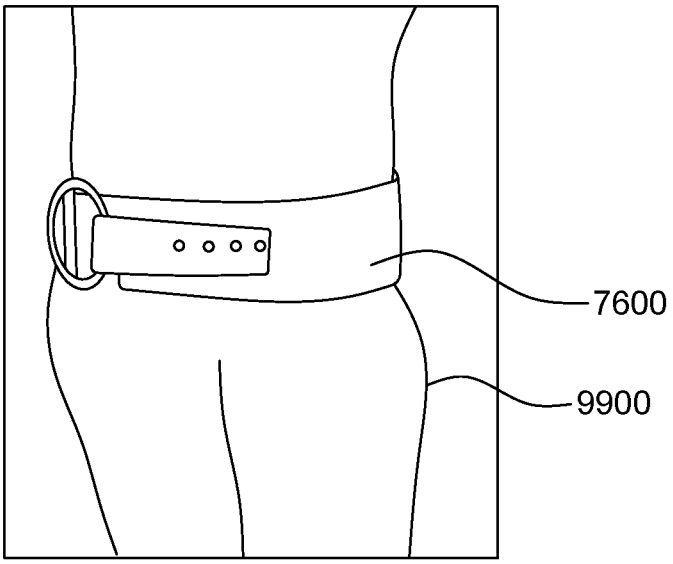

Referring now to FIGS. 99-102, the extender belt 7600 is configured to couple to a waistband 9910 of pants or trousers 9900 having a hook (see hook 7729 of the belt 7600) and bar 9902 waistband closure. The waistband 9910 of the patents 990 is too tight and will not close around the user/wearer. FIGS. 100-102 show views of the extender belt 7600 being coupled to the pants or trousers 9900 shown in FIG. 99.

As shown in FIGS. 100-101, the extender hook 7729 hooks on or attaches to the pant bar 9902 of the pants or trousers 9900. As shown in FIG. 102, the extender belt 7600 covers over the open waistband 9913 and the open zipper 9911. The hook couples to the pant bar to hold the belt to the pants. The button studs engage the stud openings to tighten the belt strap around the user's waist.

Snap-On Extender Belt

Referring now to FIGS. 83-90, a thirteenth embodiment of an extender belt 8300 is shown. The extender belt 8300 includes a brown leather belt strap 8302 and a solid oval silver hook buckle 8310. The extender belt 8300 further includes an extender feature portion 8308 hidden in the backside of the belt strap 8302. The belt strap 8302 has a tongue portion 8304 that includes a plurality of holes 8303 in the strap.

Figure 85:
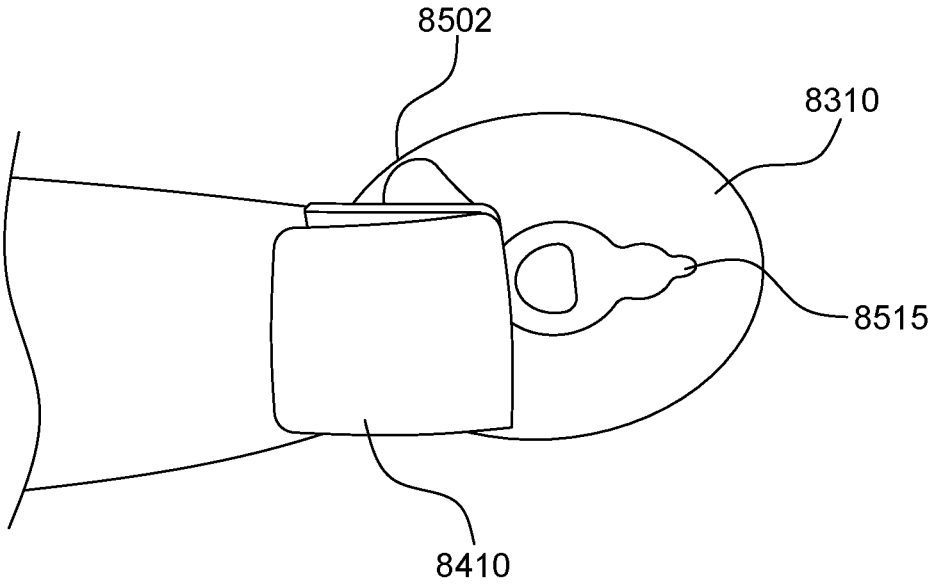

The buckle 8310 has a solid metal face that does not have an opening to receive the belt strap 8302. As shown in FIG. 85, the buckle 8310 has a pivotal oval link 8502, a hinged link, with an opening to receive the tongue portion 8304 of the belt strap 8302. The buckle 8310 further includes a hook 8515 to engage the holes 8303 located in the tongue portion of the belt strap 8302 to help secure the belt 8300 around the user/wearer.

Figure 84:
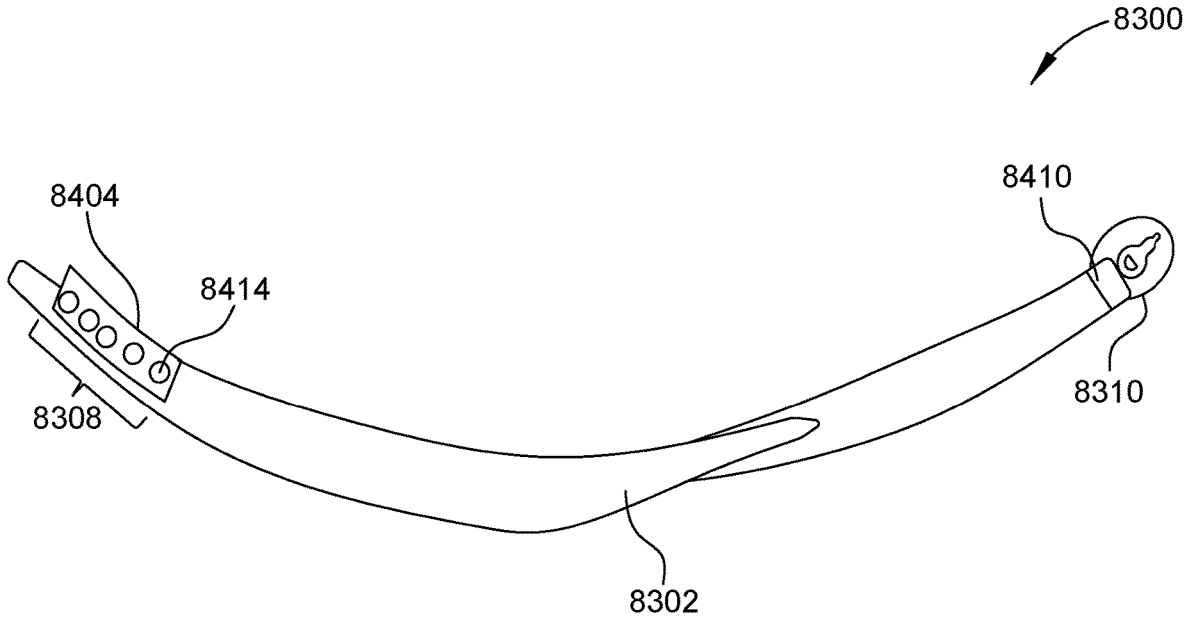

As can be seen in FIGS. 84 and 85, the buckle 8310 is secured to the strap 8302 by having an end of the strap inserted through the opening in the link 8502, wrapped back over a bar of the buckle link, and folding over to form a loop 8410. After the loop, the end of the strap is fastened to a backside of the belt strap 8302. These layers of belt strap can fastened together by sewing thread into holes between each with a needle. Alternatively, the layers of belt strap can be coupled together by one or more male-female snaps.

Figure 90:
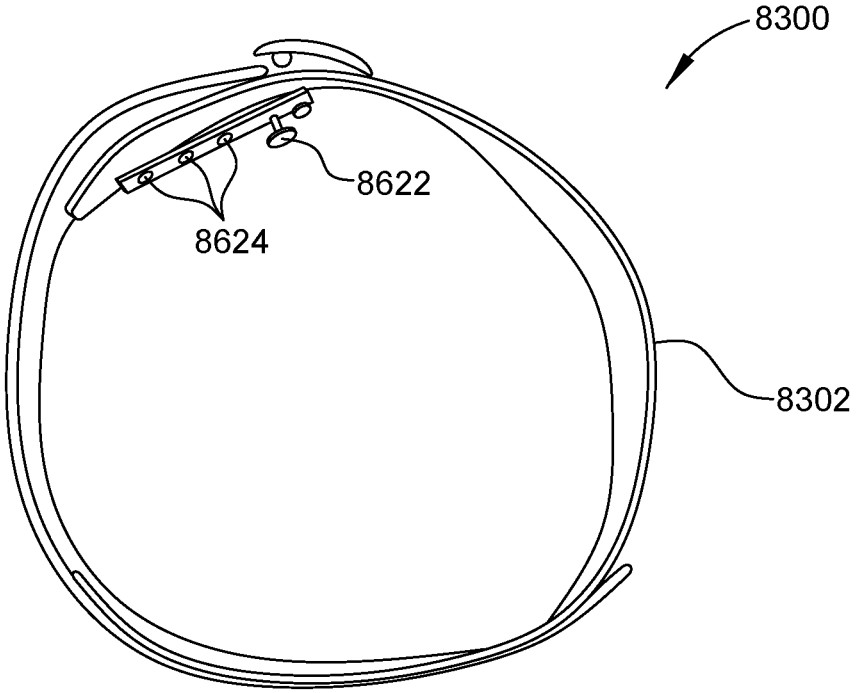

With one end of the strap coupled to the buckle, the tongue portion of the strap can be inserted into and through the opening in the link 8502 going parallel with the strap as can be seen in FIG. 90. The hook 8515 of the buckle 8310 can then engage (hook into) the holes 8303 in the tongue portion of the belt strap 8302.

Figure 86:
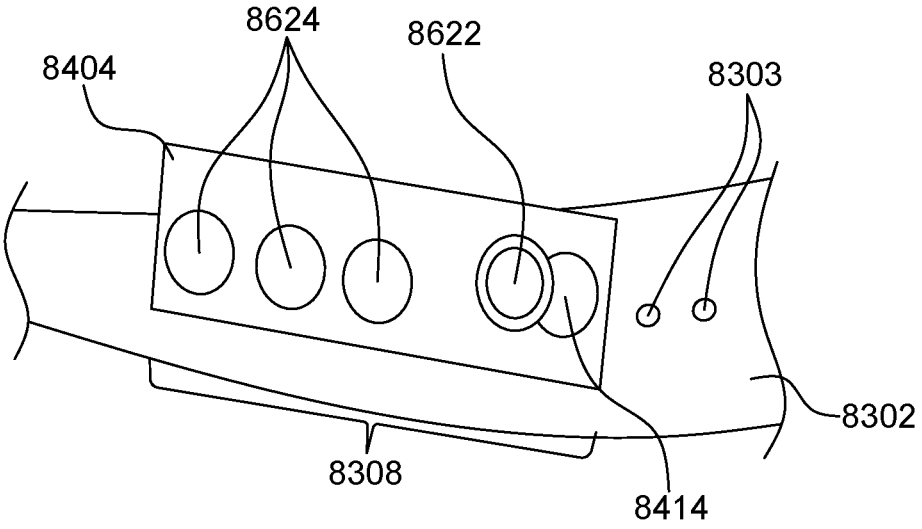
Figure 87:
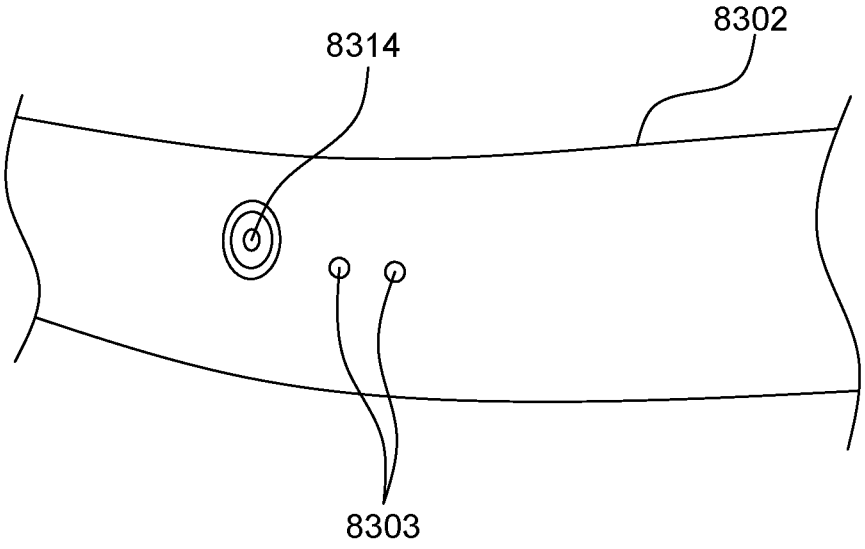

Referring now to FIGS. 84 and 86, the extender feature portion 8308 of the belt includes an extender strip 8404 having an extender button 8622 and a plurality (e.g., three) of extender buttonholes 8624. The extender strip 8404 can be sewn onto the backside of the strap. The extender strip 8404 can further include a male or female snap 8414 to removeably couple the extender feature portion to the backside of the strap 8302. As shown in FIG. 87, the tongue portion of the strap further includes a respective female or male snap 8314 to couple to the male or female snap 8414 of the extender strip.

Figure 89:
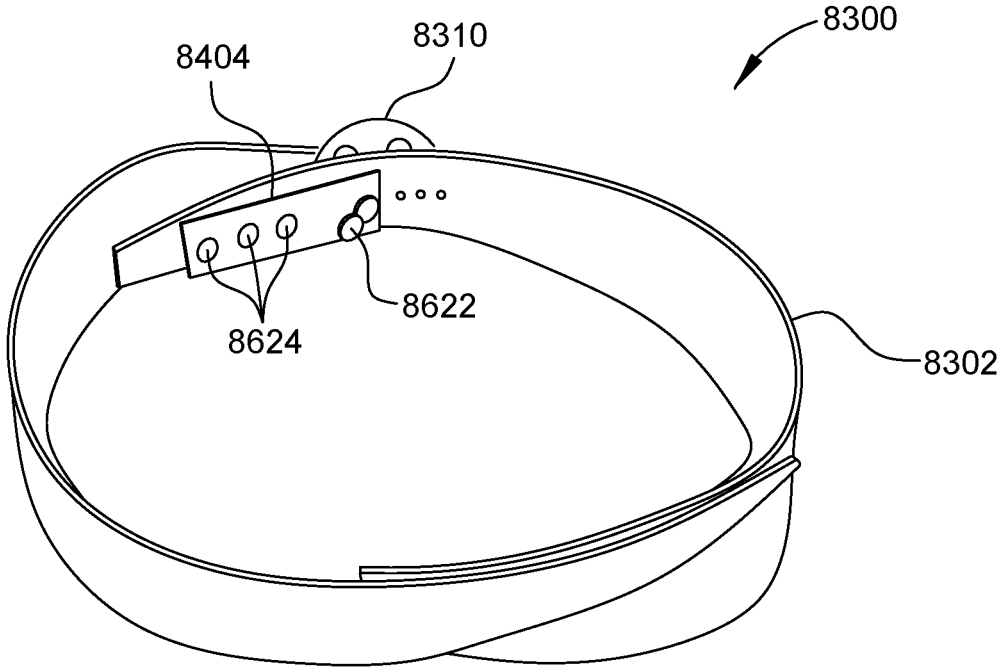

Referring now to FIGS. 89-90, the extender strip 8404 is removable and can be snapped on or off of the backside of the strap 8302. When the extender belt is worn, the extender button 8622 extends in towards the wearer/user to couple to a pant buttonhole. One extender hole 8624 of the plurality is selected to receive a pant button of pants or trousers.

Figure 88:
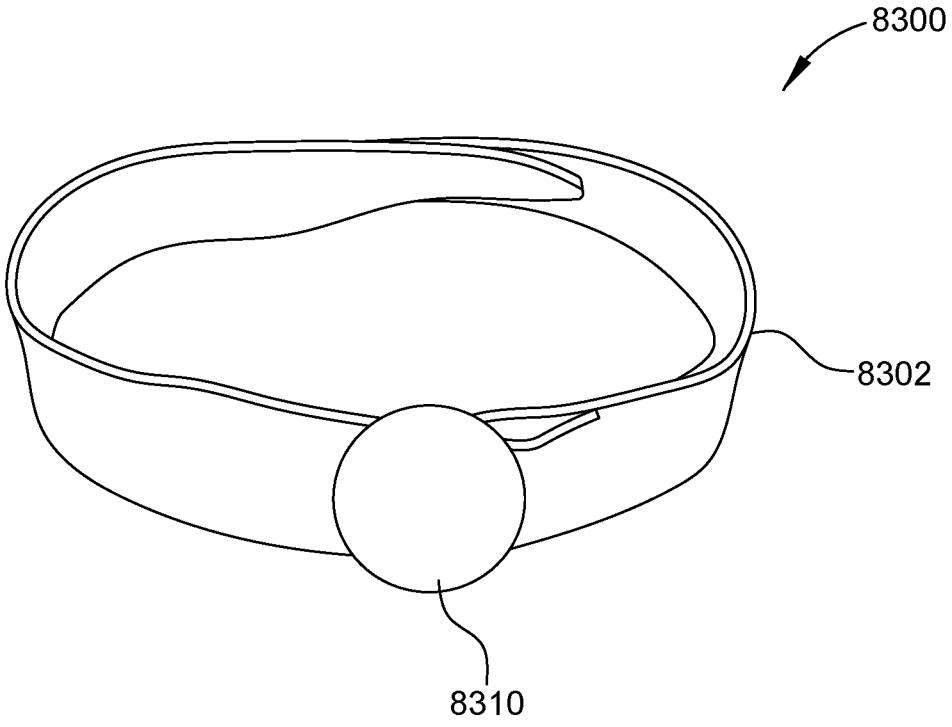

The extender belt 8300 is slightly contoured and can be worn through the belt loops of pants or trouser. The same design for the extender belt can be used on a slide belt. As shown in FIG. 88, the extender feature portion of the belt is hidden from view by the strap 8302. The face of the buckle 8310 is sufficiently large to cover over an open waistband and a partially open zipper in pants or trousers.

Referring now to FIGS. 91-98, a fourteenth embodiment of an extender belt 9100 is shown. The extender belt 9100 includes a black leather belt strap 9102 with a extender feature portion 9108, and a leather sleeve or belt loop 9120 coupled to the leather belt strap. The extender belt 9100 is a low cost belt without a buckle.

At one end, the belt strap 9102 has a cover face 9125 that is round and wider that other portions so it is configured to provide coverage over an open waistband and/or open zipper. At an opposite end, the belt strap 9102 includes a tongue portion 9104 with a plurality (e.g., two) of button plug (stud) holes 9103. The tongue portion 9104 is configured to be inserted into and through the sleeve or belt loop 9120 near the cover face 9125.

Figure 91:
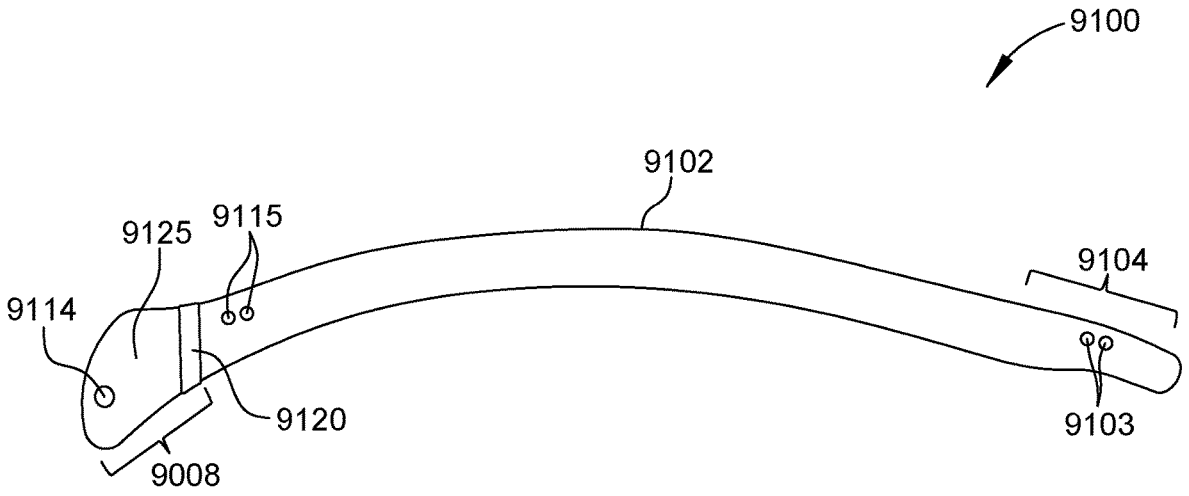
Figure 93:
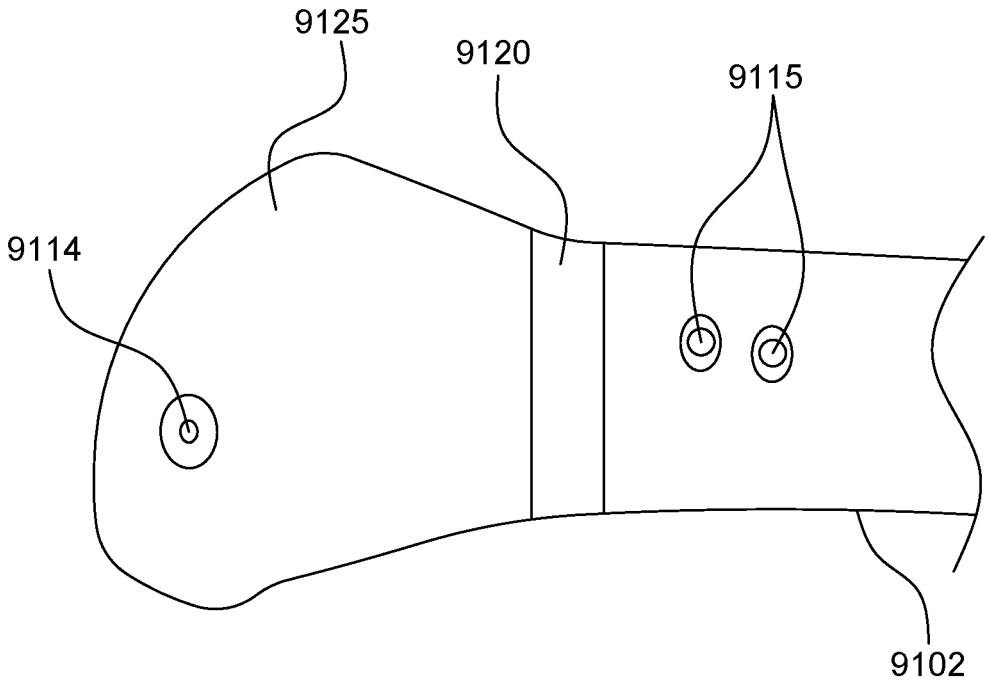

Referring now to FIGS. 91 and 93. Adjacent the belt loop 7120, the belt strap 9102 has a plurality (e.g., two) of button plugs (studs) 9115 configured to receive one or more of the plurality of button plug holes 9103. FIGS. 91 and 93 further illustrate a backside of a male or female snap 9114 coupled to the cover face 9125 of the belt strap 9102. The male or female snap 9114 is configured to receive a respective female or male snap of the extender feature portion.

As shown in FIGS. 91 and 93, the sleeve or belt loop 9120 is coupled to the belt strap 9102 near the cover face 9125. When the tongue portion 9104 of the strap is inserted through the sleeve or belt loop 9120, sleeve or belt loop 9120 helps the tongue portion overlap and lay flat against the outside surface of another layer of the strap. The tongue portion 9104 when in the belt loop is further secured to the surface of the strap by the plug holes 9103 engaging the button plugs 9115.

Figure 92:
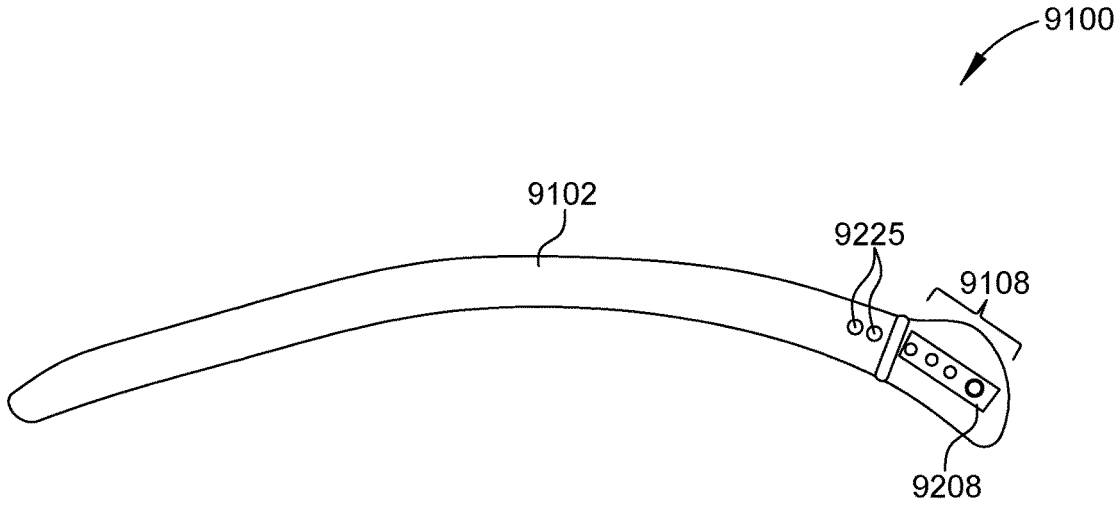
Figure 94:
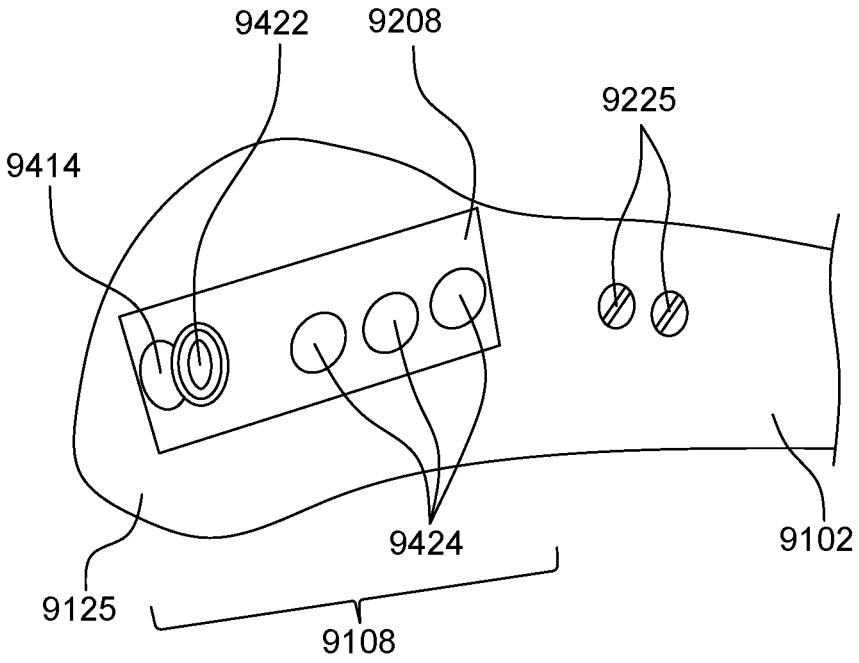
Figure 95:
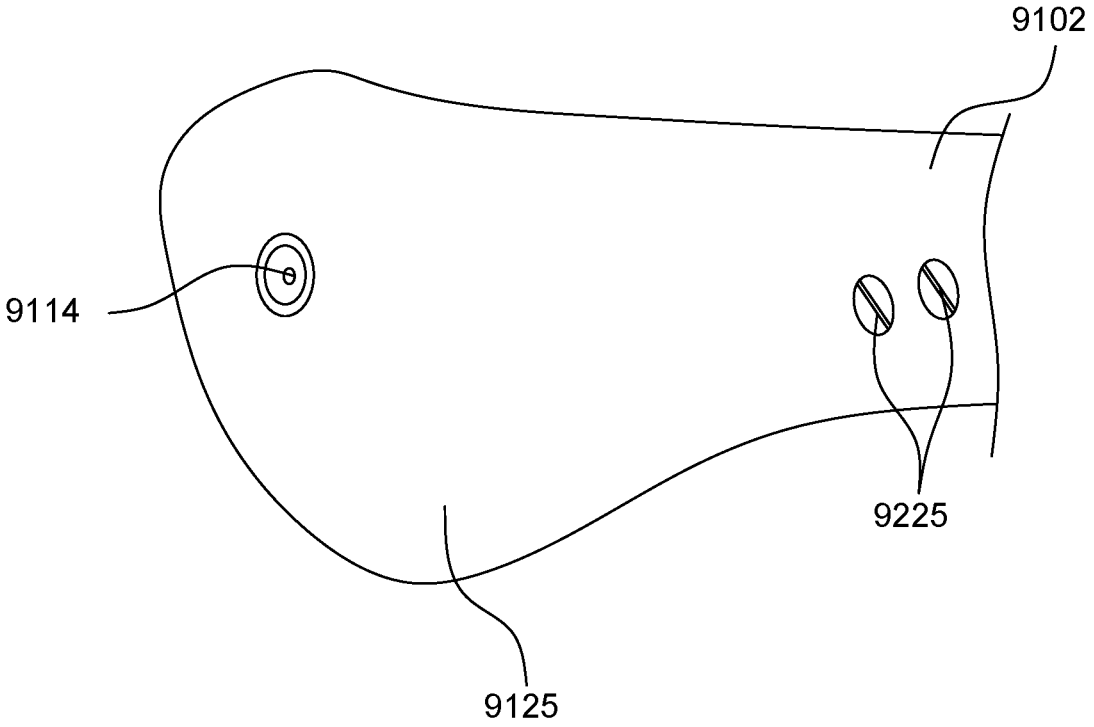

Referring now to FIGS. 92 and 94, the extender feature portion 9108 is located in the backside of the strap 9102 hidden behind the wide area of the cover face 9125. The extender feature portion 9108 includes the an extender strip 9208 having a female or male snap 9414 that snaps into the snap 9114 of the belt strip. That is, the extender feature portion 9108 can snap onto the belt strap 9102. FIG. 95 illustrates a female snap 9114 coupled to the cover face portion 9125 of the strap 9102. The female snap 9114 is configured to receive a male snap 9414 of the extender strip 9208. In an alternate embodiment, the extender strip is coupled to the backside of the strap by sewing thread into holes between each with a needle. A pair of fasteners 9225 (e.g., screws) in the backside hold the button plugs (studs) 9115 coupled to the strap 9102.

The extender strip 9208 includes an extender button 9422 facing inward toward the user/wearer and a plurality of extender buttonholes 9424 in a row adjacent the extender button. The extender button 9422 is pressed into and engages a pant buttonhole in pants or trousers. Each of the plurality of extender buttonholes 9424 is configured to receive and engage a pant button of the pants or trousers. The extender strip 9208 can be removeably coupled to pants or trousers. With the snaps, the extender strip 9208 can be removeably coupled to the pants or trousers separate and apart from the belt strap 9102. In an alternate embodiment, the extender strip is coupled to the backside of the strap by sewing thread into holes between each with a needle.

Figure 97:
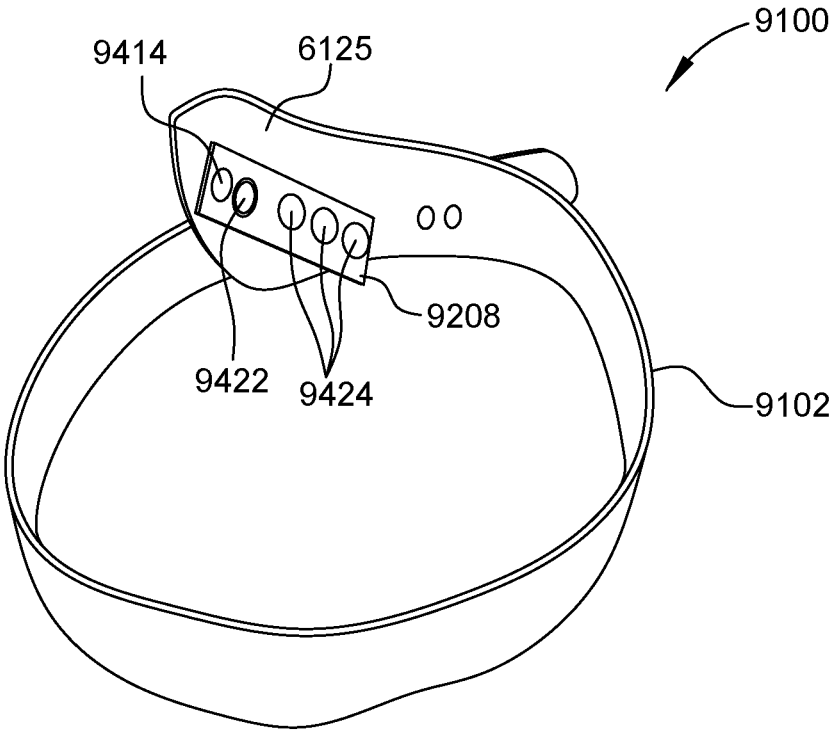
Figure 98:
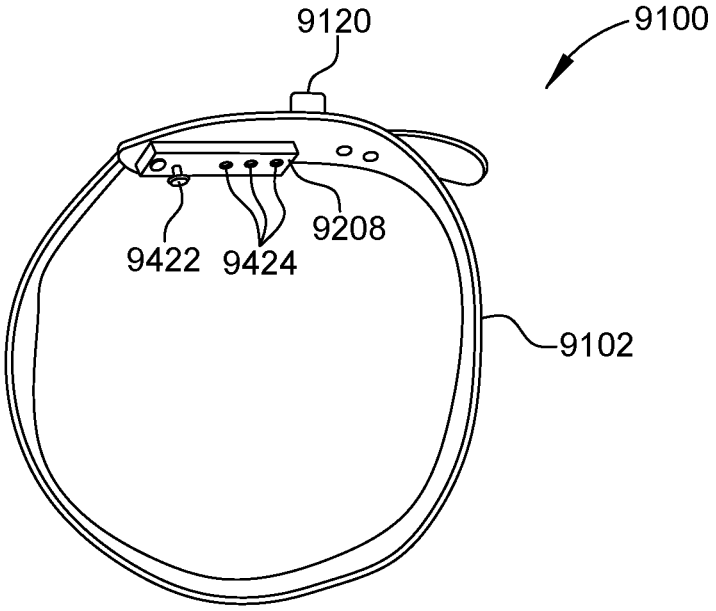

Referring now to FIGS. 94 and 97-98, the button 9422 is engaged into a pant buttonhole of a pant or trouser being worn by the user/wearer. One of the extender holes 9424 is selected to receive a pant button of the pant or trouser to bridge over an open waistband. The pant button is pressed into and engages the selected extender hole. If not already fixed onto the strap, the snap of the extender strip 9208 is pressed into and engages the snap of the belt strap 9102.

Figure 96:
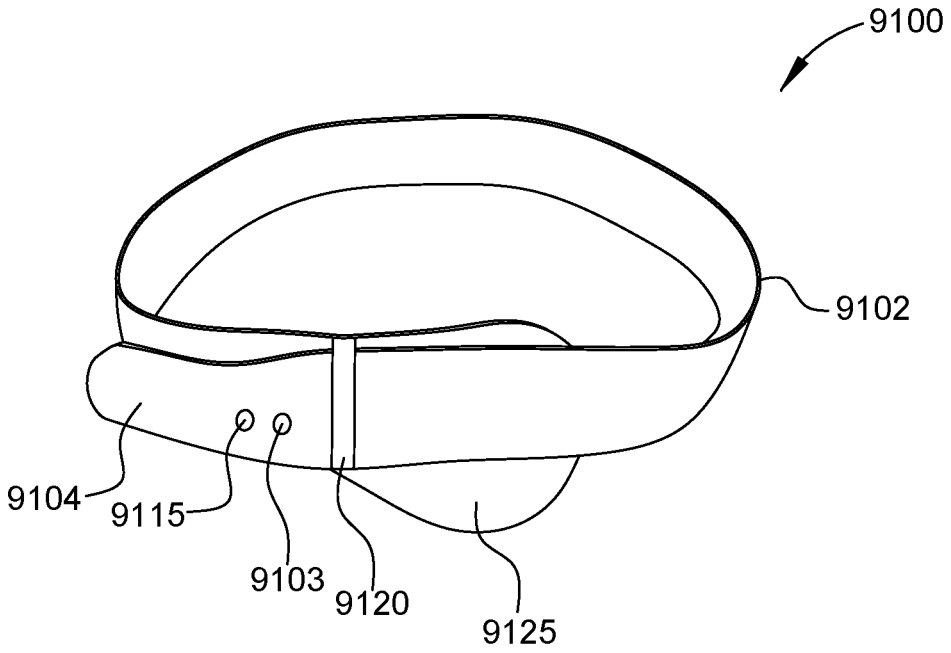

Referring now to FIGS. 91, 96, and 98, the tongue portion 9104 of the belt strap is inserted into and through the belt loop 9120. One or more button plug holes (stud holes) 9103 in the tongue portion 9104 are aligned with one or more button plugs (studs) 9115. The tongue overlaps and is pressed against the surface of another part of the strap 9102 so that the one or more plug holes (stud holes) 9103 engage with the one or more button plugs (studs) 9115. The tongue portion of the strap extending through the belt loop 9120 is thereby removeably coupled to another part of the strap.

As shown in FIG. 96, the extender belt 9100 is slightly contoured and can be worn by being inserted through the belt loops of pants or trousers. The extender feature portion 9108 is hidden from view by the cover face portion 9125 of the belt strap 9102. The cover face of the belt strap is also sufficiently large in area to cover over an open waistband and a partially open zipper in pants or trousers.

CONCLUSION

While certain exemplary embodiments have been described and shown in the accompanying drawings, it is to be understood that such embodiments are merely illustrative of and not restrictive on the broad invention, and that the embodiments of the invention not be limited to the specific constructions and arrangements shown and described, since various other modifications can occur to those ordinarily skilled in the art.

While this specification includes many specifics, these should not be construed as limitations on the scope of the disclosure or of what can be claimed, but rather as descriptions of features specific to particular implementations of the disclosure. Certain features that are described in this specification in the context of separate implementations can also be implemented in combination in a single implementation. Conversely, various features that are described in the context of a single implementation can also be implemented in multiple implementations, separately or in sub-combination. Moreover, although features can be described above as acting in certain combinations and even initially claimed as such, one or more features from a claimed combination can in some cases be excised from the combination, and the claimed combination can be directed to a sub-combination or variations of a sub-combination. Accordingly, the claimed invention is limited only by patented claims that follow below.

What is claimed is:

1. An extender belt for pants and trousers, the extender belt comprising:

a belt strap including a front side and a back side, the belt strap further including a first end portion extending in a first longitudinal direction and a second end portion extending in a second longitudinal direction opposite from the first longitudinal direction defining a longitudinal axis of the belt strap, the first end portion of the belt strap comprises a series of a plurality of openings in which each of the plurality of openings is configured to receive a protrusion of a belt buckle;

a belt buckle coupled to the belt strap and positioned at the second end portion, the belt buckle having a pivotal protrusion configured to extend into an opening of the plurality of openings in the belt strap; and an extender strip positioned in parallel with the longitudinal axis of the belt strap and attached to the belt strap, the extender strip including (i) a plurality of openings in a row each being configured to receive a pant button and (ii) an extender button coupled to the extender strip positioned adjacent to the row of the plurality of openings, the extender button extending inwardly from the back side of the belt strap when the extender strip is attached to the belt strap and configured for insertion into a buttonhole of pants when the belt strap is formed as a loop with the first end portion overlapping the second end portion.

2. The extender belt of claim 1, wherein the belt strap has a wide portion at the second end portion configured to cover over an open zipper and an open waistband of the pants.

3. The extender belt of claim 1, wherein the extender strip, coupled to the back side of the belt strap, is sized with a width less than a width of the belt strap to reside entirely behind the back side of the belt strap.

4. The extender belt of claim 1, wherein the extender strip includes a snap that is coupled to a mating snap positioned on the back side the belt strap for attachment of the extender strip to the belt strap.

5. The extender belt of claim 1, wherein the extender strip is attached to the belt strap by sewing thread.

6. An extender belt for pants and trousers, the extender belt comprising:

a belt strap including a front side and a back side, the belt strap further including a first end portion extending in a first longitudinal direction and a second end portion extending in a second longitudinal direction opposite from the first longitudinal direction defining a longitudinal axis of the belt strap;

a connecting device coupled to the belt strap at the second end portion of the belt strap, the connecting device being attached to the first end portion of the belt strap forming a loop with the belt strap;

an extender strip having an end coupled to the back side of the belt strap at the second end portion and positioned in parallel with the longitudinal axis of the belt strap, the extender strip including (i) a plurality of openings in a row each being configured to receive a pant button and (ii) an extender button coupled to the extender strip and positioned inline with the row of the plurality of openings, the extender button extending inwardly from the back side of the belt strap when the extender strip is attached to the belt strap and configured for insertion into a buttonhole of pants when the belt strap is formed as a loop with the first end portion overlapping the second end portion.

7. The extender belt of claim 6, further comprising:

an extender hook coupled to the extender strip offset from the row of the plurality of openings, the extender hook configured to extend in a direction away from the back side and to insert into a bar of pants operating as a latch.

8. The extender belt of claim 6, wherein the extender strip includes a snap that is coupled to a mating snap positioned on the back side the belt strap for attachment of the extender strip to the belt strap.

9. The extender belt of claim 6, wherein the extender strip is coupled to the belt strap by sewing thread into holes in the extender strip and the belt strap.

10. The extender belt of claim 6, wherein the extender strip, coupled to the back side of the belt strap, is sized with a width less than a width of the belt strap to reside entirely behind the back side of the belt strap.

11. The extender belt of claim 6, wherein the connecting device is a belt buckle.

12. The extender belt of claim 6, wherein the connecting device being attached to the first end portion of the belt strap using snaps.

13. An extender belt for pants and trousers, the extender belt comprising:

a belt strap including a front side and a back side, the belt strap further including a first end portion extending in a first longitudinal direction and a second end portion extending in a second longitudinal direction opposite from the first longitudinal direction defining a longitudinal axis of the belt strap;

a belt buckle pivotally coupled to the belt strap at the second end portion, the belt buckle having a pivotal protrusion configured to extend into an opening of a series of a plurality of openings positioned at the first end portion of the belt strap;

an extender strip having an end coupled to the belt strap at the second end portion and positioned in parallel with the longitudinal axis of the belt strap, the extender strip including a plurality of openings in a row each being configured to receive a pant button; and an extender hook coupled to the extender strip, the extender hook extending inwardly from the back side of the belt strap when the extender strip is attached to the belt strap and configured to extend into a bar of pants when the belt strap is formed as a loop with the first end portion overlapping the second end portion.

14. The extender belt of claim 13, wherein the extender strip includes a snap and is coupled to a mating snap positioned on the back side the belt strap by the strap.

15. The extender belt of claim 13, wherein the extender strip is coupled to the belt strap by sewing thread into holes in the extender strip and the belt strap.

16. The extender belt of claim 13, wherein the extender strip, coupled to the back side of the belt strap, is sized with a width less than a width of the belt strap to reside entirely behind the back side of the belt strap.

* * * * *